US012286266B2

(12) United States Patent
Mora Linares

(10) Patent No.: US 12,286,266 B2
(45) Date of Patent: Apr. 29, 2025

(54) COLLAPSIBLE TRAY

(71) Applicant: Jorge Ricardo Mora Linares, Mississauga (CA)

(72) Inventor: Jorge Ricardo Mora Linares, Mississauga (CA)

( * ) Notice: Subject to any disclaimer, the term of this patent is extended or adjusted under 35 U.S.C. 154(b) by 266 days.

(21) Appl. No.: 18/127,806

(22) Filed: Mar. 29, 2023

(65) Prior Publication Data

US 2023/0322436 A1 Oct. 12, 2023

Related U.S. Application Data

(60) Provisional application No. 63/328,867, filed on Apr. 8, 2022.

(51) Int. Cl.
*B65D 25/28* (2006.01)
*B65D 6/18* (2006.01)

(52) U.S. Cl.
CPC ..... *B65D 11/1846* (2013.01); *B65D 25/2835* (2013.01)

(58) Field of Classification Search
CPC ..... B65D 11/1846; B65D 25/2835; B65D 11/186; B65D 11/00; B65D 11/18; B65D 71/0003; B65D 21/00; B65D 21/0209; B65D 1/225
See application file for complete search history.

(56) References Cited

U.S. PATENT DOCUMENTS

| | | | | |
|---|---|---|---|---|
| 9,527,626 | B1 * | 12/2016 | Coronado | B65D 11/186 |
| 2002/0070267 | A1 * | 6/2002 | Okamura | B65D 11/186 229/117.04 |
| 2013/0161330 | A1 * | 6/2013 | Gualersi | B65D 25/04 220/666 |
| 2018/0339801 | A1 * | 11/2018 | Strange | B65D 1/225 |
| 2022/0048666 | A1 * | 2/2022 | Vandewiele | B65D 1/225 |

* cited by examiner

*Primary Examiner* — Don M Anderson
(74) *Attorney, Agent, or Firm* — H. Brock Kolls

(57) ABSTRACT

The present invention relates to a collapsible tray with foldable sides that includes a trapezoid panel and two triangle panels. Panel connectors secure together in a movable manner each triangle panel to the trapezoid panel. Side panels are movably interconnected at each end to the foldable side. A base is movably interconnected to each foldable side and each side panel. In use, when a collapsing force is applied to the trapezoid panel or the side panel, the adjacency between the trapezoid panel and the triangle panel folds inward allowing the foldable side, and the side panels to fold flat on top of the base. A drawer is slidably connected to the base where a user can slide the drawer out from the bottom to access contents inside and slide the drawer back under the base for storage. The drawer is useable by the user when the collapsible tray is closed.

23 Claims, 46 Drawing Sheets

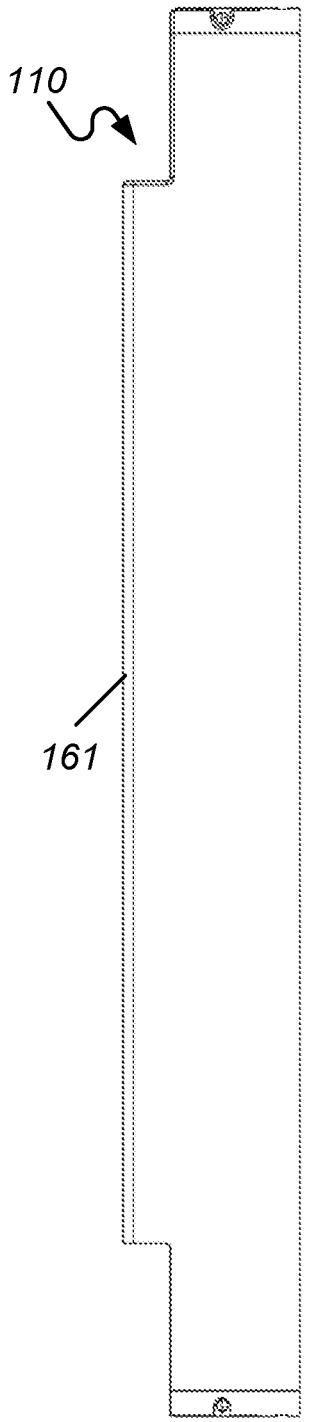
Fig. 6E
Fig. 6F
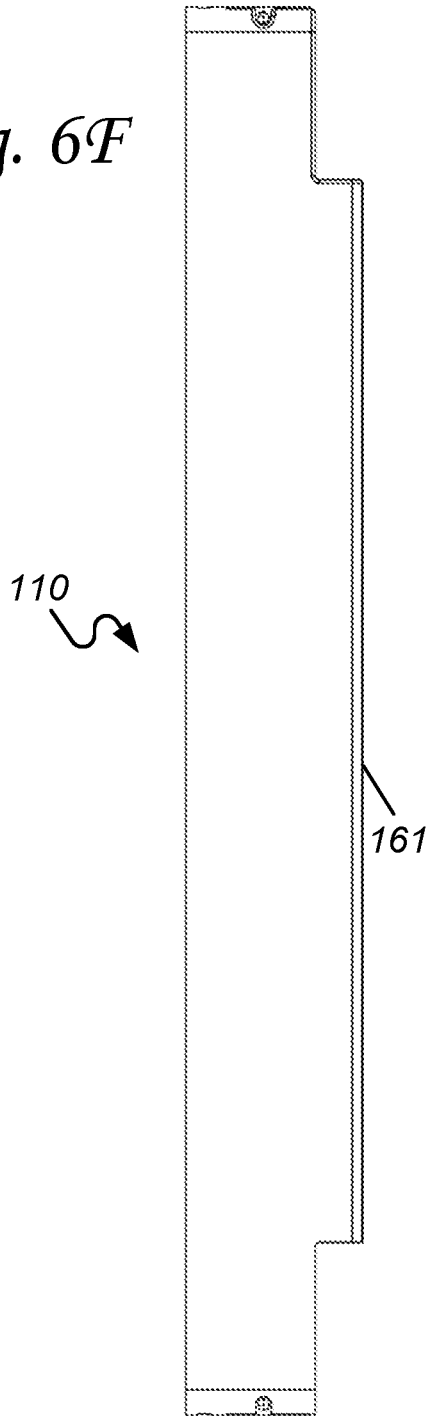

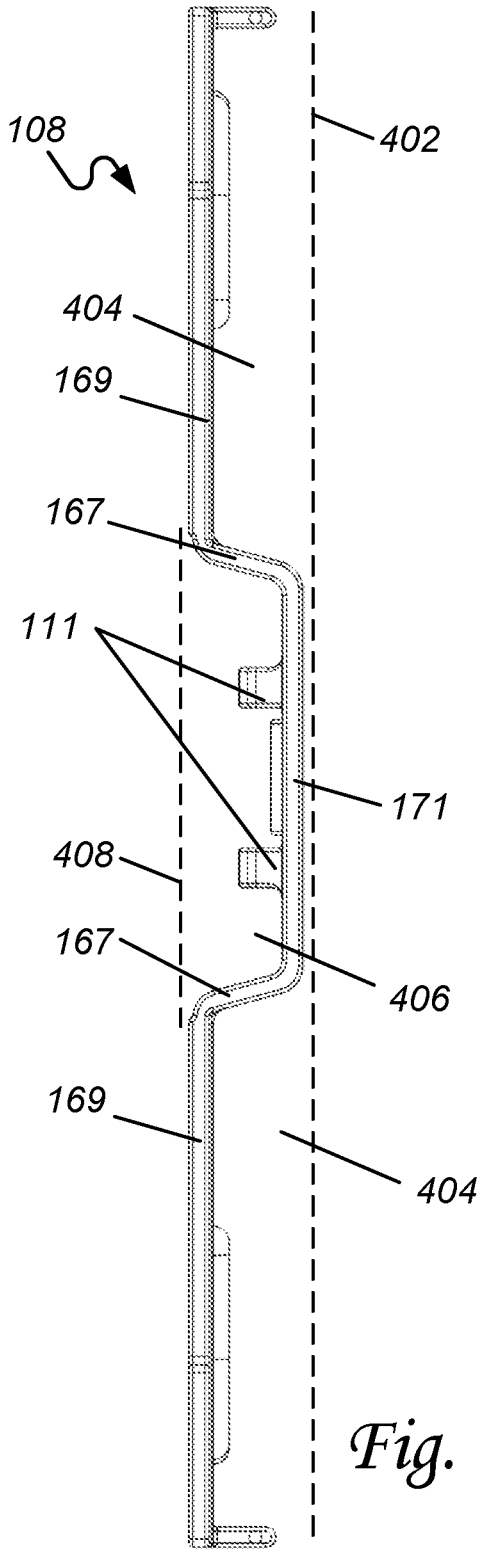
Fig. 7C
Fig. 7D
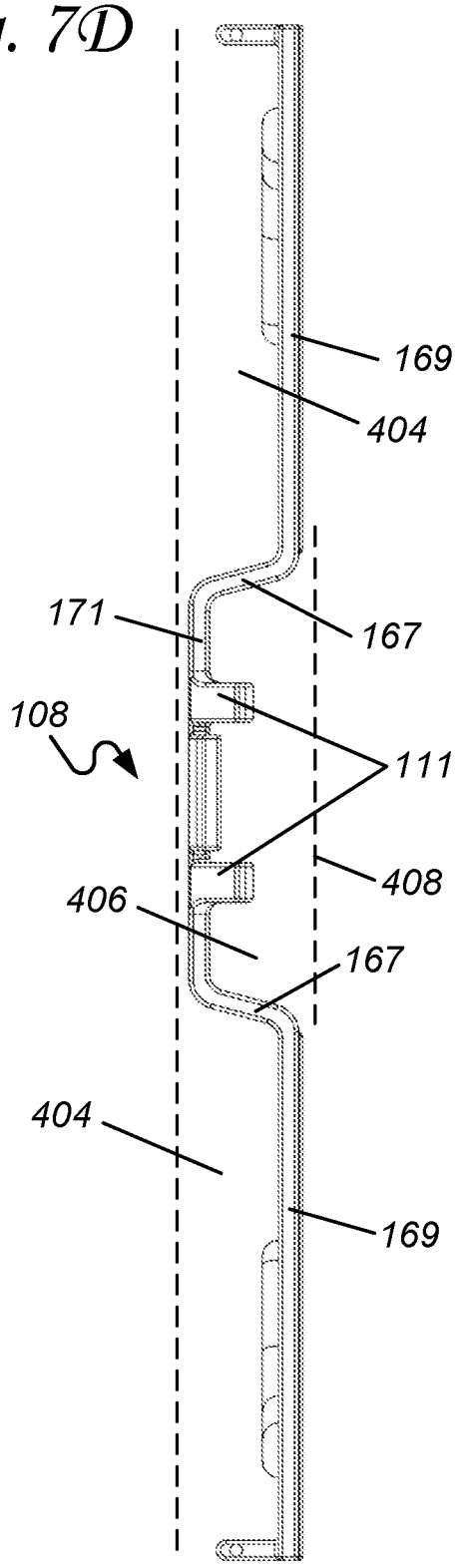

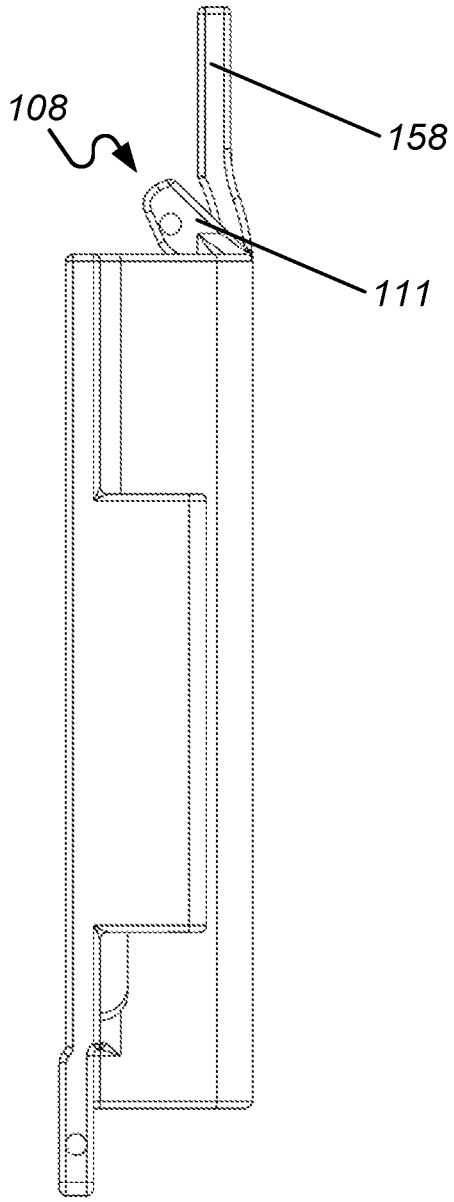
Fig. 7E
Fig. 7F
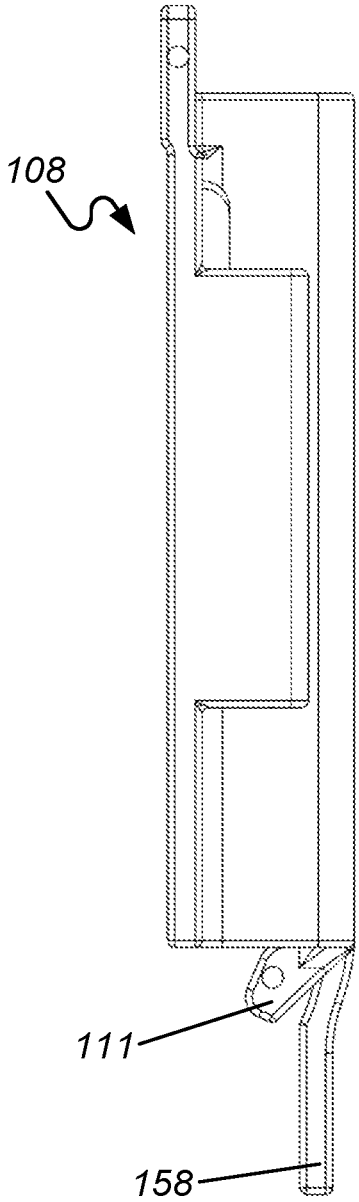

112

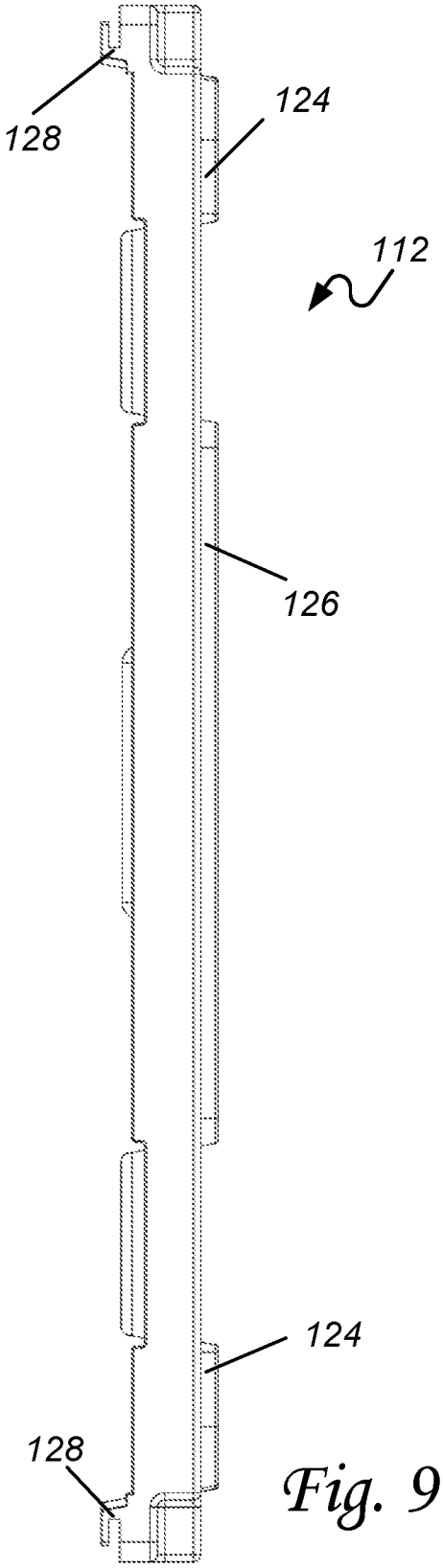
Fig. 9G
Fig. 9H
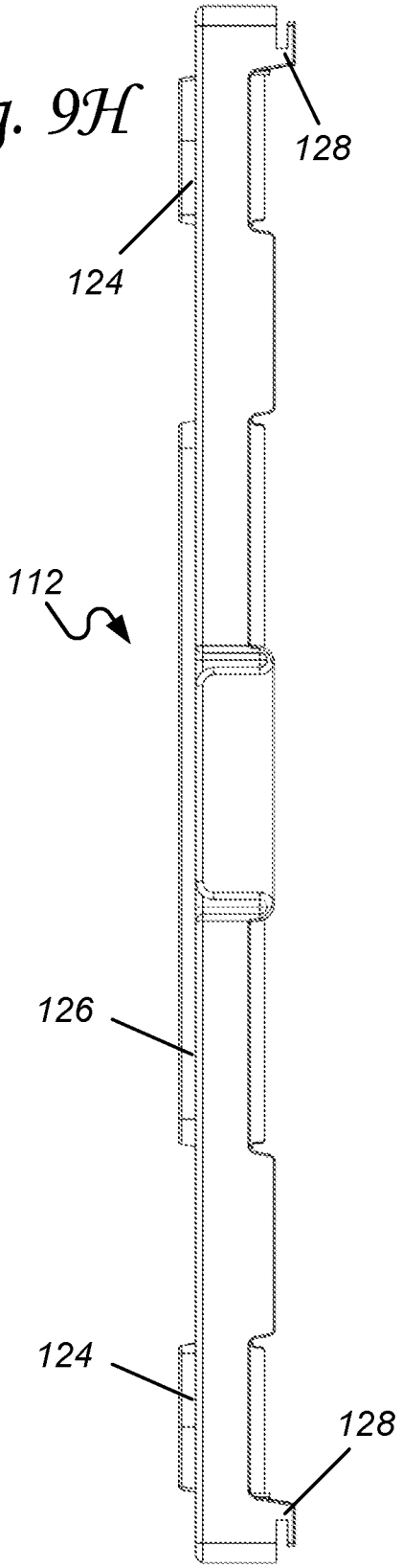

COLLAPSIBLE TRAY

CROSS-REFERENCE TO RELATED APPLICATIONS

This application contains subject matter which is related to the subject matter of the following application. The below-listed application is hereby incorporated herein by reference in its entirety:

This is a U.S. non-provisional application that claims the benefit of a U.S. provisional application, Ser. No. 63/328,867, inventor Jorge Ricardo Mora Linares, entitled "Collapsible Tray", filed Apr. 8, 2022.

TECHNICAL FIELD OF THE INVENTION

This invention relates to a collapsible tray with foldable sides that includes a trapezoid panel and two triangle panels. Panel connectors secure together in a movable manner each triangle panel to the trapezoid panel. Side panels are movably interconnected at each end to the foldable side. A base is movably interconnected to each foldable side and each side panel. In use, when a collapsing force is applied to the trapezoid panel or the side panel, the adjacency between the trapezoid panel and the triangle panel folds inward allowing the foldable side, and the side panels to fold flat on top of the base. A drawer is slidably connected to the base such that a user can slide the drawer out from the bottom of the base to access contents inside and then slide the drawer back under the base for storage. The drawer is useable by the user even when the collapsible tray is folded closed.

BACKGROUND OF THE INVENTION

Before our invention, while convenient when in use, a shortcoming of prior carriers is that they can occupy a lot of wasted space when on shelves and stacked together with other bulky prior carriers when not in use. In this regard, an inability to fold flat for storage renders prior carriers difficult to store when not in use.

Another shortcoming of prior carriers is that small parts can't easily be sorted and stored in a manner that is easy for a user to access but does not interfere with larger objects when they are placed in the prior carrier. In this regard, as an example and not a limitation, small items such as nuts and bolts or fishing hooks, lures, and weights can get lost amongst the larger item when placed together in prior carriers and such smaller items can't easily be sorted and remain sorted in protective compartments.

The present invention addresses these and other shortcomings by providing a collapsible tray. For these reasons and shortcomings as well as other reasons and shortcomings, there is a long-felt need that gives rise to the present invention.

SUMMARY OF THE INVENTION

The shortcomings of the prior art are overcome and additional advantages are provided through the provision of a collapsible tray comprising more than one foldable side. The foldable side comprises a trapezoid panel that has a tapered edge along the left and right sides, a first panel connector hole proximate to each of the tapered edges, and at least two triangle panels each having a hypotenuse edge with each having a second panel connector hole proximate to each of the hypotenuse edge.

The collapsible tray further comprises a panel connector that passes through the first panel connector hole and the second panel connector hole securing together in a movable manner each of the triangle panels to the trapezoid panel. And, more than one side panel. The side panel is movably interconnected at each end to the foldable side forming a tray perimeter.

The collapsible tray further comprises a base that is movably interconnected to each foldable side and each side panel. In operation, when a user applies a collapsing force to the trapezoid panel or the side panel, the adjacency between the tapered edge and the hypotenuse edge folds inward allowing each foldable side, and the side panel to fold flat on top of the base.

The collapsible tray further comprises a drawer. The drawer comprises at least one first slidable track. The base comprises at least one second slidable track. The first slidable track and the second slidable track interlock allowing the drawer to be slidably attached along the bottom surface of the base, wherein the user can slide the drawer out from the bottom of the base to access contents inside the drawer and then slide the drawer back under the base for storage.

Additional shortcomings of the prior art are overcome and additional advantages are provided through the provision of a collapsible tray comprising more than one foldable side. The foldable side comprises a trapezoid panel, and at least two triangle panels. The trapezoid panel has a top trapezoid edge, a bottom trapezoid edge, a left trapezoid edge, a right trapezoid edge, a portion of a first trapezoid base hinge along the bottom trapezoid edge, a tapered edge along each of the left trapezoid edge and the right trapezoid edge, and at least one first panel connector hole that is proximate to each of the tapered edge. The triangle panel forms a right triangle having a base edge, a perpendicular edge, a hypotenuse edge, a portion of a first triangle side panel hinge, and at least one second panel connector hole proximate to the hypotenuse edge. One of the triangle panels is positioned on the left trapezoid edge and one of the triangle panels is positioned on the right trapezoid edge. The base edge aligns with the top trapezoid edge and the hypotenuse edge aligns with the tapered edge.

The collapsible tray further comprises more than one panel connector. The panel connector passes through the first panel connector hole and the second panel connector hole securing together in a movable manner one of the triangle panels to the left trapezoid edge and one of the triangle panels to the right trapezoid edge. And, more than one side panel has a left side panel edge, a right side panel edge, a top side panel edge, and a bottom side panel edge. The bottom side panel edge comprises a portion of at least one first side panel base hinge. The left side panel edge comprises a portion of at least one second triangle side panel hinge. And, the right side panel edge comprises a portion of at least one of the second triangle side panel hinge. Each of the first triangle side panel hinge and the second triangle side panel hinge are movably interconnected forming a tray perimeter. The tray perimeter comprises two of the side panel and two of the foldable side panel.

The collapsible tray further comprises a base. The base comprises a portion of at least one second trapezoid base hinge that interconnects with the first trapezoid base hinge securing together in a movable manner each of the trapezoid panels to the base and a portion of at least one of a second side panel base hinge that interconnects with the first side panel base hinge securing together in a movable manner each of the side panel to the base.

In operation, when a user applies a collapsing force to the trapezoid panel or the side panel, the adjacency between the tapered edge and the hypotenuse edge folds inward allowing each of the trapezoid panel, the triangle panel, and the side panel to fold flat on top of the base.

Additional shortcomings of the prior art are overcome and additional advantages are provided through the provision of a collapsible tray comprising more than one trapezoid panel having a top trapezoid edge, a bottom trapezoid edge, a left trapezoid edge, a right trapezoid edge, a portion of a first trapezoid base hinge along the bottom trapezoid edge, a tapered edge along each of the left trapezoid edge and the right trapezoid edge, and at least one first panel connector hole proximate to each of the tapered edge. The bottom trapezoid edge comprises a portion of at least one first trapezoid base hinge.

The collapsible tray further comprises more than one triangle panel that forms a right triangle having a base edge, a perpendicular edge, a hypotenuse edge, and at least one second panel connector hole proximate to the hypotenuse edge. The perpendicular edge comprises a portion of at least one first triangle side panel hinge. One of the triangle panels is positioned on the left trapezoid edge and one triangle panel is positioned on the right trapezoid edge. The base edge aligns with the top trapezoid edge and the hypotenuse edge aligns with the tapered edge.

The collapsible tray further comprises more than one panel connector, the panel connector passes through the first panel connector hole and the second panel connector hole securing together in a movable manner one of the triangle panels to the left trapezoid edge and one of the triangle panel to the right trapezoid edge, forming a foldable side panel that is rectangular in shape. And, more than one side panel has a left side panel edge, a right side panel edge, a top side panel edge, and a bottom side panel edge. The bottom side panel edge comprises a portion of at least one of a first side panel base hinge. The left side panel edge comprises a portion of at least one of a second triangle side panel hinge and the right side panel edge comprises at least one of the second triangle side panel hinge. Each of the first triangle side panel hinge and the second triangle side panel hinge are movably interconnected forming a tray perimeter that comprises two of the side panel and two of the foldable side panel.

The collapsible tray further comprises a base. The base comprises a portion of at least one of a second trapezoid base hinge that interconnects with the first trapezoid base hinge securing together in a movable manner each of the trapezoid panels to the base and a portion of at least one of a second side panel base hinge that interconnects with the first side panel base hinge securing together in a movable manner each of the side panel to the base. In operation, when a user applies a collapsing force to the trapezoid panel or the side panel, adjacency between the tapered edge and the hypotenuse edge folds inward allowing each of the trapezoid panel, the triangle panel, and the side panel to fold flat on top of the base.

Additional features and advantages are realized through the techniques of the present invention. Other embodiments and aspects of the invention are described in detail herein and are considered a part of the claimed invention. For a better understanding of the invention with advantages and features, refer to the description and the drawings.

BRIEF DESCRIPTION OF THE FIGURES

The subject matter which is regarded as the invention is particularly pointed out and distinctly claimed in the claims at the conclusion of the specification. The foregoing and other objects, features, and advantages of the invention are apparent from the following detailed description taken in conjunction with the accompanying drawings in which:

FIG. 1I illustrates one example of a back surface view of a foldable side having magnetic locking tabs;

FIGS. 6A-6F illustrate one example of a base;

FIGS. 7A-7F illustrate one example of a side panel;

FIGS. 9A-9H illustrate one example of a drawer;

The detailed description explains the preferred embodiments of the invention, together with advantages and features, by way of example with reference to the drawings.

DETAILED DESCRIPTION OF THE INVENTION

Figure 1A:
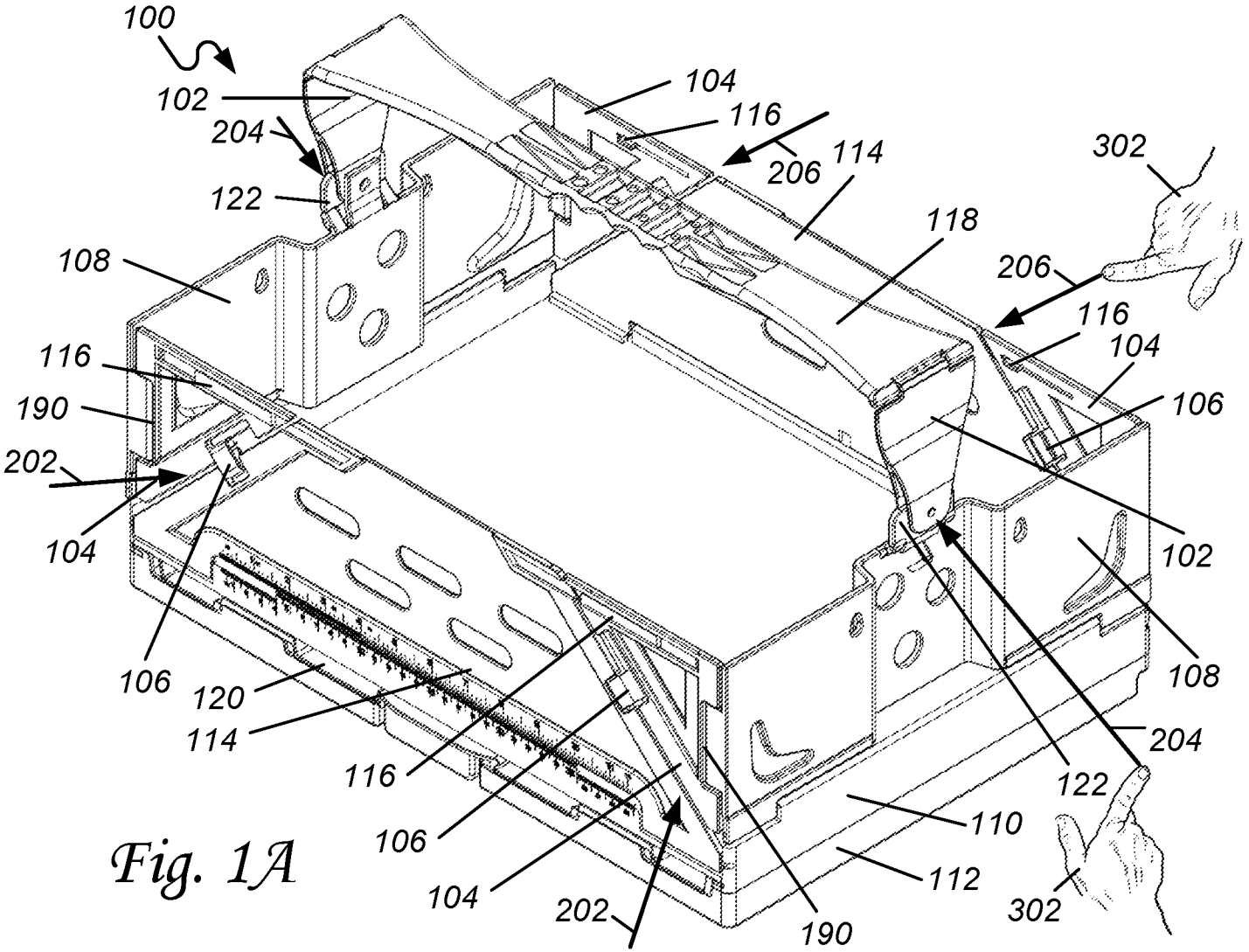
FIG. 1A illustrates one example of a top front perspective view of the collapsible tray with the drawer in the closed position.

Turning now to the drawings in greater detail, it will be seen that in FIG. 1A there is illustrated one example of a top front perspective view of the collapsible tray 100 with drawer 112 in the closed position and slidably secured under the base 110. In an exemplary embodiment, the collapsible tray 100 can comprise more than one foldable side 160. Foldable side 160 is better illustrated in at least FIGS. 1H and 10B. The foldable side 160 comprises a trapezoid panel 114 having a tapered edge 162 along the left 135 and right 137 sides of the trapezoid panel 114 and a first panel connector hole 170 located proximate to each of the tapered edge 162.

Figure 1B:
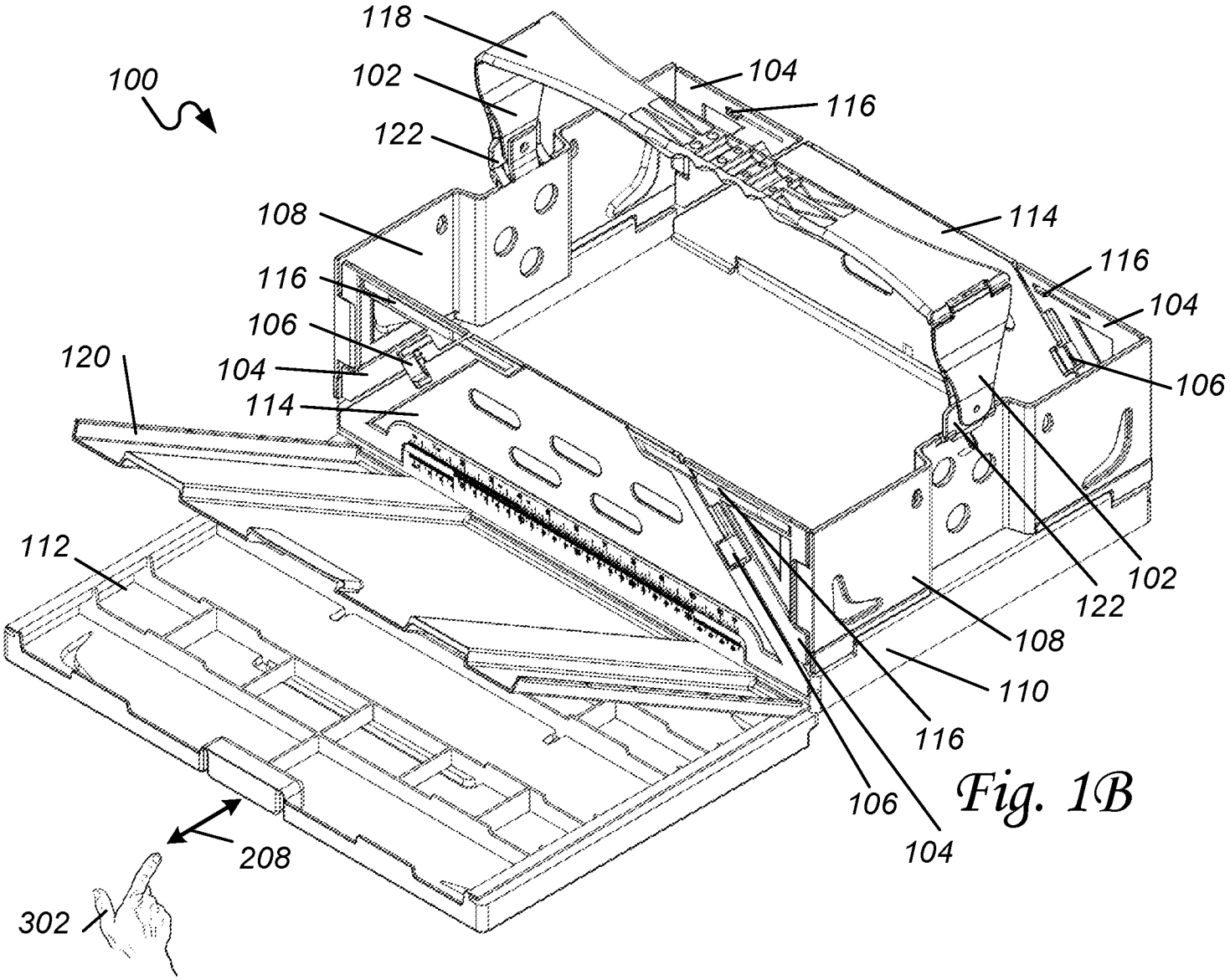
FIG. 1B illustrates one example of a top front perspective view of the collapsible tray with the drawer in the open position.
Figure 1C:
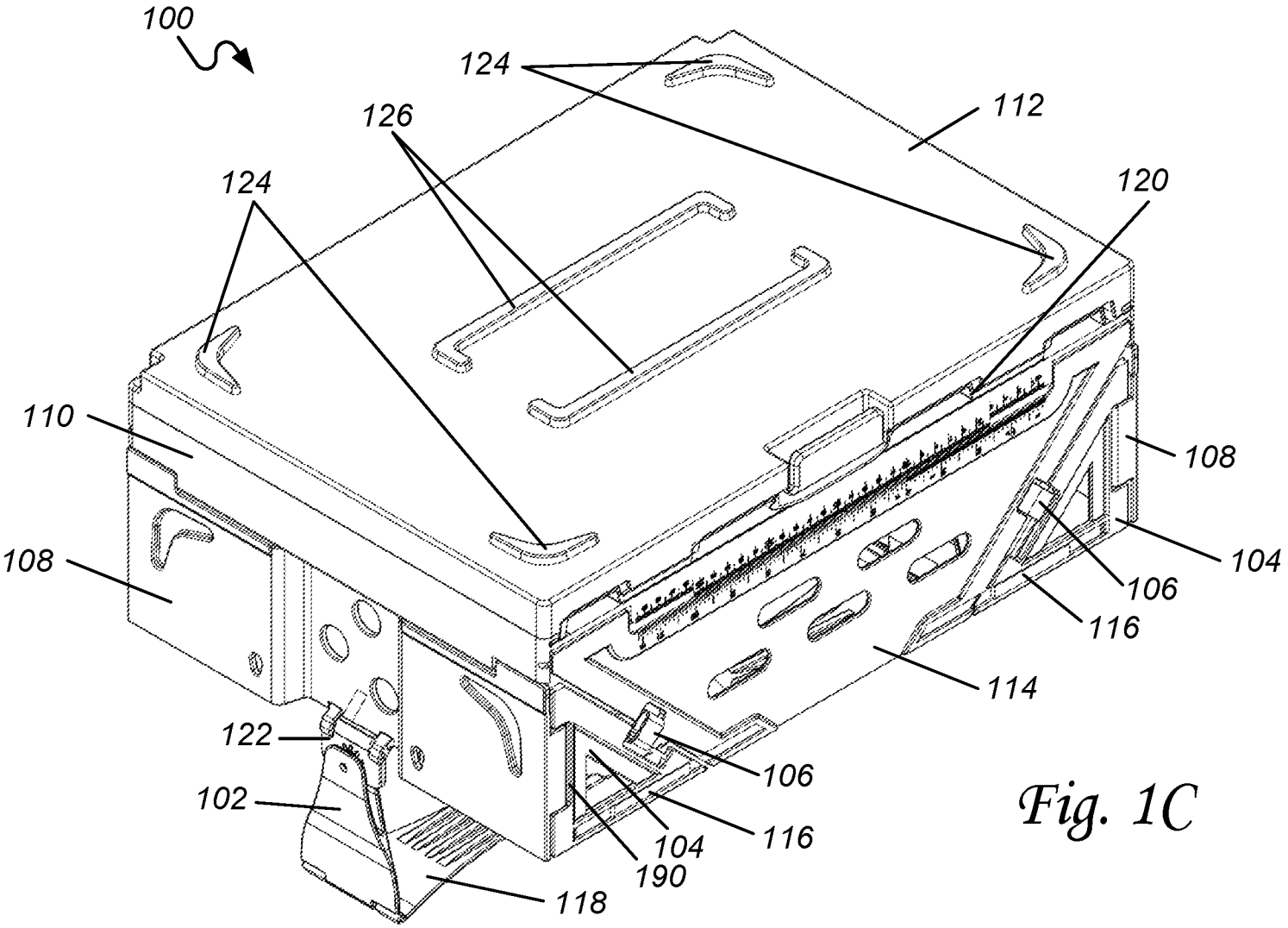
FIG. 1C illustrates one example of a bottom front perspective view of the collapsible tray with the drawer in the closed position.
Figure 1D:
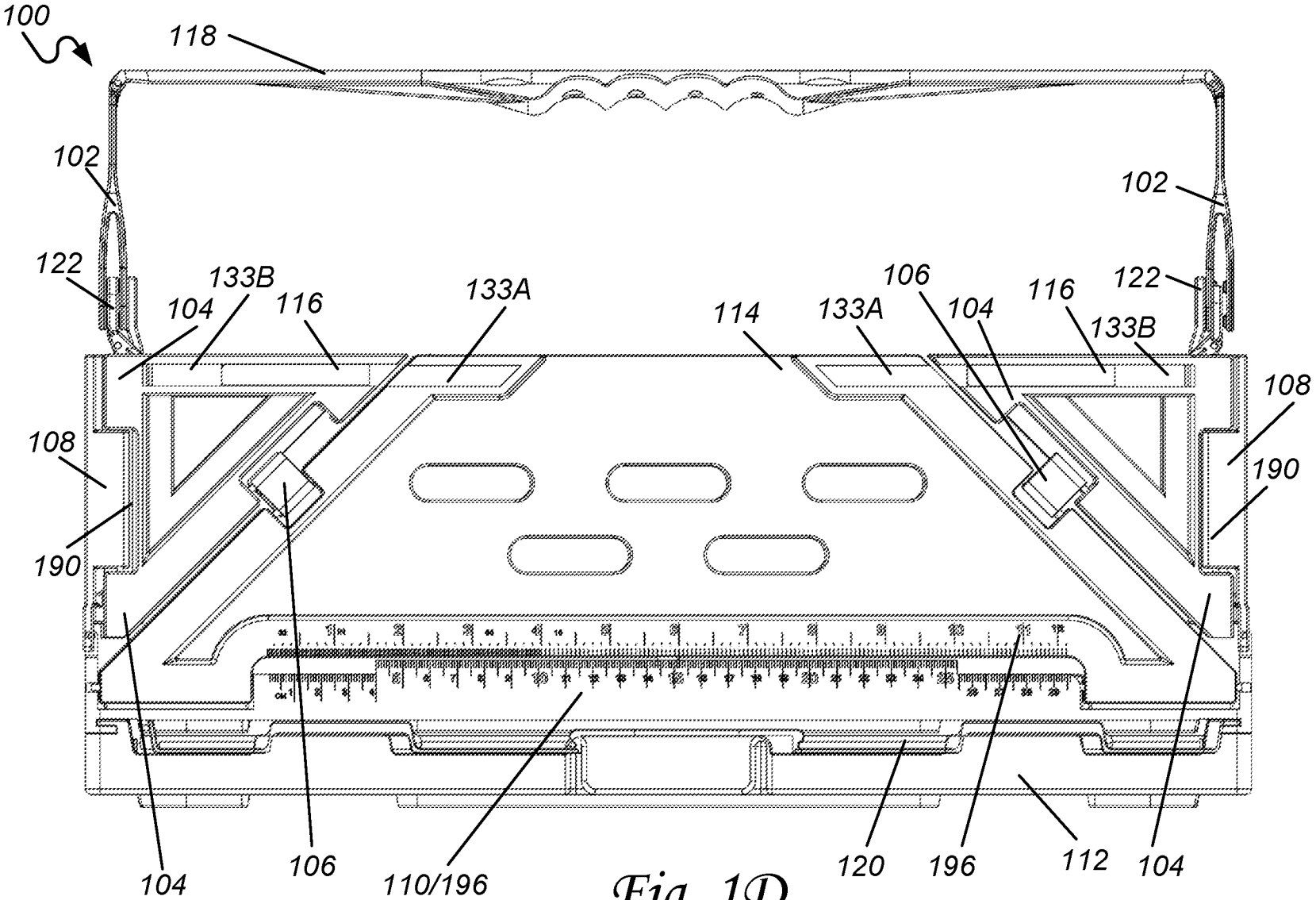
FIG. 1D illustrates one example of front and back views which are identical, of the collapsible tray with the drawer in the closed position.
Figure 1E:
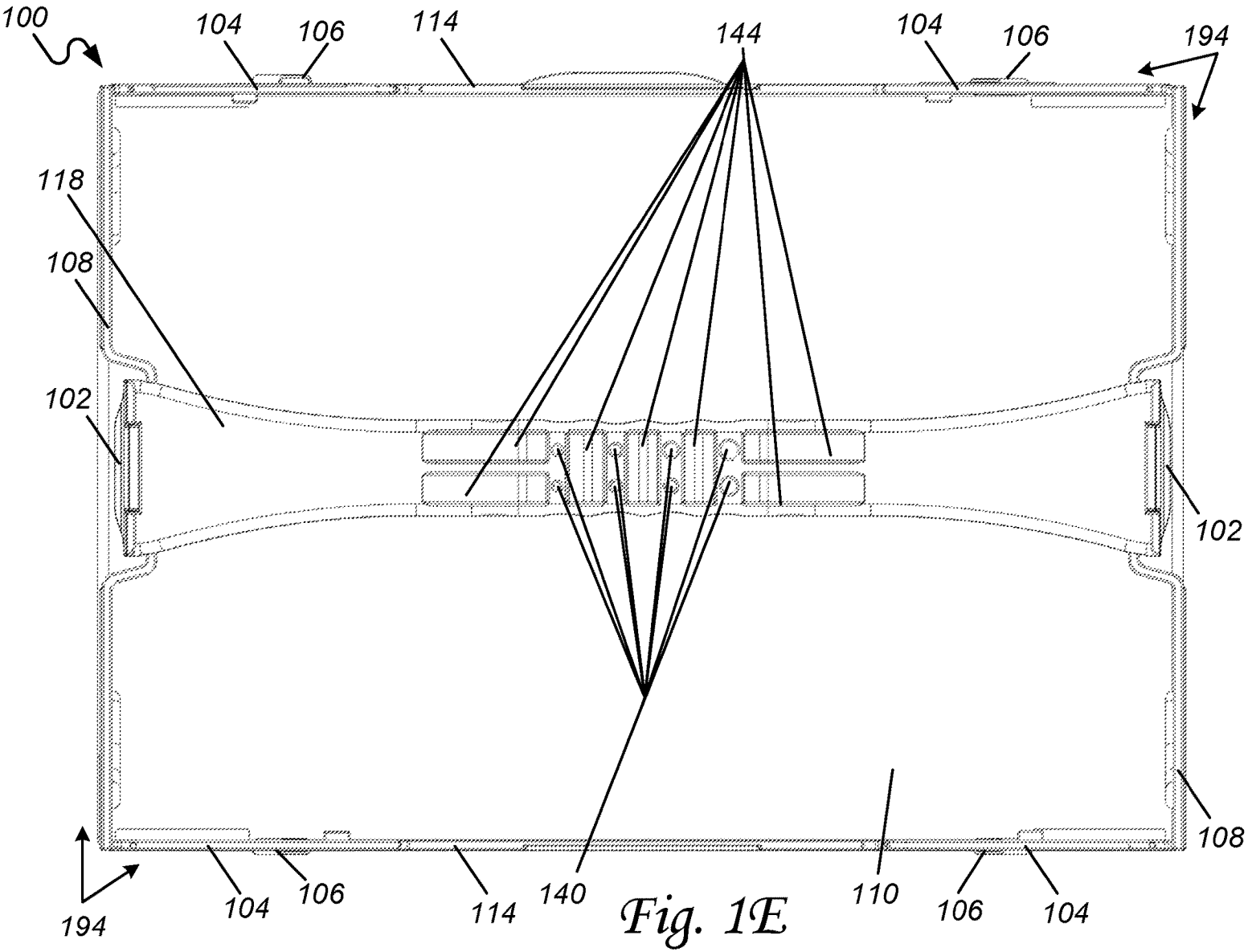
FIG. 1E illustrates one example of a top view of the collapsible tray with the drawer in the closed position.
Figure 1F:
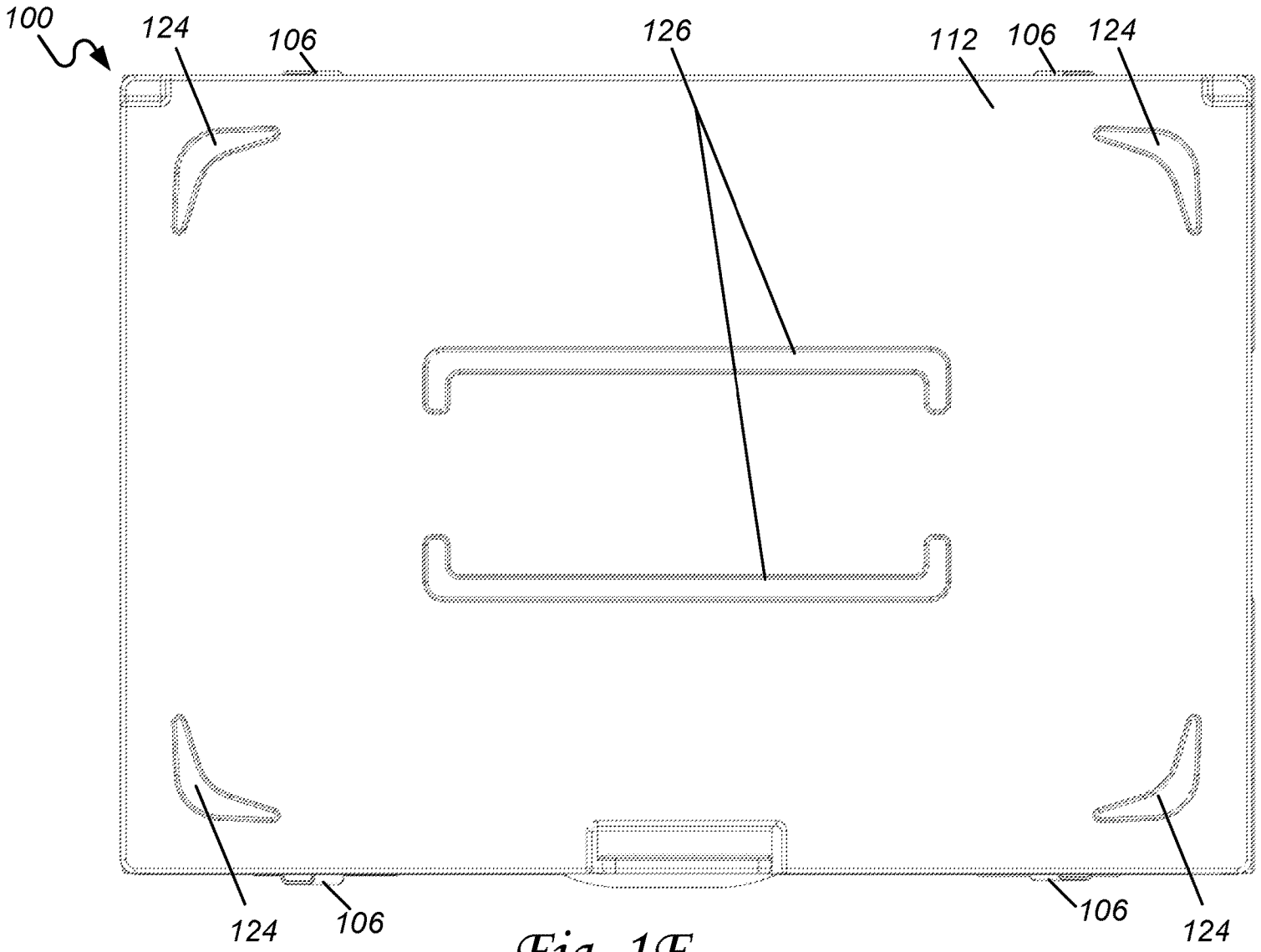
FIG. 1F illustrates one example of a bottom view of the collapsible tray with the drawer in the closed position.
Figure 1G:
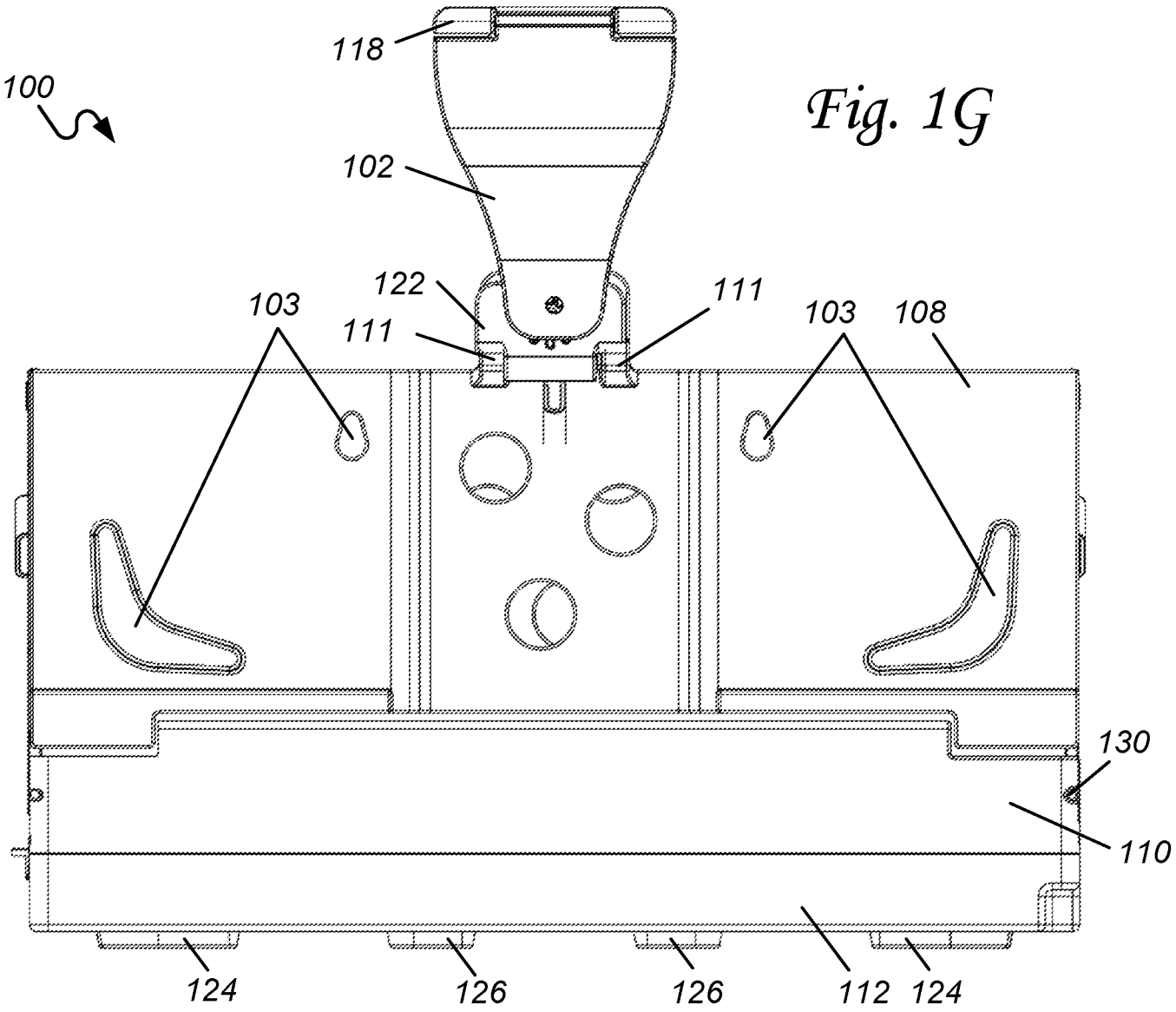
FIG. 1G illustrates one example of right and left views which are identical, of the collapsible tray with the drawer in the closed position.
Figure 1H:
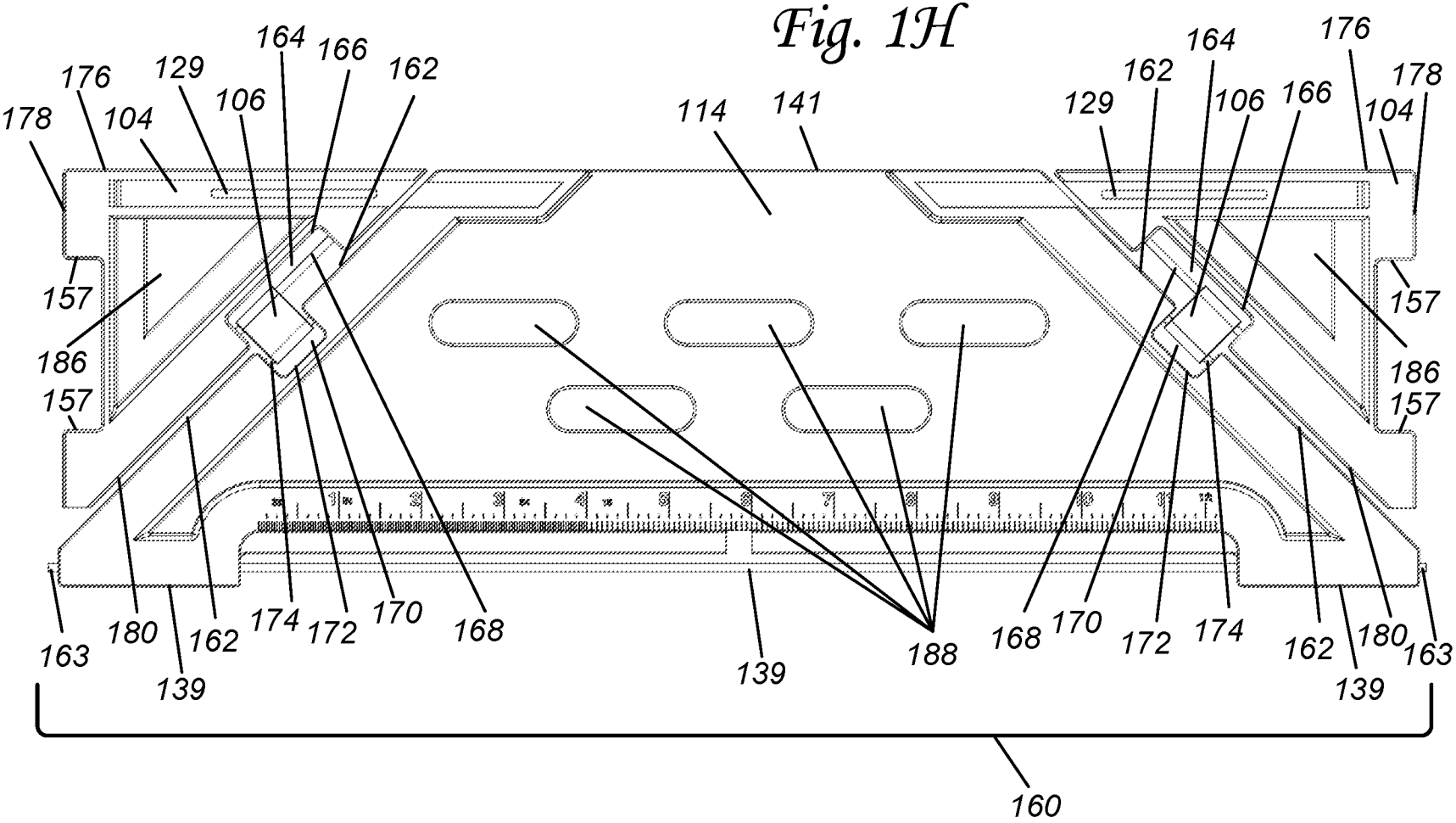
FIG. 1H illustrates one example of a front surface view of a foldable side.
Figure 11:
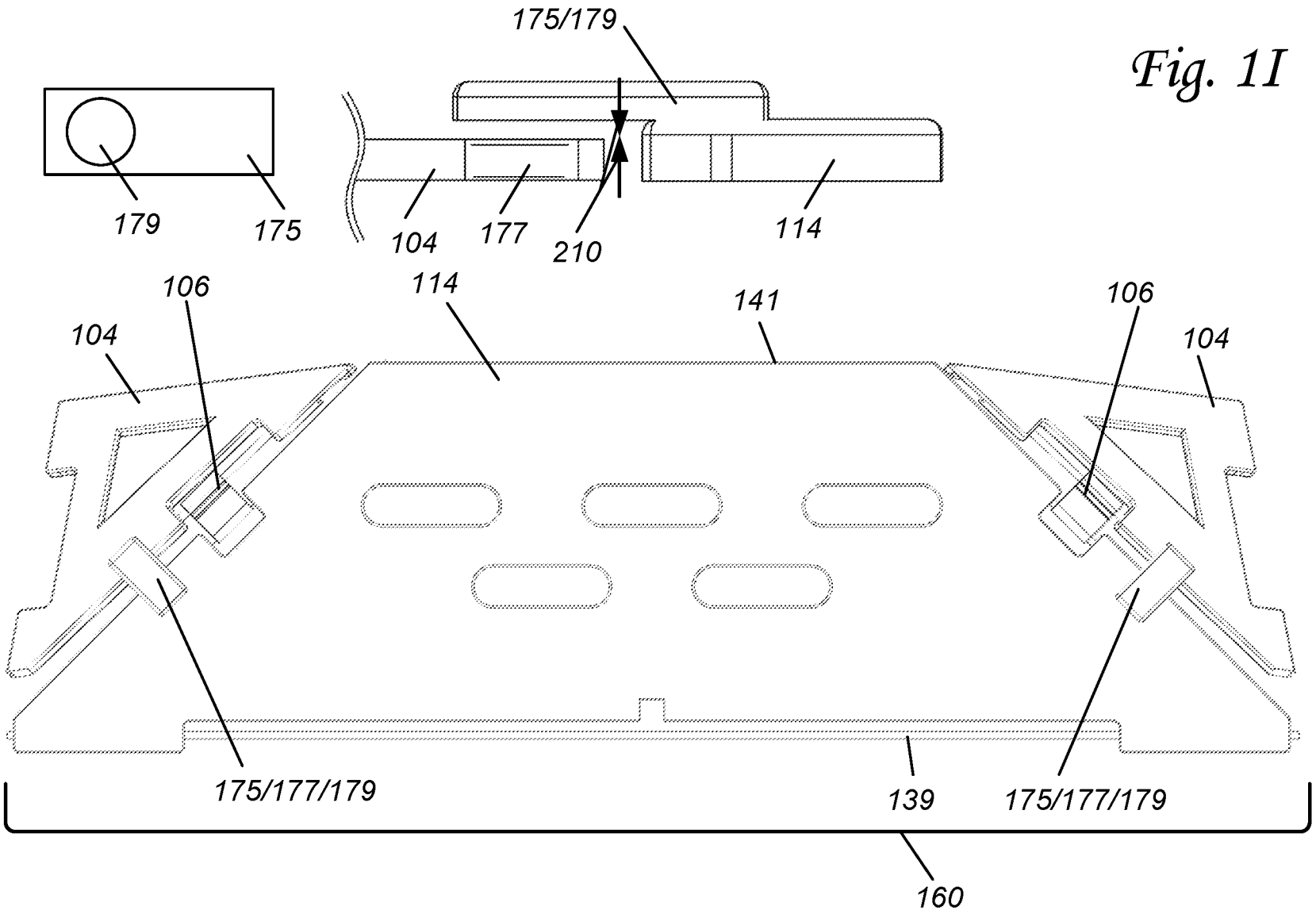
FIGS. 11A-11F illustrate one example of a triangle panel.

In an exemplary embodiment and with reference to FIG. 1H, the first panel connector hole 170 can be formed by integrally forming a trapezoid panel notch 172 along the tapered edge 162 and installing a trapezoid panel bridge pin 174 between the contoured edges of notch 172. In this regard, the first panel connector hole 170 is formed between the trapezoid panel bridge pin 172 and the rear contour edge of the trapezoid panel notch 172. The trapezoid panel bridge pin 172 can be fabricated from metal, plastic, a combination thereof, or other suitable materials.

In another exemplary embodiment, the first panel connector hole 170 can be formed within the trapezoid panel 114 surface proximate to tapered edge 162. In this regard, the tapered edge 162 can remain intact and the first panel connector hole 170 can be cut, integrally formed, or otherwise fabricated within the interior region of the trapezoid panel 114, as may be required and/or desired in a particular embodiment.

The foldable panel 160 can further comprise at least two triangle panels 104. Each of the triangle panels 104 can have a base edge 176, a perpendicular edge 178, and a hypotenuse edge 180 with a second panel connector hole 164 proximate to each of the hypotenuse edge 180.

The second panel connector hole 164 can be formed by integrally forming triangle panel notch 166 along the hypotenuse edge 180 and installing a triangle panel bridge pin 168 between the contoured edges of triangle panel notch 166. In this regard, the second panel connector hole 164 is formed between the tringle panel bridge pin 168 and the rear contour edge of the triangle panel notch 166. The triangle panel bridge pin 168 can be fabricated from metal, plastic, a combination thereof, or other suitable materials.

In another exemplary embodiment, the second panel connector hole 164 can be formed within the triangle panel 104 surface proximate to hypotenuse edge 180. In this regard, the hypotenuse edge 180 can remain intact and the second panel connector hole 1164 can be cut, integrally formed, or otherwise fabricated within the interior region of the triangle panel 104, as may be required and/or desired in a particular embodiment.

In an exemplary embodiment, the collapsible tray 100 can further comprise a panel connector 106 that passes through the first panel connector hole 170 and the second panel connector hole 164 securing together in a movable manner each of the triangle panel 104 to the trapezoid panel 114. In this regard, triangle panels 104 can fold at the hypotenuse edge 180 and tapered edge 162 to lie flat on the trapezoid panel 114.

In an exemplary embodiment, the collapsible tray 100 can further comprise more than one side panel 108. The side panel 108 is movably interconnected at each end 190 to the foldable side 160 forming a tray perimeter 194. In this regard, each end 190 of side panel 108 can be interconnected with a perpendicular edge 178 of triangle panel 104 forming tray perimeter 194 which is rectangular in shape. The tray perimeter 194 is illustrated in at least FIG. 1E. Side panel 108 end 190 is better illustrated in at least FIG. 7A. Such end 190 of side panel 108 interconnections with the perpendicular edge 178 of triangle panel 104 can be by way of a hinge connection between side panels 108 and triangle panels 104. Such hinge interconnection can be by way of pins 173 inserted through panels 104/108, snap on hinges to panels 104/108, snap together edges on panels 104/108, or by other hinge type interconnections, as may be required and/or desired in a particular embodiment.

In an exemplary embodiment, the collapsible tray 100 can further comprise a base 110 that is movably interconnected to each of the foldable side 160 and each of the side panels 108, wherein when a user 302 applies a collapsing force 204/206 to the trapezoid panel 114 or the side panel 108, the adjacency between the tapered edge 162 and the hypotenuse edge 180 folds inward allowing each of the foldable sides 160 which is comprised of trapezoid panel 114 and two triangle panels 104, and the side panel 108 to fold flat on top of the base 110.

In operation, interconnections between the base 110, two foldable sides 160 and two side panels 108 can be by way of a hinge connection. Such hinge connection can be between the base 110, foldable sides 160 which comprises trapezoid panel 114 and two triangle panels 104 per foldable side, and side panels 108. Each of the trapezoid panel 114 and side panel 108 when hinged to base 110 can move freely as to lie flat on base 110 in a closed position and stand perpendicular to base 110 in an open position. Such hinge interconnections can be by way of pins 173 inserted through panels 104/108/114 and/or base 110, snap on hinges between panels 104/108/114 and/or base 110, snap together edges on panels 104/108/114 with base 110, or by other hinge type interconnections, as may be required and/or desired in a particular embodiment. In an exemplary embodiment, the trapezoid panel 114, triangle panels 104, and side panel 108 interconnect in a movable manner with the base 110 at the outer perimeter of base 110. Once interconnected and in the open position as better illustrated in at least FIG. 1E, the foldable sides 160 and side panels 108 form a tray perimeter 194.

In an exemplary embodiment, the foldable side 160 can be rectangular in shape, or other shapes as may be required and/or desired in a particular embodiment.

In an exemplary embodiment, the collapsible tray 100 can be fabricated from metal, plastic, a combination thereof, or other suitable materials.

Referring to FIG. 1B, there is illustrated one example of a top front perspective view of the collapsible tray 100 with drawer 112 in the open position. In an exemplary embodiment, the collapsible tray 100 can further comprise a drawer 112. Drawer 112 can comprise at least one first slidable track 128 which is better illustrated in at least FIG. 9G. The base 110 comprises at least one second slidable track 192 which is better illustrated in at least FIGS. 6C and 6D. The first slidable track 128 and the second slidable track 192 interlock allowing drawer 112 to be slidably attached along the bottom surface of the base 110. Better illustrated in at least FIG. 1B, user 302 can slide 208 drawer 112 out from the bottom of the base 110 to access the contents inside drawer 112 and then slide 208 the drawer 112 back under the base 110 for storage.

In an exemplary embodiment, the collapsible tray 100 can further comprise a drawer lid 120 that is movably interconnected with drawer 112 along one edge. In this regard, when user 302 slides 208 drawer 112 out from the bottom of the base 110 drawer lid 120 can be opened to access the contents inside drawer 112. The drawer lid 120 can then be closed to cover the contents of drawer 112 before sliding 208 drawer 112 back under the base 110 for storage.

Figures 8E, 8F:
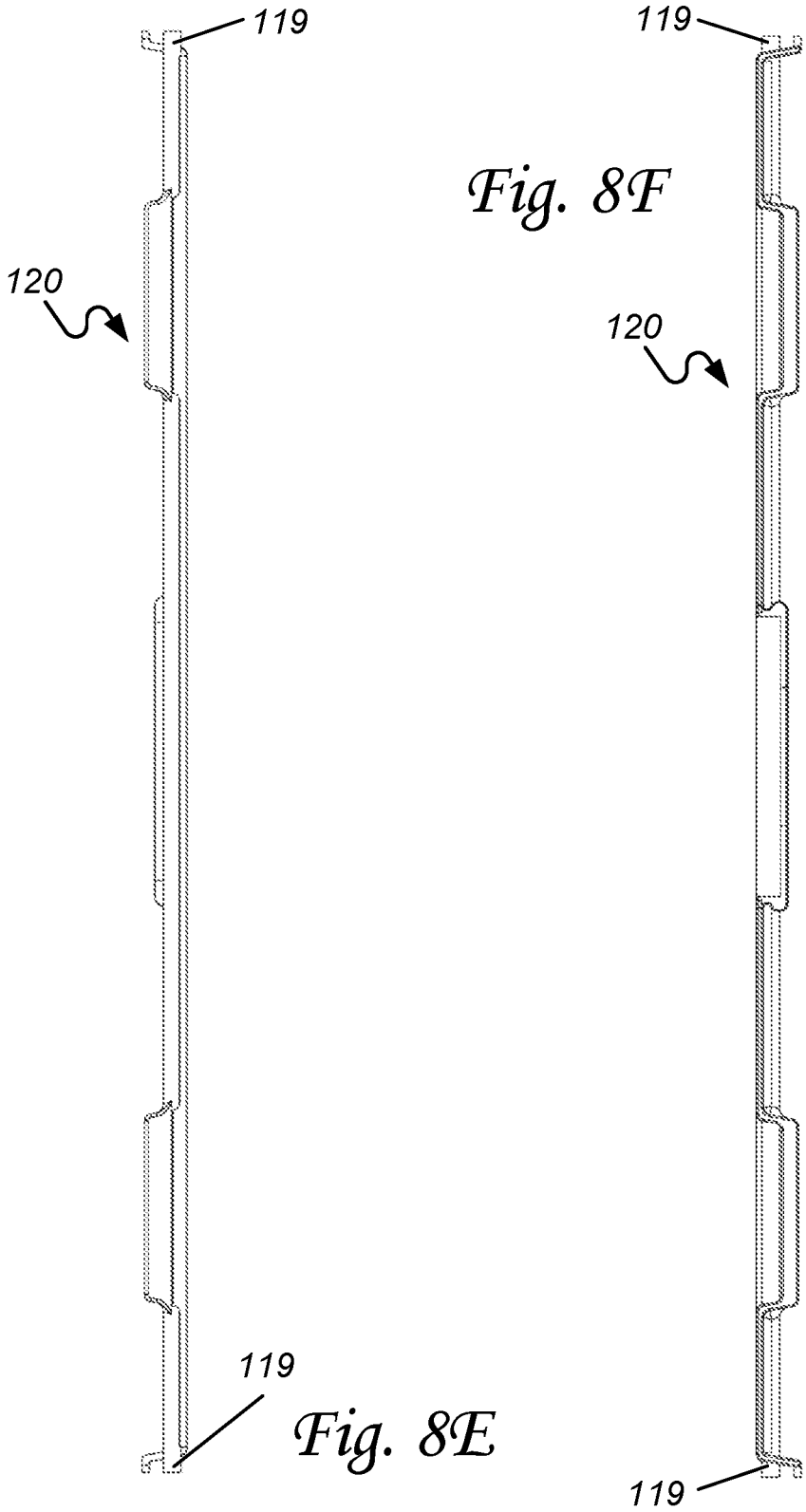
Figure 9A:
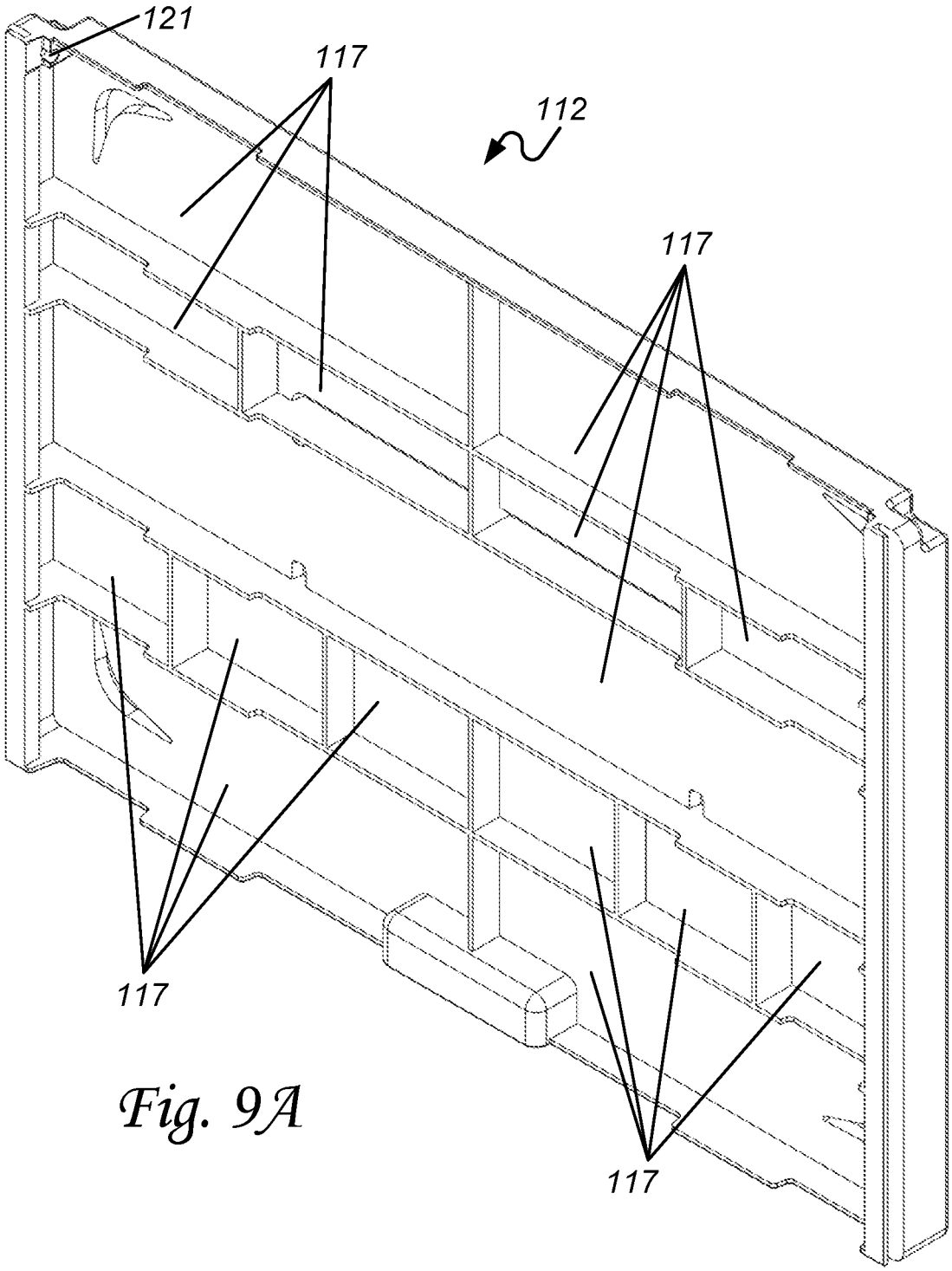

Such interconnection with drawer 112 by way of drawer connector 121 is better illustrated in at least FIG. 9A. In addition, drawer lid 120 interconnection by way of lid connector 119 along one edge can operate as a hinge connection is better illustrated in at least FIGS. 8E and 8F. The drawer lid 120 by way of a lid connector 119 when hinged to drawer 112 drawer connector 121 can move freely to open and close. When in the closed position, drawer lid 112 can lie flat on drawer 112 preventing the contents of drawer 112 from egressing. The drawer lid 120 securely fasten closed to drawer 112 by one or more interlocking tabs, friction fit, or by other types and/or kinds of drawer lid 112 fasteners, as may be required and/or desired in a particular embodiment. Such hinge interconnections can be by way of pins 173 inserted through drawer 112 and drawer lid 120, snap on hinges between 112 and drawer lid 120, snap together edges on 112 and drawer lid 120, or by other hinge type interconnections, as may be required and/or desired in a particular embodiment.

Referring to FIG. 1C, there is illustrated one example of a bottom front perspective view of the collapsible tray 100 with drawer 112 in the closed position stored under the base 110 with drawer lid 120 securely closed.

Referring to FIG. 1D, there is illustrated one example of front and back views which are identical, of the collapsible tray 100 with drawer 112 in the closed position. In an exemplary embodiment, a ruler 196 can be formed on the outer surface 198 of the trapezoid panel 114 or on the outer surface 156 of the base 110. On the outer surface 198 of the trapezoid panel 114, the ruler 196 is better illustrated in at least FIG. 10B. On the outer surface 156 of the base 110, ruler 196 is better illustrated in at least FIGS. 6C and 6D. In an exemplary embodiment, a ruler 196 in different units of measure can be formed on different surfaces. In this regard, as illustrated in at least FIG. 1D imperial units can be formed on trapezoid panel 114, and metric units can be formed on base 110. Forming ruler 196 can be by printing, embossing, de-embossing, or by other methods, as may be required and/or desired in a particular embodiment.

Referring to FIG. 1E, there is illustrated one example of a top view of the collapsible tray 100 with drawer 112 in the closed position. In an exemplary embodiment and with reference to at least FIGS. 4A and 4B, handle 118 can comprise more than one handle recess 144 along the top surface of handle 118. In this regard, handle recess 144 reduces the amount of material along the top surface of handle 118 and increases the amount of material along the bottom surface of handle 118. The additional amount of material along the bottom surface of handle 118 is contoured into a handle grip 117 which provides additional structural support as well as promotes an anti-slip grip for the user 302. Handle 118 also has more than one handle hole 140 to provide an egress path for water or other fluids that might accumulate on the top of handle 118.

In an exemplary embodiment and with reference to at least FIGS. 3B-C and 5A-B a handle 118 can be interconnected in a movable manner between at least two of the rotating link 102. In this regard, the first dimple pattern 146 and the second dimple pattern 107 engage in a movable manner allowing the rotating links 102 to hold the handle 118 in an upright position when the collapsible tray 100 is in an open position.

Figure 3A:
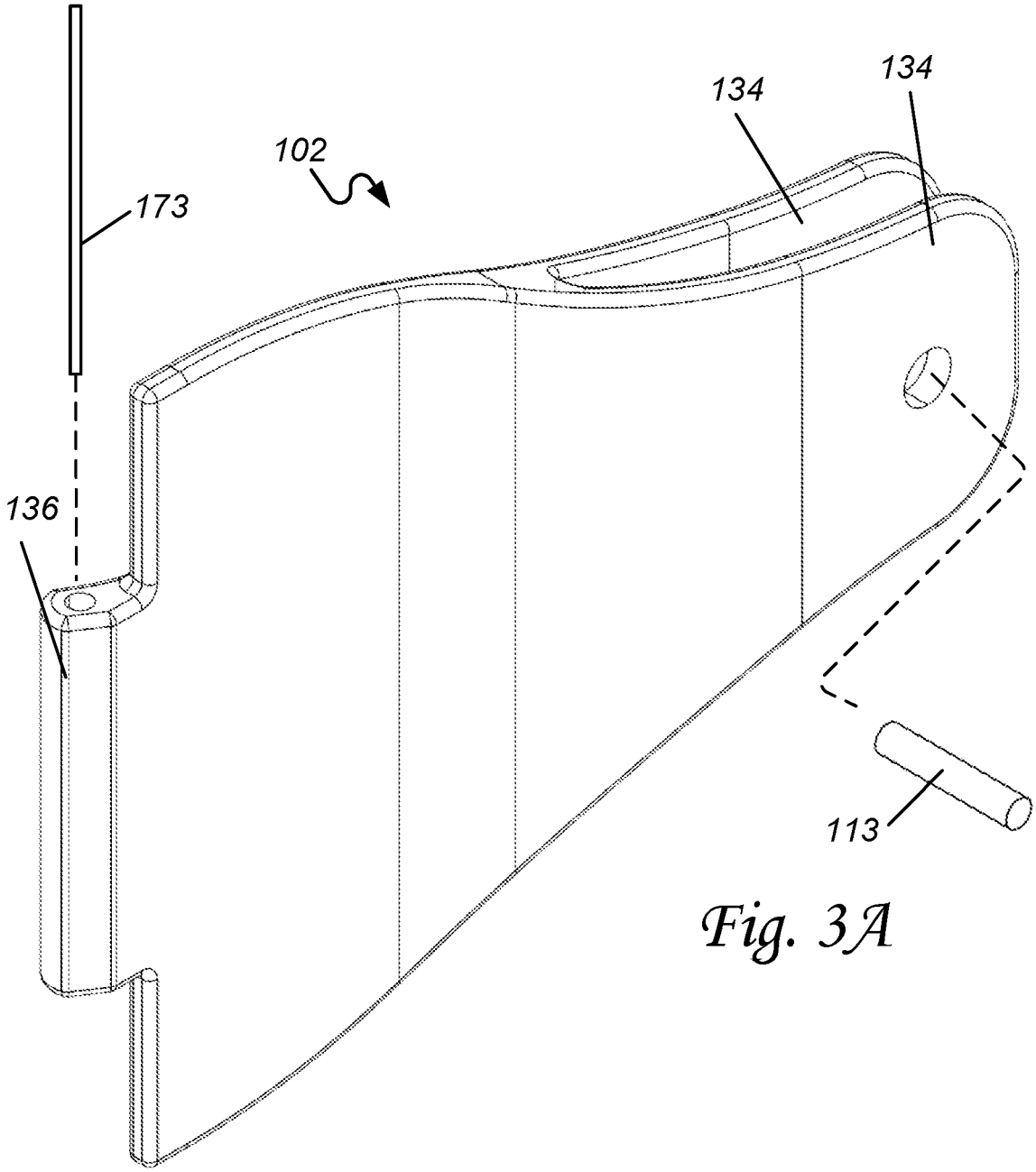
FIGS. 3A-3F illustrate one example of a rotating link.
Figure 3B:
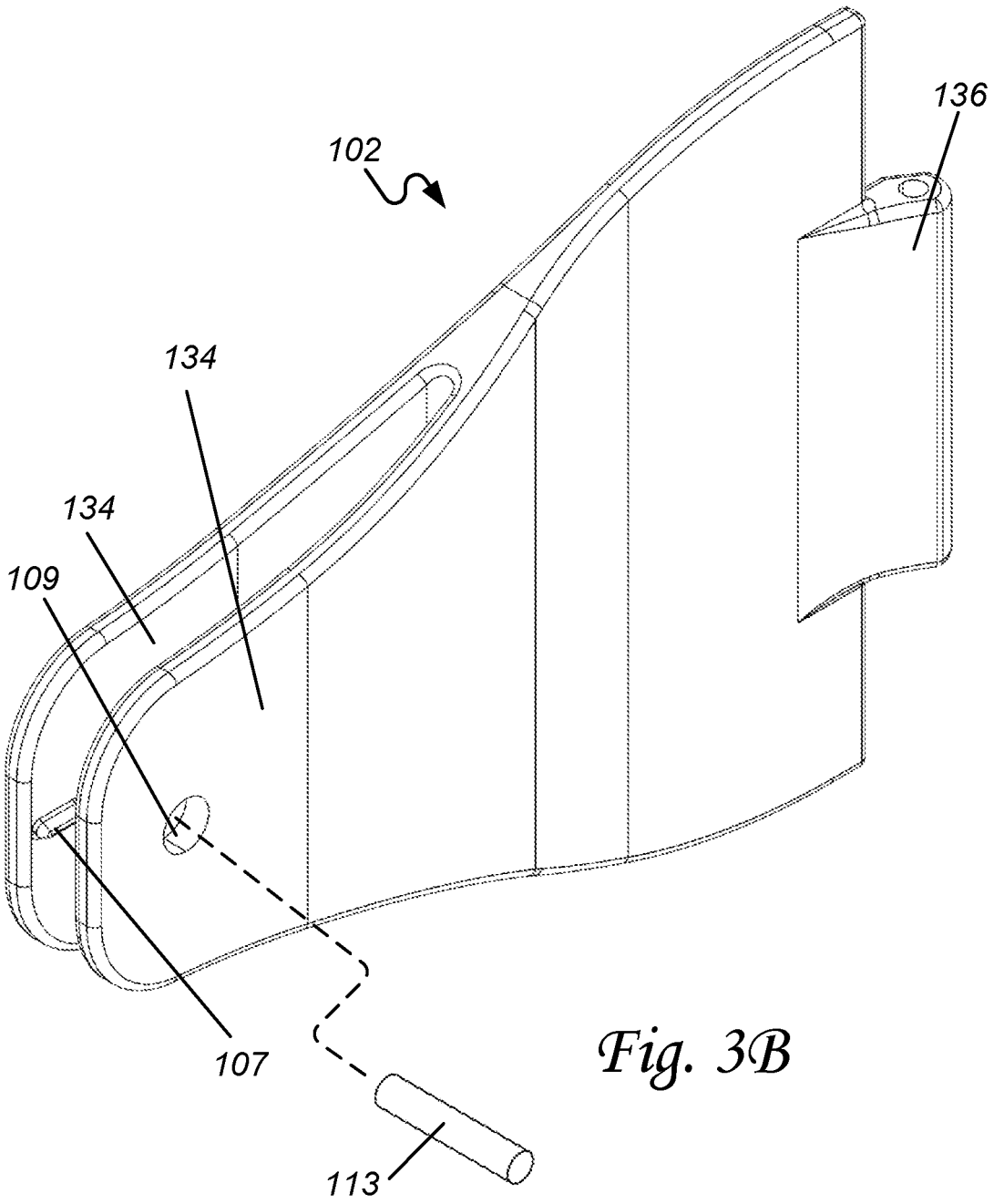
Figure 3C:
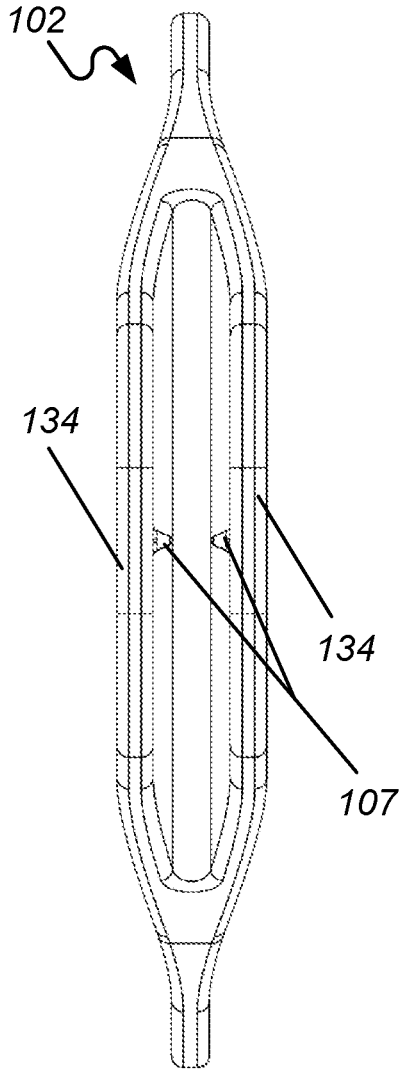
Figure 3D:
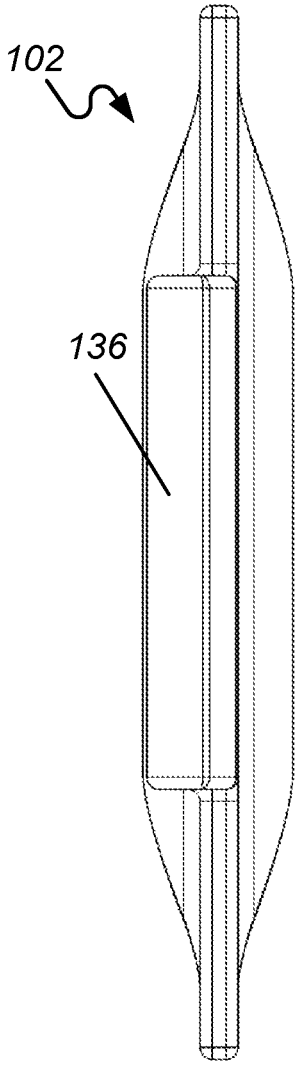
Figure 3E:
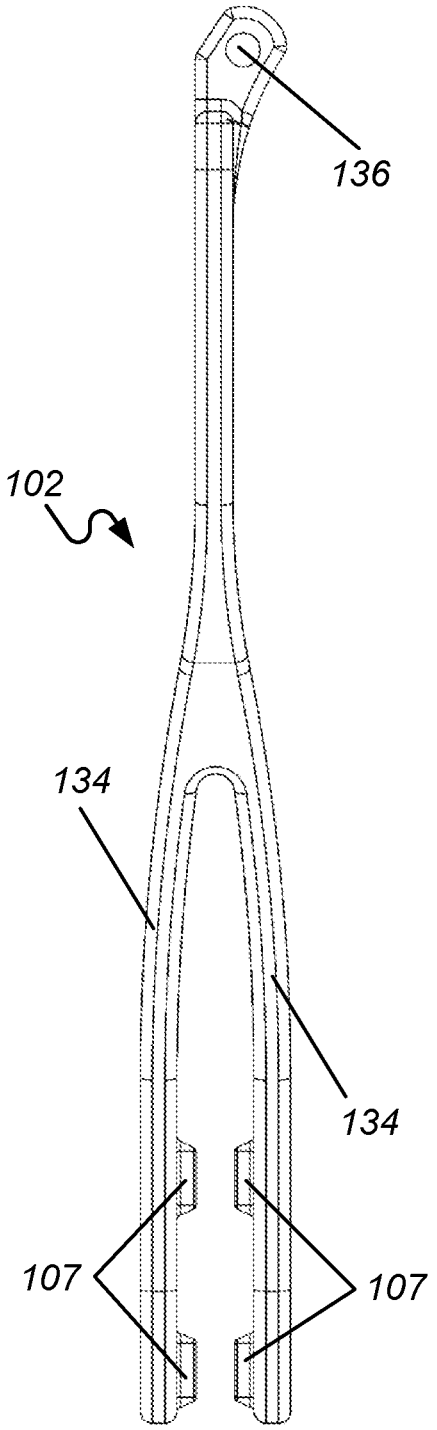
Figure 3F:
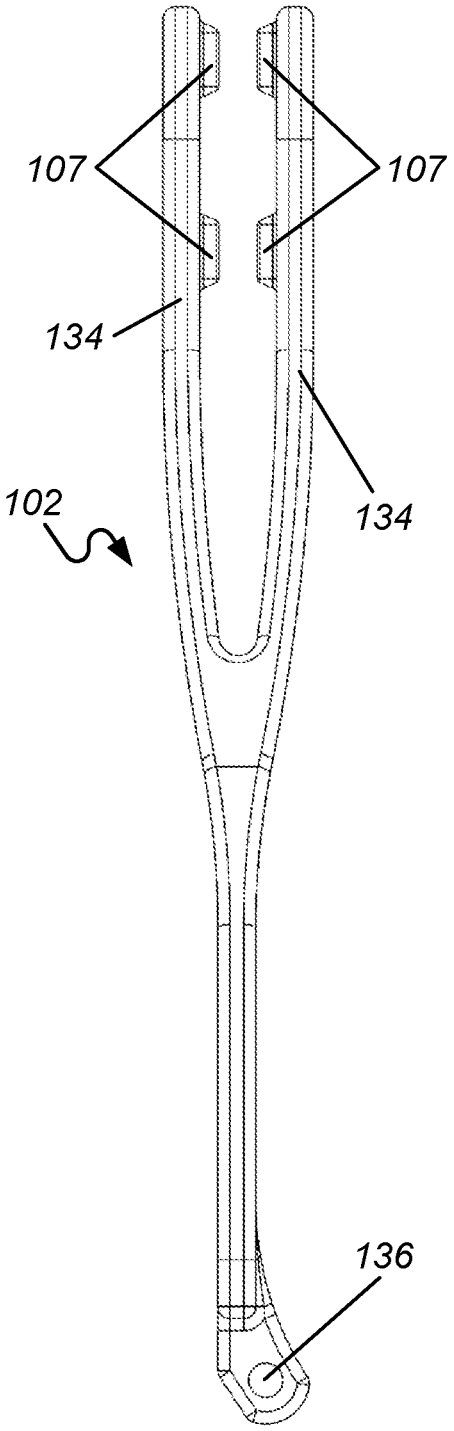

In an exemplary embodiment and as better illustrated in at least FIGS. 3E and 3F, such second dimple pattern 107 can be integrally formed along the inner surface of a pair of connector legs 134. In operation, the link connector 122 having the first dimpled pattern can fit between the connector legs 134 and the fastening pin 113 can be inserted through one connector leg 134, through the first rotating link hole 105 of the link connectors 122, and then through the second connector leg 134. The second dimple pattern 107 engages the first dimple pattern 146 to allow the handle 118 when interconnected with the rotating link 102 to click into and hold various positions including remaining vertical with respect to the base 110 when the collapsible tray 100 is in the opened position.

Figure 4A:
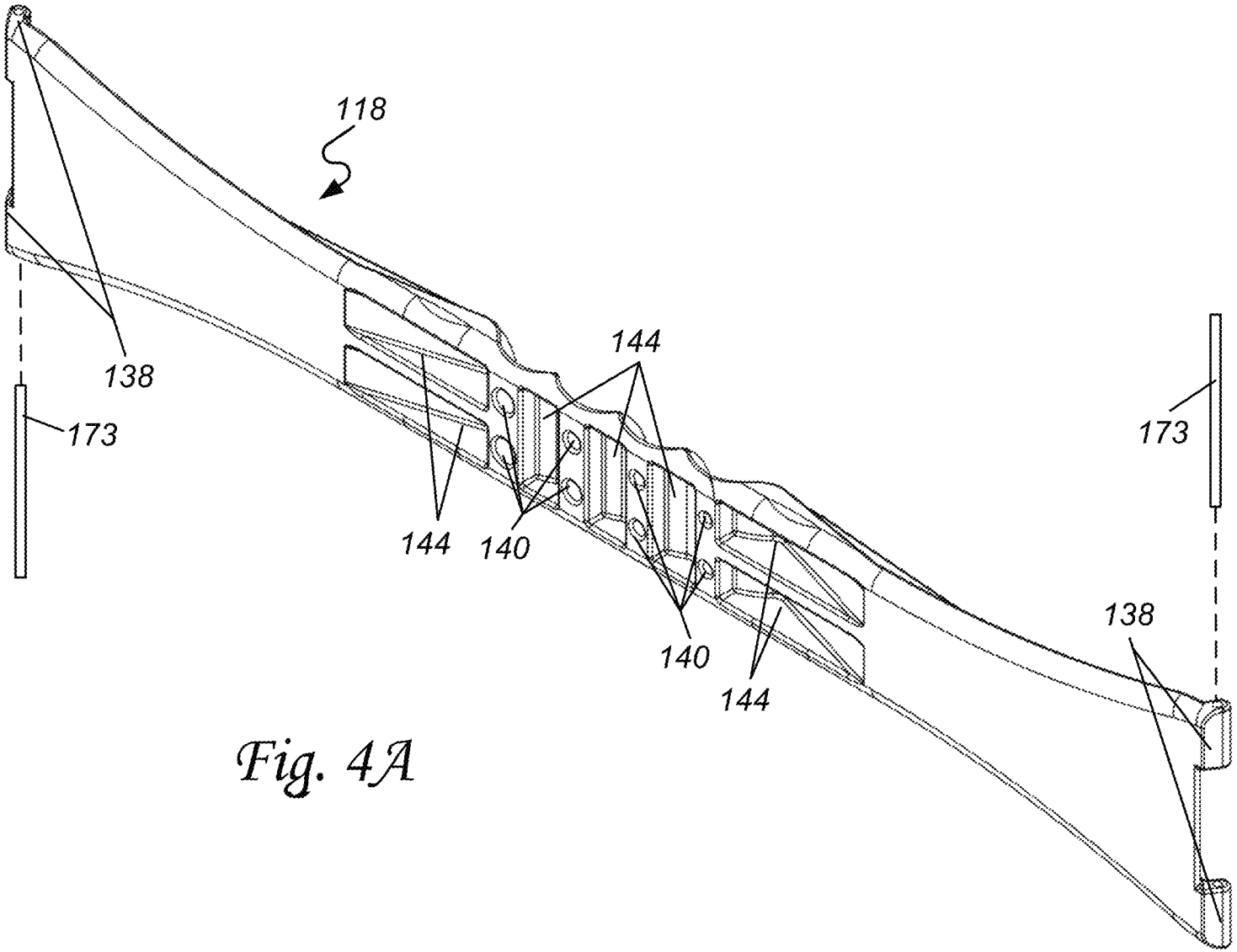
FIGS. 4A-4D illustrate one example of a handle.
Figure 4B:
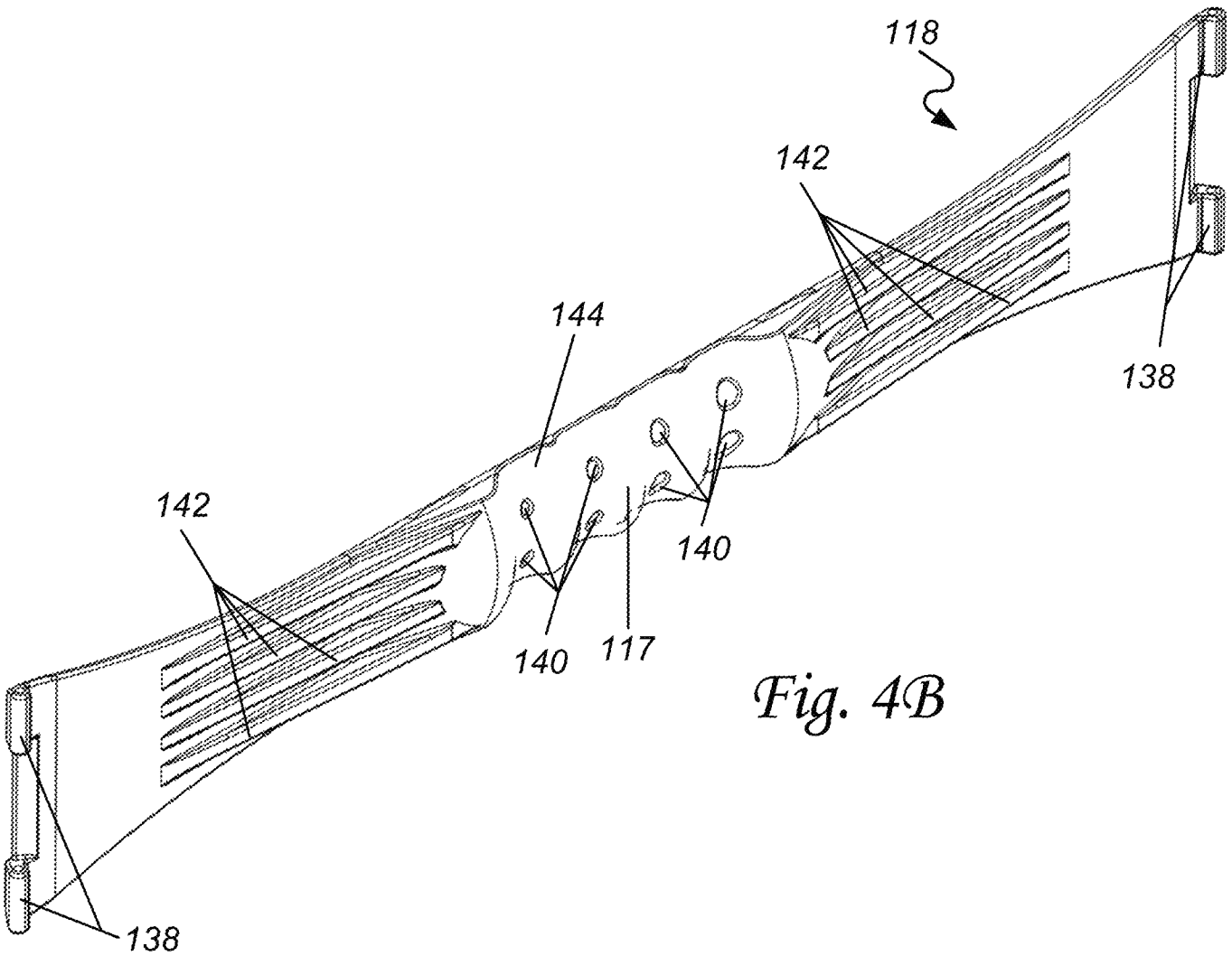

In an exemplary embodiment and with reference to FIG. 4B, handle 118 comprises more than one strengthening rib 142 that is integrally formed and runs laterally along a portion of the surface of handle 118 between the rotating link 102 interconnection points 138. In operation, the strengthening ribs abate the handle bowing under load and allow more weight to be carried in the collapsible tray 100 before the handle 118 breaks.

Referring to FIG. 1F, there is illustrated one example of a bottom view of the collapsible tray 100 with drawer 112 in the closed position. In an exemplary embodiment, drawer feet 124/126 can be integrally formed on the bottom surface of drawer 112. The drawer feet 124/126 elevate drawer 112 from the table surface that drawer 112 is sitting on across most of the bottom of the drawer 112 surface.

Referring to FIG. 1G, there is illustrated one example of a right side and a left side view which is identical, of the collapsible tray 100 with drawer 112 in the closed position. In an exemplary embodiment, the side panel 108 can further comprise at least one standoff 103 integrally formed in the side panel 108 and positioned to be in contact with trapezoid panel 114, triangle panel 104, or base 110 to cause the trapezoid panel 114 and triangle panel 104 to lay parallel and flat with respect to the front surface of the base 110 and prevent crushing between the side panel 108 and the panel connector 106 when the collapsible tray 100 is in a closed position.

In an exemplary embodiment, at least one of the standoff 103 is orientated on and extending outwardly from the front surface 149 of the side panel 108 and at least one of the standoff 103 is orientated on and extending outwardly from the back surface 165 of the side panel 108.

In another exemplary embodiment, one or more of standoff 103 is orientated on and extending outwardly from the front surface 149 of the side panel 108.

Figure 5A:
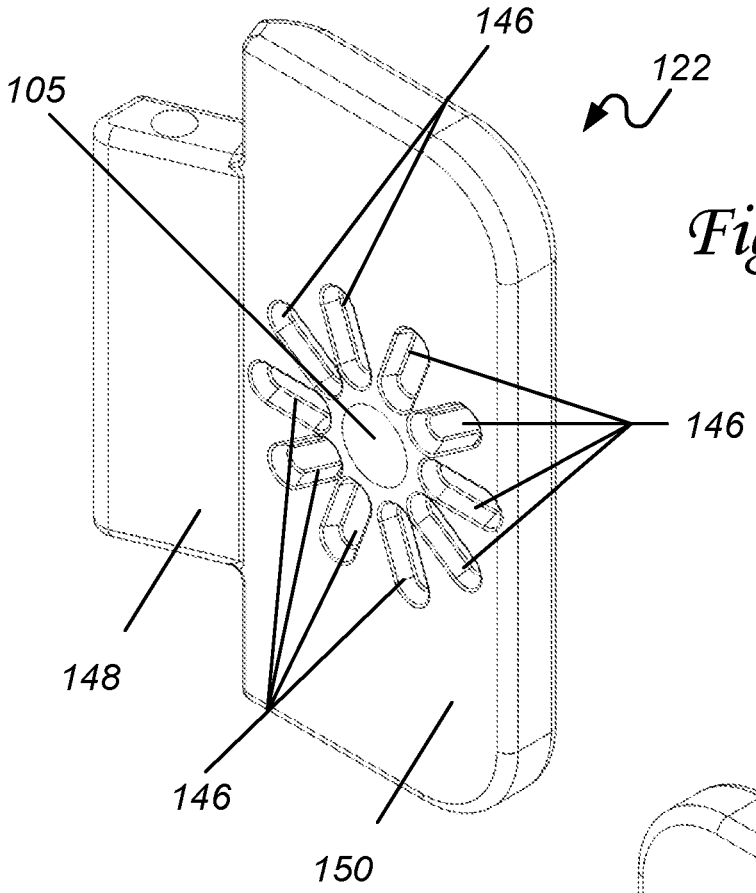
FIGS. 5A-5D illustrate one example of a folding link.
Figure 5B:
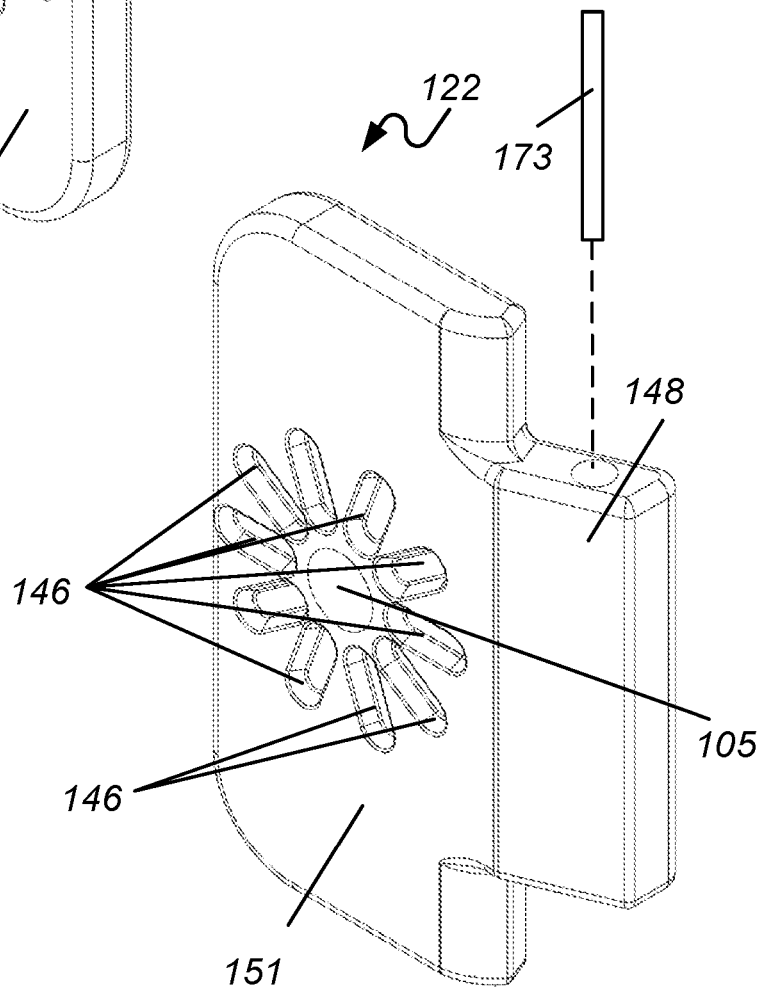

In an exemplary embodiment, and as better illustrated in at least FIGS. 5A and 5B, more than one folding link 122 comprises a first dimpled pattern 146 along at least one surface 150/151 and has a first rotating link hole 105 therethrough. The side panel 108 and folding link 122 are movably interconnected allowing the folding link 122 to fold inward towards base 110 when the collapsible tray 100 is closed.

In an exemplary embodiment and with reference to at least FIGS. 3B and 3C, more than one rotating link 102 comprises a second dimple pattern 107, and has a second rotating link hole 109. A fastening pin 113 is fitted through the first rotating link hole 105 and the second rotating link hole 109 securing in a movable manner the rotating link 102 to the folding link 122.

Referring to FIG. 1H, there is illustrated one example of a front surface view of a foldable side 160. In an exemplary embodiment, the foldable side 160 comprises trapezoid panel 114 having a tapered edge 162 along the left and right side and a first panel connector hole 170 proximate to each of the tapered edge 162, and at least two triangle panel 104 having a hypotenuse edge 180 with a second panel connector hole 164 proximate to each of the hypotenuse edge 180.

In an exemplary embodiment, a collapsible tray 100 can comprise more than one foldable side 160. The foldable side 160 can comprise a trapezoid panel 114 having a tapered edge 162 along the left and right sides. A first panel connector hole 170 is located proximate to each of the tapered edge 162, and at least two triangle panels 104 each having a hypotenuse edge 180 and each having a second panel connector hole 164 located proximate to each of the hypotenuse edge 180.

The collapsible tray 100 further comprises a panel connector 106 that passes through the first panel connector hole 170 and the second panel connector hole 164 securing together in a movable manner each of the triangle panel 104 to the trapezoid panel 114, and, more than one side panel 108. The side panel 108 is movably interconnected at each end to the foldable side 160 forming a tray perimeter 194. The collapsible tray 100 further comprises a base 110 that is movably interconnected to each of the foldable sides 160 and each of the side panels 108. In operation, when user 302 applies a collapsing force 202/204 to the trapezoid panel 114 or the side panel 108, the adjacency between the tapered edge 162 and the hypotenuse edge 180 folds inward towards the base 110 allowing each of the foldable side 160, and the side panel 108 to fold flat on top of the base 110.

The collapsible tray 100 further comprises a drawer 112. Drawer 112 comprises at least one first slidable track 128. The base 110 comprises at least one second slidable track 192. The first slidable track 128 and second slidable track 192 interlock allow drawer 112 to be slidably attached along the bottom surface of the base 110. In operation, user 302 can slide drawer 112 out from the bottom of base 110 to access the contents inside drawer 112 and then slide drawer 112 back under base 110 for storage, even while the collapsible tray 100 is in the closed position.

Figures 10A, 10B:
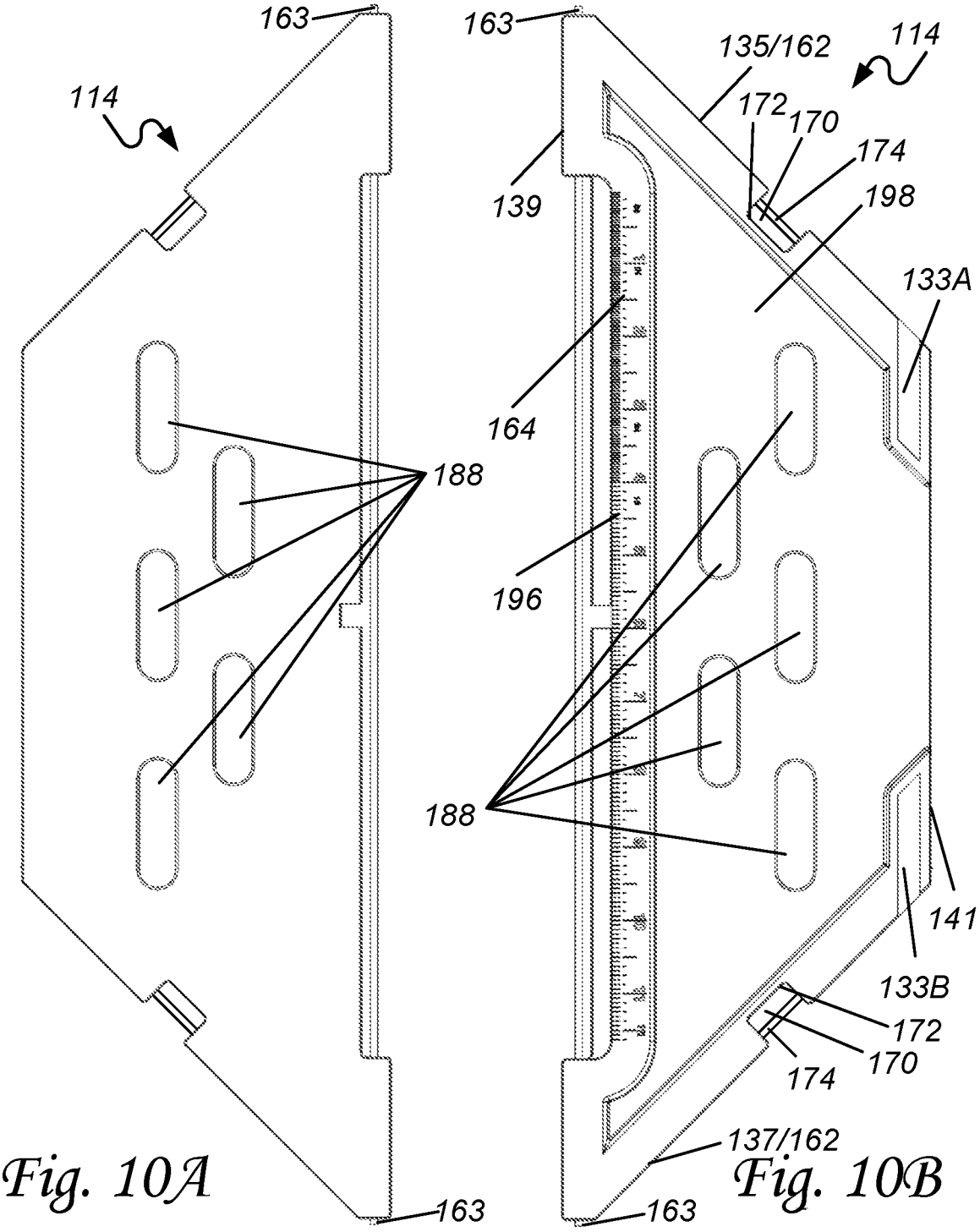
FIGS. 10A-10F illustrate one example of a trapezoid panel.
Figure 11A:
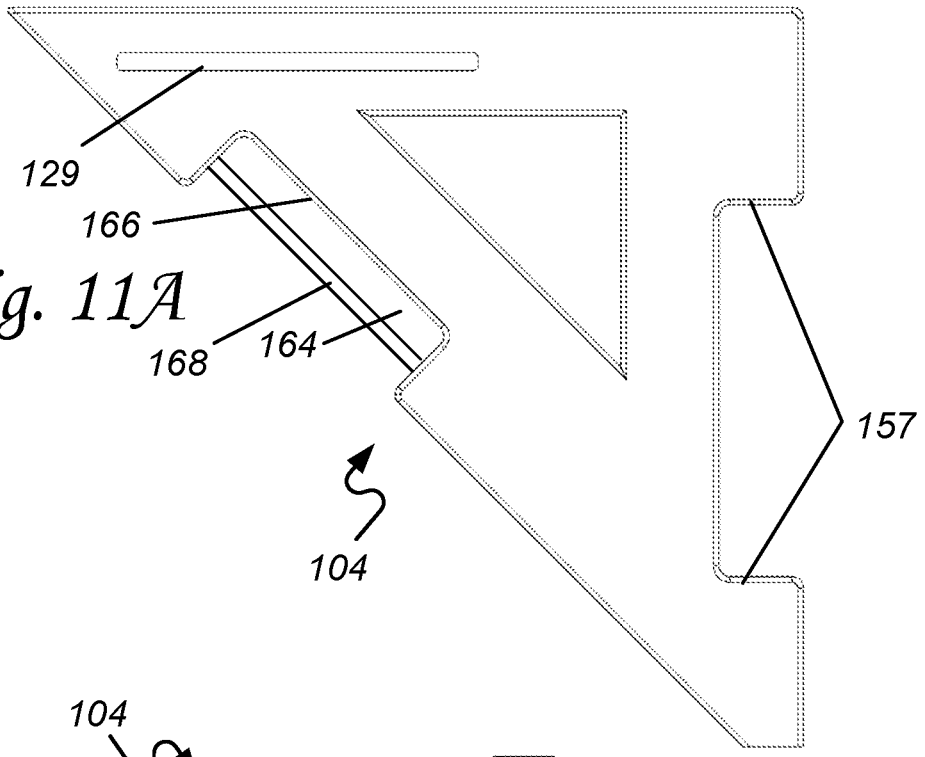

In an exemplary embodiment and better illustrated in at least FIGS. 10B and 11A, the collapsible tray 100 can comprise more than one foldable side 160. The foldable side 160 comprises a trapezoid panel 114, and at least two triangle panels 104. The trapezoid panel 114 has a top trapezoid edge 141, a bottom trapezoid edge 139, a left trapezoid edge 135, a right trapezoid edge 137, a portion first trapezoid base hinge 163 along the bottom trapezoid edge 139, a tapered edge 162 along each of the left trapezoid edge 135 and the right trapezoid edge 137, and at least one first panel connector hole 170 that is proximate to each of the tapered edge 162.

The triangle panel 104 forms a right triangle having a base edge 176, a perpendicular edge 178, a hypotenuse edge 180, a portion first triangle side panel hinge 157, and at least one second panel connector hole 164 that is proximate to the hypotenuse edge 180. One of the triangle panels 104 is positioned on the left trapezoid edge 135 and one of the triangle panels 104 is positioned on the right trapezoid edge 137. The base edge 176 aligns with the top trapezoid edge 141 and the hypotenuse edge 180 aligns with the tapered edge 162.

The collapsible tray 100 can further comprise more than one panel connector 106. The panel connector 106 passes through the first panel connector hole 170 and the second panel connector hole 164 securing together in a movable manner one of the triangle panel 104 to the left trapezoid edge 135 and one of the triangle panel 104 to the right trapezoid edge 137.

In an exemplary embodiment and an advantage in the present invention is that the trapezoid panel 114 and the triangle panels 104 are mutually exclusive and absent any panel connection therebetween. Instead, the panel connector 106 secures around the tringle panel bridge pin 168 and the trapezoid panel bridge pin 174 (and/or passes through the first panel connector hole 170 and the second panel connector hole 164) to hold loosely and freely the trapezoid panel 114 and the triangle panels 104 in positions. This arrangement prevents the trapezoid panel 114, triangle panels 104, and side panels 108 from binding during the opening and closing of the collapsible tray 100. In this regard, with minimal opening or collapsing force 202/204 the collapsible tray 100 can reliably open or fold without binding the panels as they move between positions.

Figure 7A:
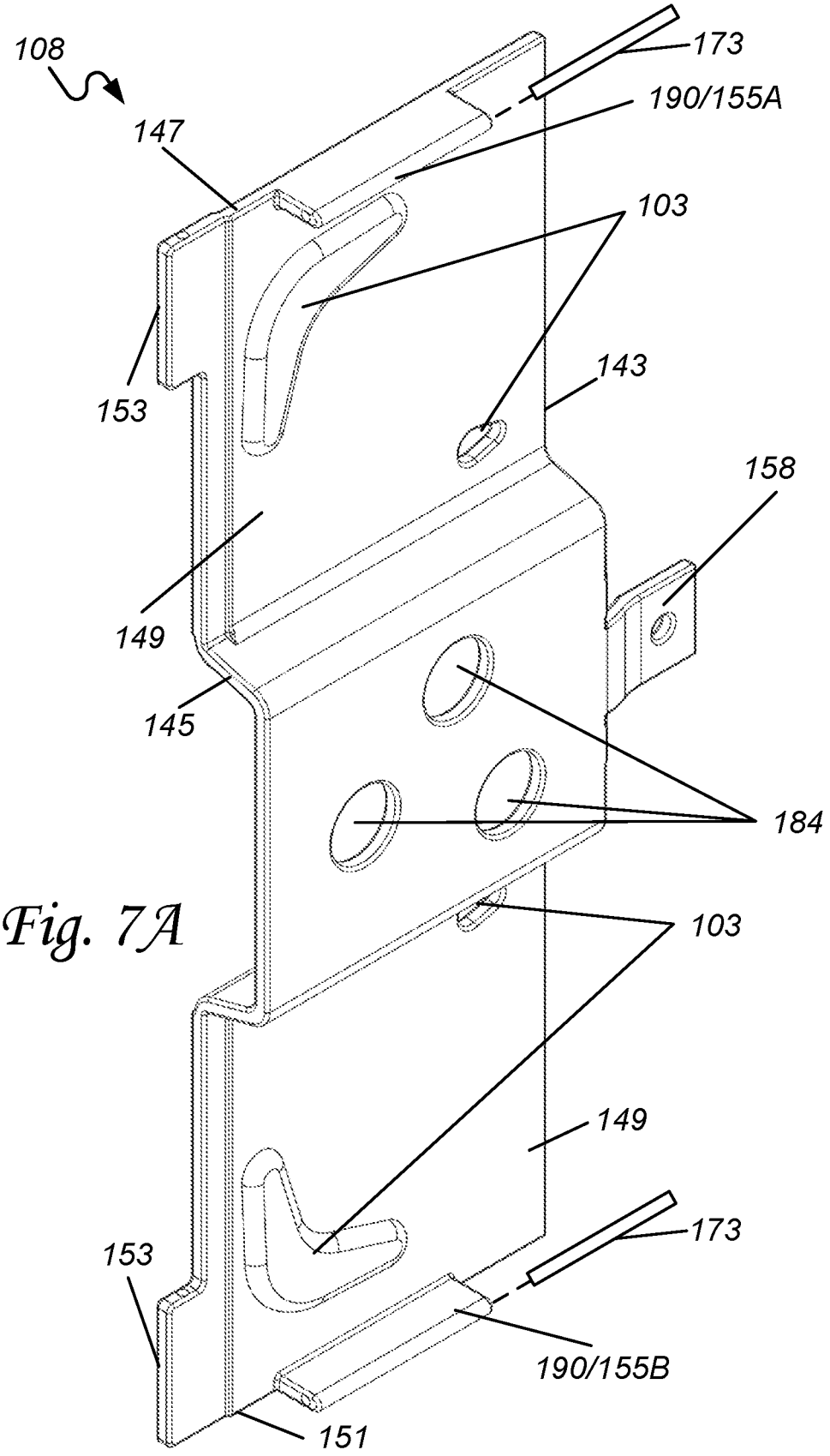

Better illustrated in at least FIG. 7A, the collapsible tray 100 can further comprise more than one side panel 108 that has a left side panel edge 151, a right side panel edge 147, a top side panel edge 143, and a bottom side panel edge 145. The bottom side panel edge 145 comprises a portion of at least one first side panel base hinge 153. The left side panel edge 151 comprises a portion of at least one second triangle side panel hinge 155B and the right side panel edge 147 comprises a portion of at least one of the second triangle side panel hinge 155A. Each of the first triangle side panel hinge 157 and the second triangle side panel hinge 155A-B are movably interconnected forming a tray perimeter 194 that comprises two of the side panel 108 and two of the foldable side panel 160.

The collapsible tray 100 can further comprise a base 110. The base 110 can comprise a portion of at least one second trapezoid base hinge 159 that interconnects with the first trapezoid base hinge 163 securing together in a movable manner each of the trapezoid panel 114 to the base 110, and a portion of at least one second side panel base hinge 161 that interconnects with the first side panel base hinge 153 securing together in a movable manner each of the side panel 108 to the base 110.

In operation, when a user 302 applies a collapsing force 202/204 to the trapezoid panel 114 or the side panel 108, the adjacency between the tapered edge 162 and the hypotenuse edge 180 folds inward allowing each of the trapezoid panel 114, the triangle panel 104, and the side panel 108 to fold flat on top of the base 110.

In another exemplary embodiment and with reference to at least FIG. 10B, the collapsible tray 100 can comprise more than one trapezoid panel 114. The trapezoid panel 114 has a top trapezoid edge 141, a bottom trapezoid edge 139, a left trapezoid edge 135, a right trapezoid edge 137, a portion first trapezoid base hinge 163 along the bottom trapezoid edge 139, a tapered edge 162 along each of the left trapezoid edge 135 and the right trapezoid edge 137, and better illustrated in at least FIG. 1H, at least one first panel connector hole 170 proximate to each of the tapered edge 162. The bottom trapezoid edge 139 can comprise a portion of at least one first trapezoid base hinge 163.

The collapsible tray 100 can further comprise more than one triangle panel 104 that forms a right triangle having a base edge 176, a perpendicular edge 178, a hypotenuse edge 180, and at least one second panel connector hole 164 proximate to the hypotenuse edge 180. The perpendicular edge 178 comprises a portion of at least one first triangle side panel hinge 157. One of the triangle panels 104 is positioned on the left trapezoid edge 135 and one of the triangle panels 104 is positioned on the right trapezoid edge 137. The base edge 176 aligns with the top trapezoid edge 141 and the hypotenuse edge 180 aligns with the tapered edge 162.

The collapsible tray 100 can further comprise more than one panel connector 106. The panel connector 106 passes through the first panel connector hole 170 and the second panel connector hole 164 securing together in a movable manner one of the triangle panel 104 to the left trapezoid edge 135 and one of the triangle panel 104 to the right trapezoid edge 137, forming a foldable side panel 160 that is rectangular in shape.

Better illustrated in at least FIG. 7A, the collapsible tray 100 can further comprise more than one side panel 108 that has a left side panel edge 151, a right side panel edge 147, a top side panel edge 143, and a bottom side panel edge 145. The bottom side panel edge 145 can comprise a portion of at least one first side panel base hinge 153. The left side panel edge 151 can comprise a portion of at least one second triangle side panel hinge 155B and the right side panel edge 147 can comprise at least one of the second triangle side panel hinge 155A. Each of the first triangle side panel hinge 157 and the second triangle side panel hinge 155A-B are movably interconnected forming a tray perimeter 194 that comprises two of the side panel 108 and two of the foldable side panel 160.

The collapsible tray 100 can further comprise a base 110. The base 110 can comprise a portion of at least one second trapezoid base hinge 159 that interconnects with the first trapezoid base hinge 163 securing together in a movable manner each of the trapezoid panel 114 to the base 110, and a portion of at least one second side panel base hinge 161 that interconnects with the first side panel base hinge 153 securing together in a movable manner each of the side panel 108 to the base 110.

In operation, when a user 302 applies a collapsing force 202/204 to the trapezoid panel 114 or the side panel 108, the adjacency between the tapered edge 162 and the hypotenuse edge 180 folds inward allowing each of the trapezoid panel 114, the triangle panel 104, and the side panel 108 to fold flat on top of the base 110.

Referring to FIG. 1I, there is illustrated one example of the back surface view foldable side 160 having magnetic locking tabs 175. In an exemplary embodiment, magnetic locking tabs 175 can be used to hold the collapsible tray 100 in the open position. In this regard, a magnetic surface 177 can be embedded in or otherwise affixed to one of the panels such as triangle panel 104 in this embodiment. Correspondingly, a tab magnet 179 can be embedded in the locking tab 175. The locking tab 175 can be glued, integrally formed, or otherwise affixed to an adjacent panel such as trapezoid panel 114. The locking tab 175 with tab magnet 179 and the magnetic surface 177 are positioned on their respective panels such that when the collapsible tray 100 is opened, the tab magnet 179 and the magnetic surface 177 overlap and come in close proximity to one another magnetically connecting 210 to prevent the collapsible tray 100 from closing without sufficient collapsible force 202/204 applied to break or otherwise separate the magnetic force 210 between the tab magnet 179 and the magnetic surface 177.

In an exemplary embodiment, more than one locking tab 175 with tab magnet 179 and magnetic surface 177 can be used, as may be required and/or desired in a particular embodiment.

In an exemplary embodiment, any of the panels 104/108/114, base 110, drawer 112, drawer lid 120, handle 118, rotating link 102, folding link 122, or other components can use locking tabs 175 with tab magnetics 179 and magnetic surfaces 177, as may be required and or desired in a particular embodiment. In addition, the locking tab 175 can be placed on any panel or component and orientated as needed to effectuate the tab magnetic 179 magnetically interconnecting 210 with the magnetic surface 177.

In an exemplary embodiment, the collapsible tray 100 further comprises at least one locking tab 175. The locking tab 175 comprises a tab magnet 179 on one end and is fastened on the other end to either the trapezoid panel 114 or the triangle panel 104. When the collapsible tray is in an open position the locking tab 175 overlays both the trapezoid panel 114 and the triangle panel 104, and the tab magnet 179 magnetically engages 210 a magnetic surface 177 on either the trapezoid panel 114 or the triangle panel 104 whichever is absent the locking tab 175, keeping the collapsible tray 100 from closing by preventing the triangle panel 104 and the trapezoid panel 114 from folding along the tapered edge 162.

Figure 2A:
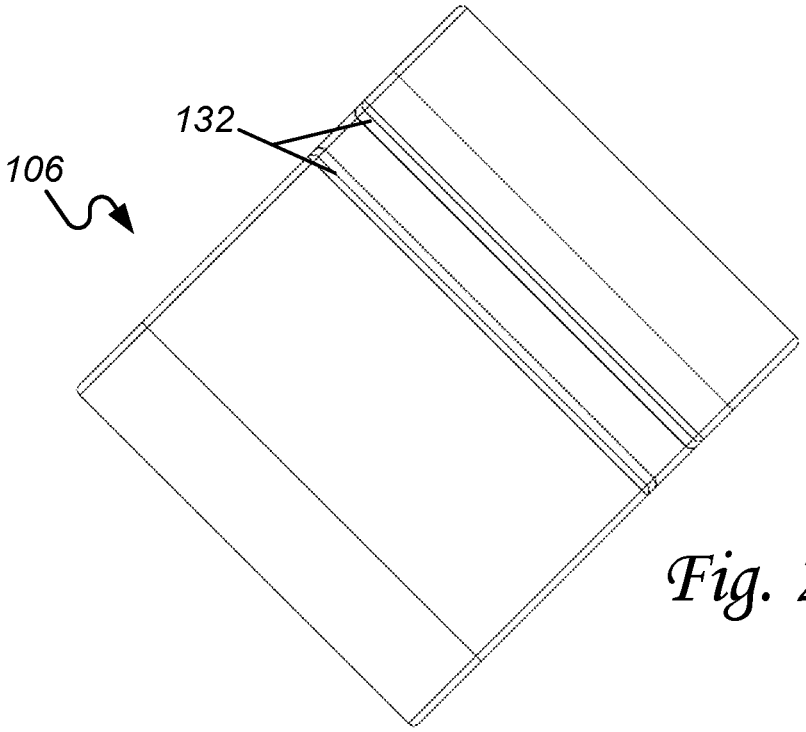
FIGS. 2A-2D illustrate one example of a panel connector.

Referring to FIGS. 2A-2D, there is illustrated one example panel connector 106. FIG. 2A illustrates a bottom view of the panel connector 106 having an opening 132. Such opening 132 can be used to slide around triangle panel bridge pin 168 and trapezoid panel bridge pin 174, to interconnect triangle panel 104 and trapezoid panel 114 in a movable manner, when the panel connector 106 is installed between the triangle panel 104 hypotenuse edge 180 and trapezoid panel 114 tapered edge 162.

Figure 2B:
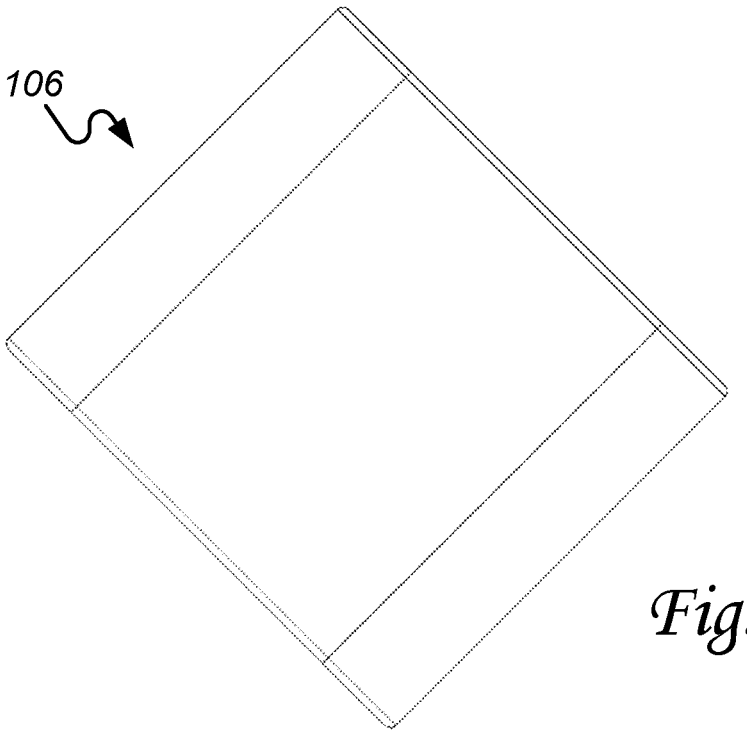
Figure 2C:
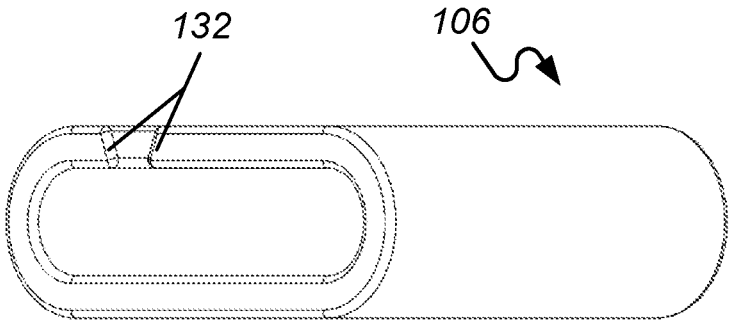
Figure 2D:
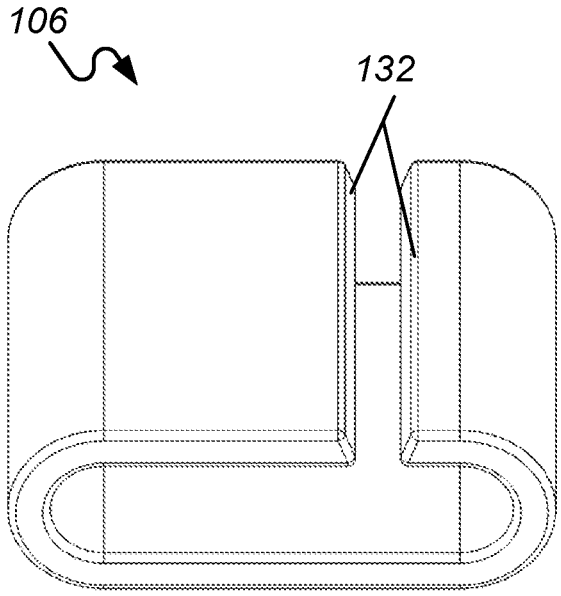

FIG. 2B is a top view of the panel connector 106. FIG. 2C is a front right and front left perspective view of panel connector 106. The right and left side views are the same. The front and back views are the same. FIG. 2D is a bottom front perspective view of the panel connector 106.

Referring to FIGS. 3A-3F, there is illustrated one example of a rotating link 102. FIG. 3A is a front perspective view of the rotating link 102. FIG. 3B is a back perspective view of a rotating link 102. FIG. 3C is a right side view of the rotating link 102. FIG. 3D is a left side view of the rotating link. FIG. 3E is a top view of the rotating link 102. FIG. 3F is a bottom side view of the rotating link 102.

In an exemplary embodiment, rotating link 102 can comprise a connecting end 136 that interconnects with handle 118 connecting end 138. Such connecting ends 136/138 interconnections can be by way of a hinge connection. Such hinge interconnection can be by way of pins 173 inserted through connecting ends 136/138, snap on hinges to rotating link 102 and handle 118, snap together edges on rotating link 102 and handle 118, or by other hinge type interconnections, as may be required and/or desired in a particular embodiment.

Figure 4C:
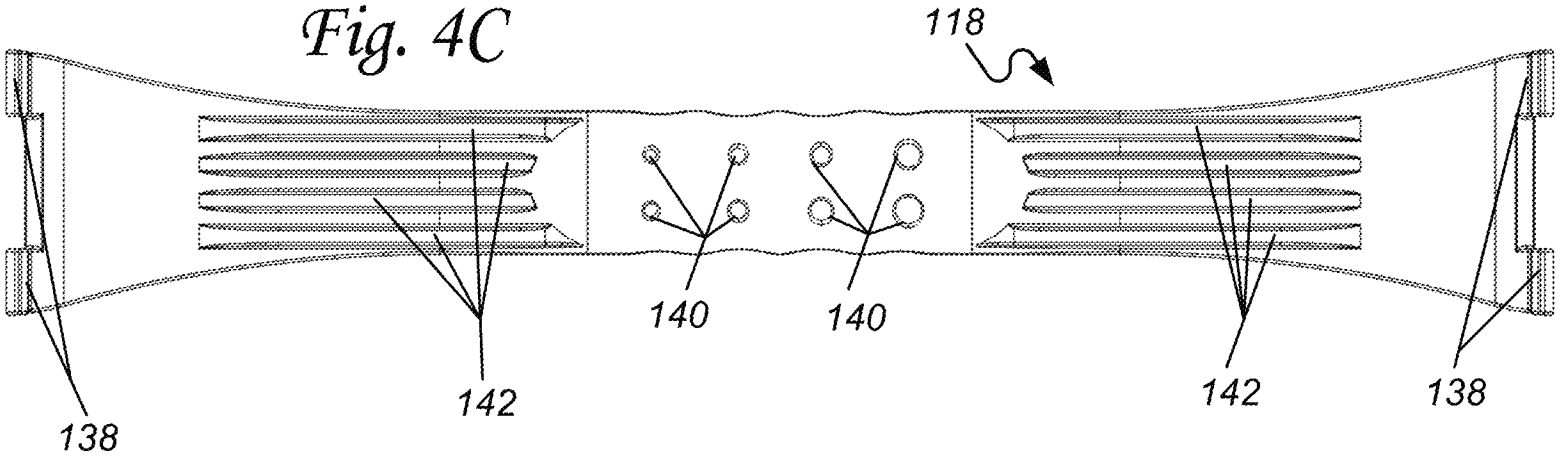
Figure 4D:
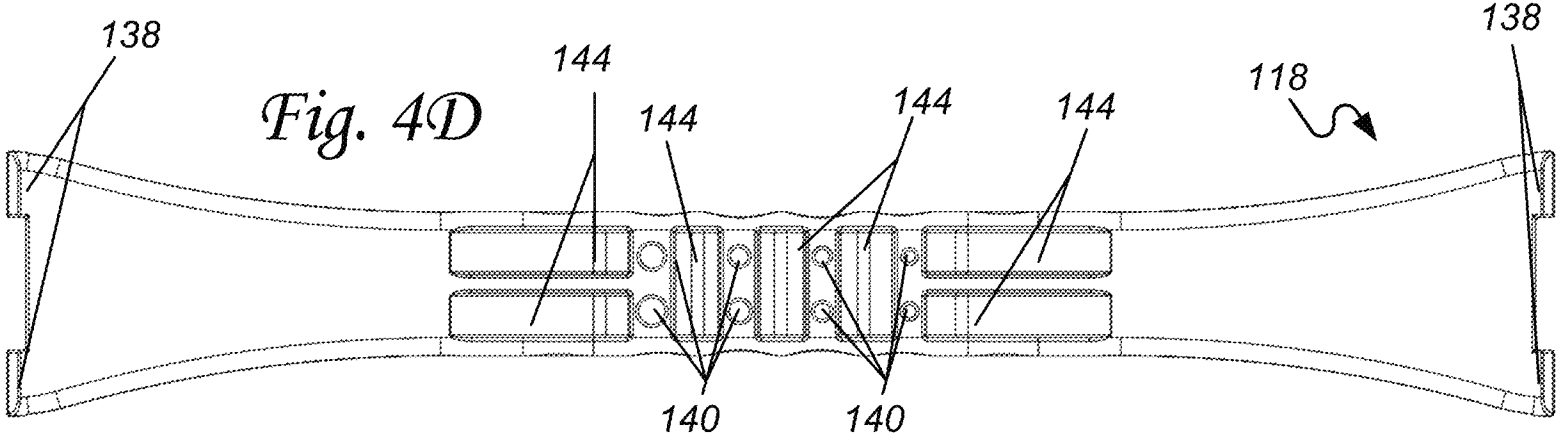

Referring to FIGS. 4A-4D, there is illustrated one example of a handle 118. FIG. 4A is a top perspective view of a handle 118. FIG. 4B is a bottom perspective view of a handle 118. FIG. 4C is a bottom view of a handle 118. FIG. 4D is a top view of a handle 118.

Figure 5C:
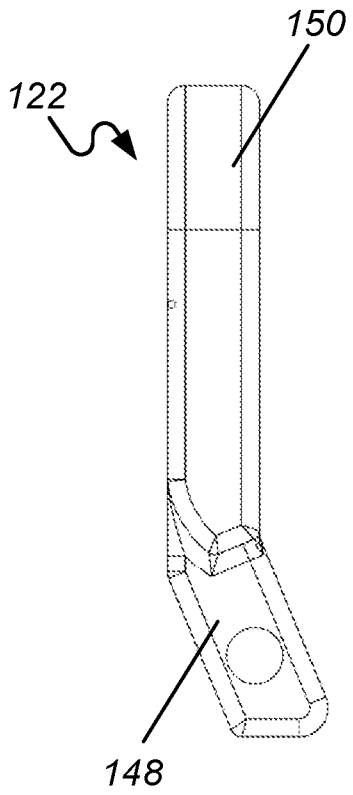
Figure 5D:
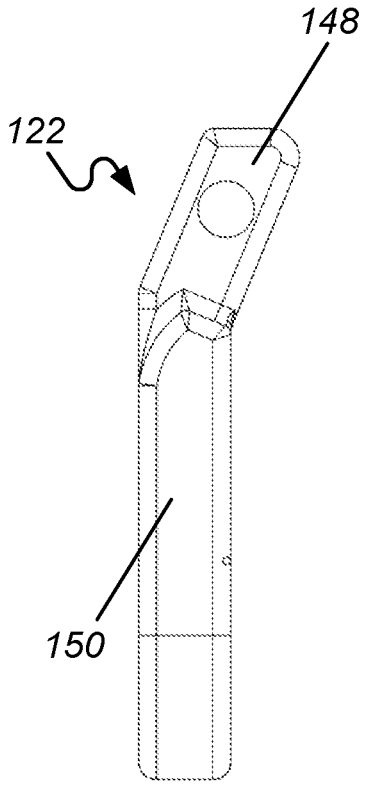

Referring to FIGS. 5A-5D there is illustrated one example of a folding link 122. FIG. 5A is a bottom front perspective view of a folding link 122. FIG. 5B is a top front perspective view of a folding link 122. FIG. 5C is a left side view of a folding link 122. FIG. 5D is a right side view of a folding link 122.

Figure 7B:
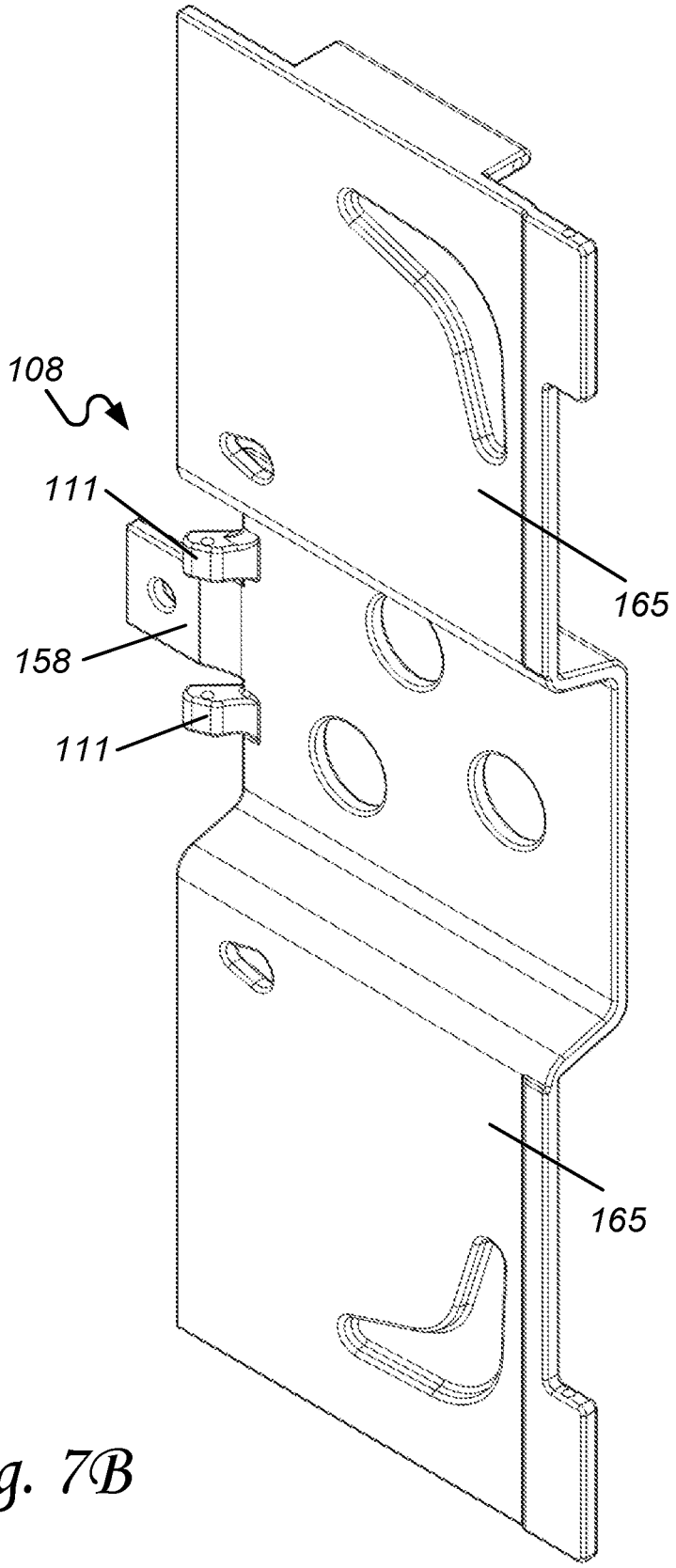

In an exemplary embodiment and as better illustrated in at least FIGS. 1G and 7B, link end 148 can be interconnected with side connect end 111 of side panel 108 by way of a hinge connection. Such hinge interconnection can be by way of pins 173 inserted through link end 148 and side connect 111, snap on hinges to link end 148 and side connect 111, snap together edges on link end 148 and side connect 111, or by other hinge type interconnections, as may be required and/or desired in a particular embodiment.

Figure 6A:
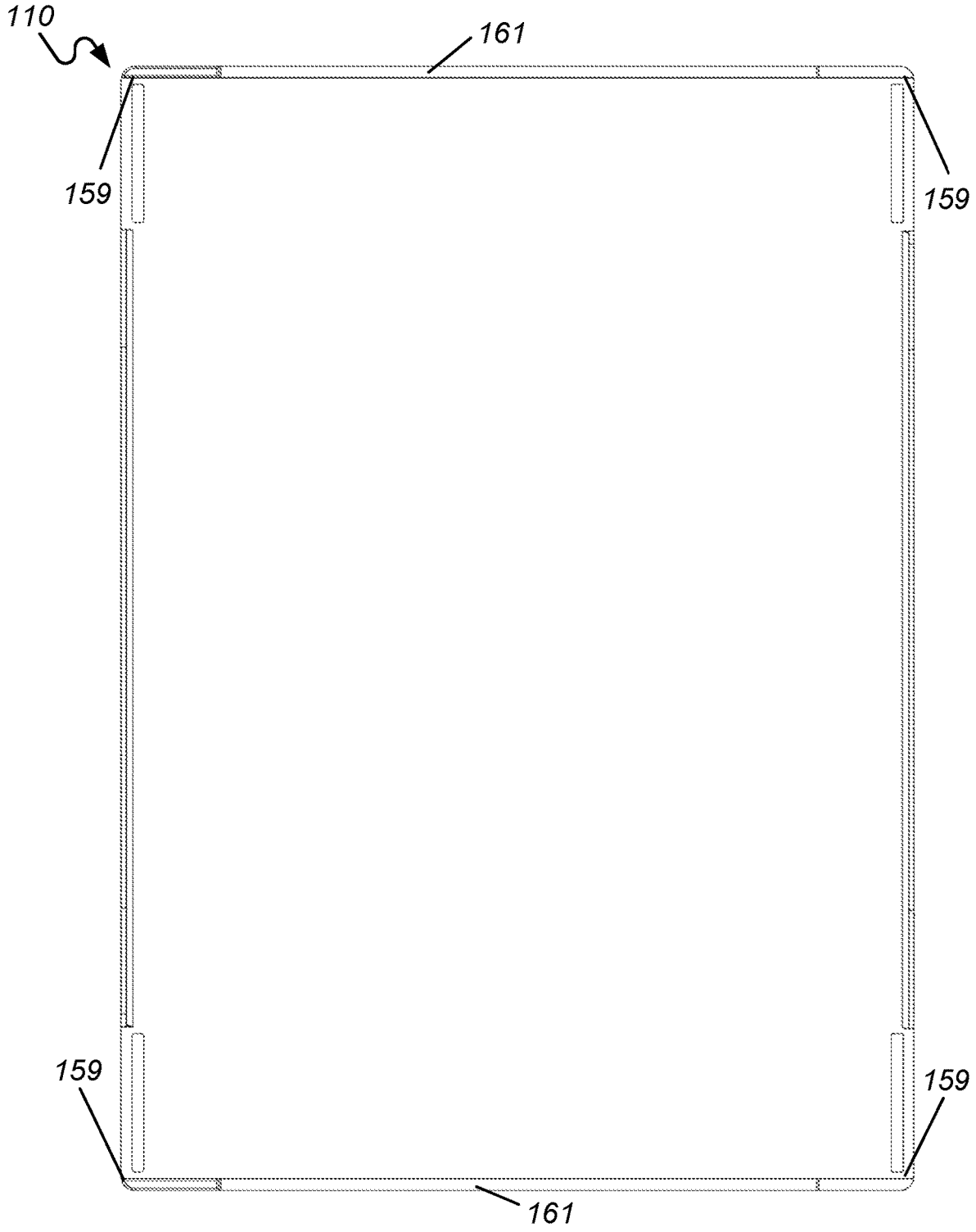
Figure 6B:
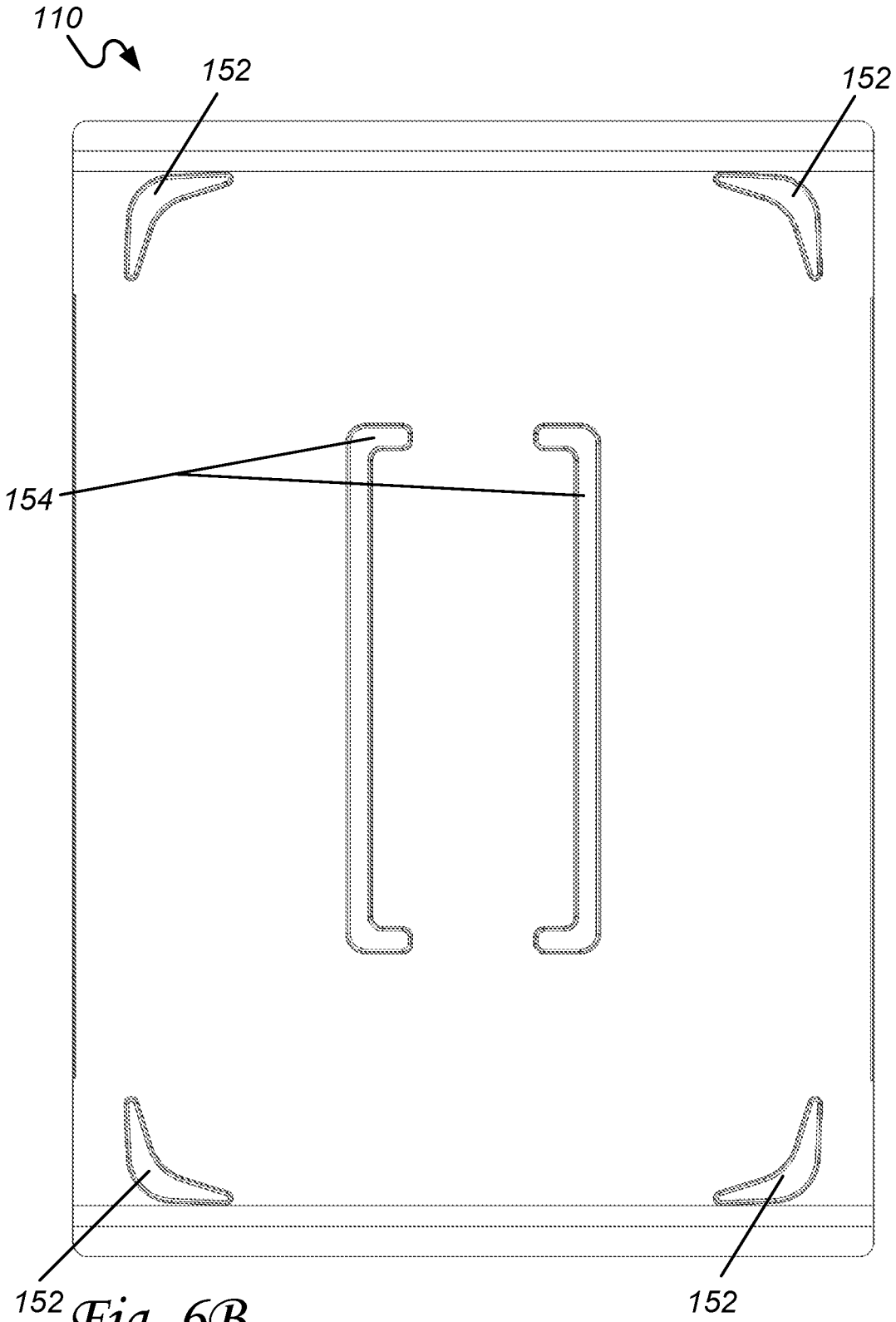
Figure 6C:
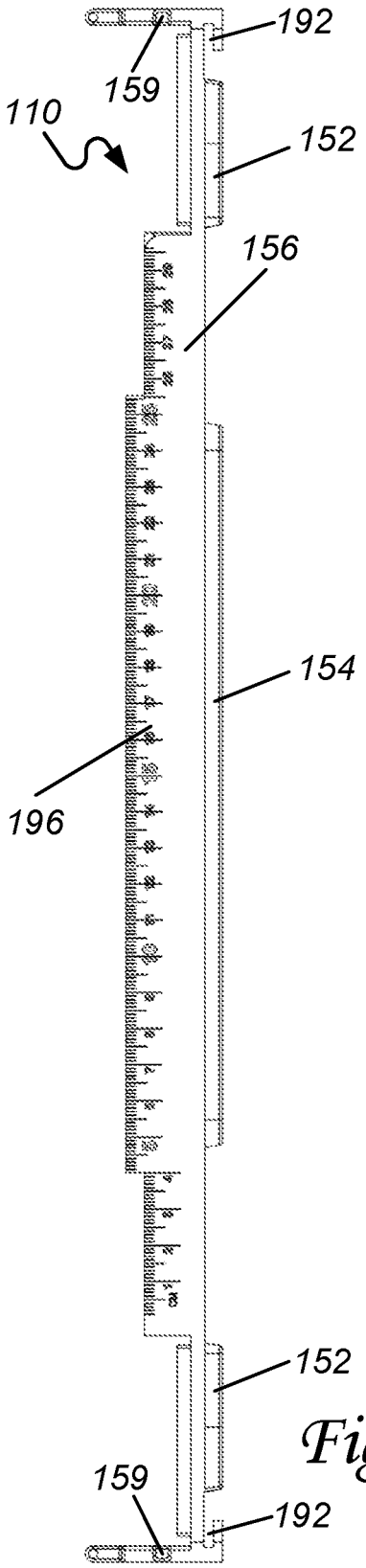
Figure 6D:
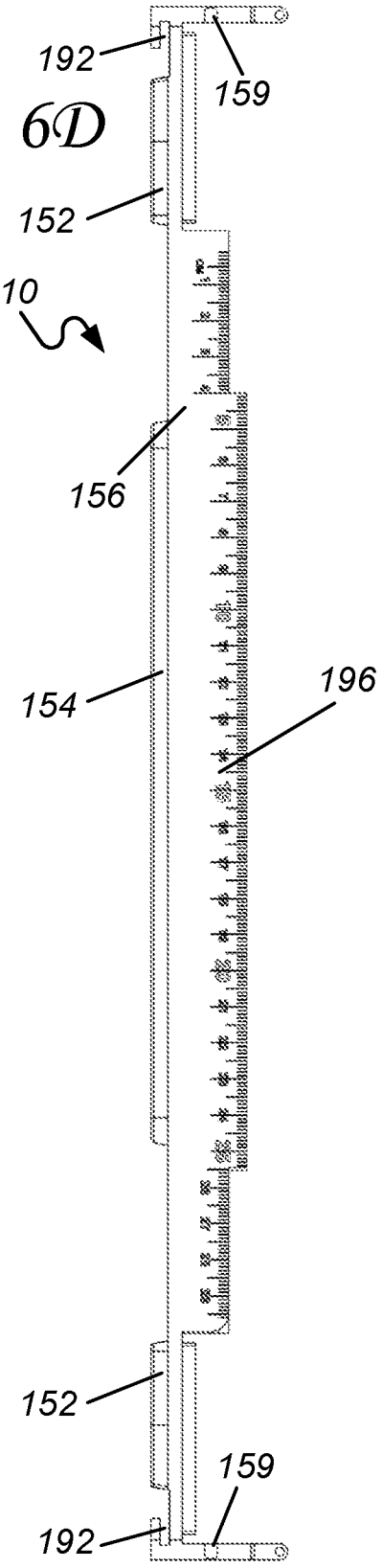

Referring to FIG. 6A-6F, there is illustrated one example of a base 110. FIG. 6A is a top view of a base 110. FIG. 6B is a bottom view of base 110 that illustrated base standoffs 152/154 that can be integrally formed into the bottom surface of base 110. FIG. 6C is a front view of base 110. FIG. 6D is a back view of base 110. FIG. 6E is a right side view of base 110. FIG. 6F is a left side view of base 110.

In an exemplary embodiment and an advantage in the present invention is that the base 110 has standoffs 152/154. In this regard, drawer 112 can be completely removed from the base 110 and the base 110 can rest on a surface on standoffs 152/154. This renders the collapsible tray 100 usable with and without the drawer 112 installed under the base 110.

Referring to FIG. 7A-7F, there is illustrated, one example of a side panel 108. FIG. 7A is a back perspective view of a side panel 108. FIG. 7B is a front perspective view of a side panel 108. FIG. 7C is a bottom perspective view of a side panel 108. FIG. 7D is a top perspective view of a side panel 108. FIG. 7E right side view of a side panel 108. FIG. 7F is a left side view of a side panel 108.

In an exemplary embodiment, side panel 108 can have one or more side panels light weighting hole 184. In this regard, without significantly compromising the structural strength of side panel 108, one or more of the side panel light weighting holes 184 can be cut out of or otherwise eliminated from side panel 114. Such side panel light weighting holes 184 reduce material used and thus material costs as well as reduce the weight of the side panels 108 and thus the overall weight of the collapsible tray 100 making it easier for a user 302 to carry.

In an exemplary embodiment and with reference to at least FIGS. 7C and 7D, the side panel 108 can be contoured 167 such the end portions 169 of the side panel 108 are raised with respect to the center portion 171. An advantage in the present invention is that when the contoured 167 side panels 108 are closed they are parallel with the base 110 which is represented by dashed line 402. When the collapsible tray 100 is closed, storage passages 404 are created. It is within these storage passages 404 that the folded trapezoid panel 114 and the triangle panel 104 nest and fit. Furthermore, a recessed passage 406 is created between contour 167 and the raised end portion 169. The recessed passage 406 is illustrated between the plane line 408 which is aligned with the surface of the raised end portions 169 and the center portion 171. It is within this recessed passage 406 that the handle 118, and rotating links 102 fold and nest when the collapsible tray 100 is closed. With each of the trapezoid panel 114, triangle panel 104, rotating link 102, and handle 118 being of relatively the same thickness, resultant from the contour 167 of the side panel 108 is that each of the trapezoid panel 114, triangle panel 104, rotating link 102, and handle 118 lay parallel and flat with respect to the base 110 when the collapsible tray is closed and the thickness of the collapsible tray 100, when closed, is uniform across the base 110. This feature makes it easy to stack the collapsible tray 100 on top of or underneath other objects only occupying a minimum amount of space of uniform thickness for storage.

In an exemplary embodiment, the collapsible tray 100 can comprise more than one rotating link 102 and a handle 118. The side panel 108 can further comprise more than one contour 167 that forms at least two end portions 169 and a center portion 171. When the collapsible tray 100 is in a closed position, each of the contour 167 raises the end portion 169 creating a storage passage 404 under each of the end portion 169 where the triangle panel 104 and trapezoid panel 114 fold along the tapper edge 162 and fit. The center portion 170 creates a recessed passage 406 where the rotating link 102 and the handle 118 fold and fit. In operation, when in the closed position the collapsible tray is of uniform thickness across the base 110.

Additionally, when the collapsible tray 100 is folded and stacked or otherwise stored, drawer 112 can still be slid out from under the base by user 302 and opened to access the contents. The drawer 112 can then be slid back under the base 110 without having to remove the collapsible tray 100 from storage or open the collapsible tray 100.

In an exemplary embodiment, handle side stops 158 can be formed and positioned along the top edge of the side panel 108 proximate to the outer surface of the link connector 122 and rotating link 102 such that the hinge connection between the link connector 122 and the panel 108 can only flex inward towards the base 110. In this regard, handle side stop 158 prevents the handle 118 and associated interconnect parts including the rotating link 102 and the link connector 122 from swaying from side to side, holding the handle stationary over the base 110 when the collapsible tray 100 is being carried by a user 302.

Figure 8A:
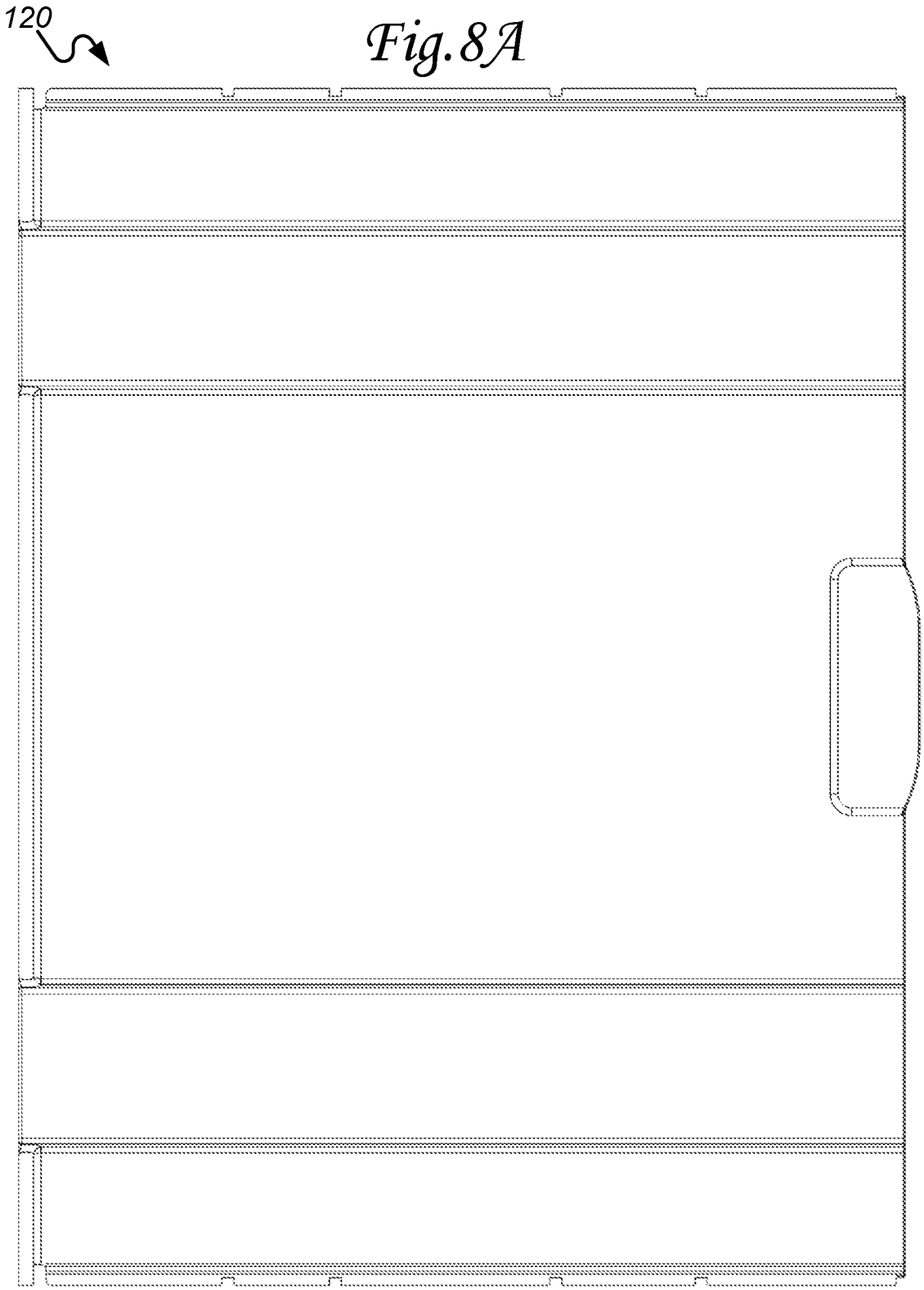
FIGS. 8A-8F illustrate one example of a drawer lid.
Figure 8B:
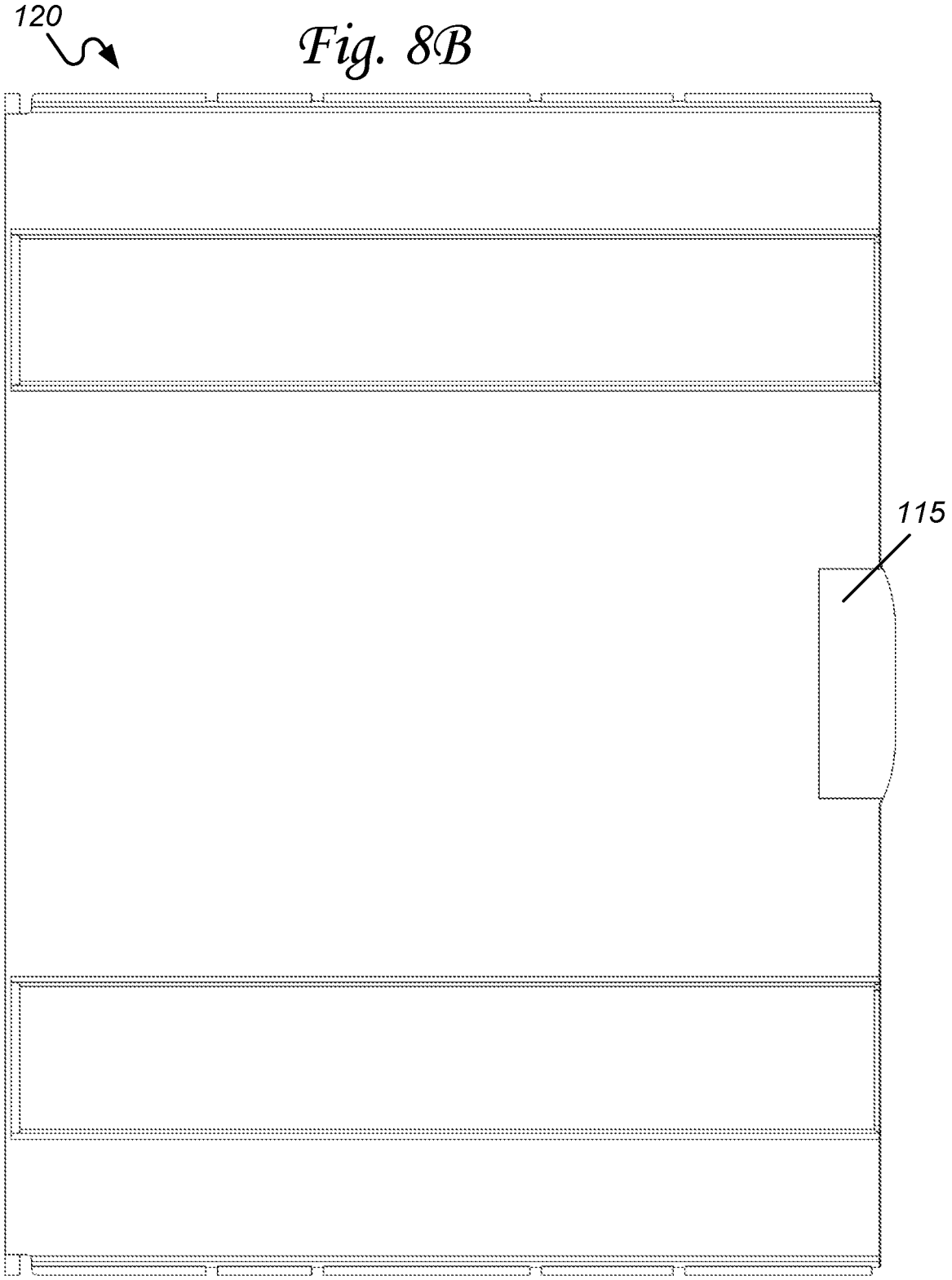
Figure 8C:
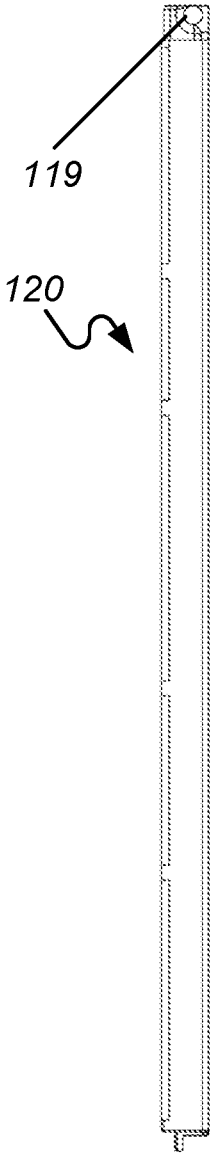
Figure 8D:
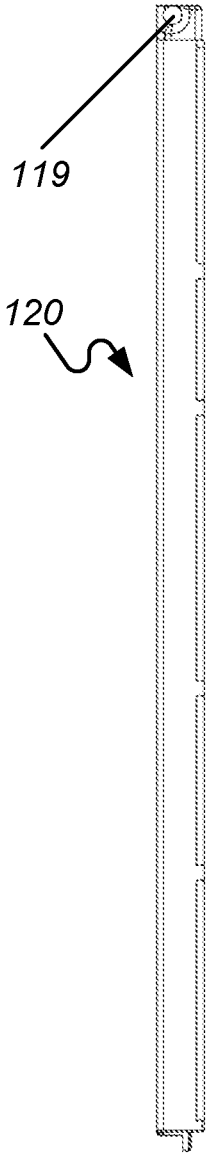

Referring to FIGS. 8A-8F, there is illustrated one example of a drawer lid 120. FIG. 8A is a top view of a drawer lid 120. FIG. 8B is a bottom view of a drawer lid 120. FIG. 8C is a right side view of a drawer lid 120. FIG. 8D is a left side view of a drawer lid 120. FIG. 8E is a back view of a drawer lid 112. FIG. 8F is a front view of a drawer lid 112.

In an exemplary embodiment, a lid handle 115 can be formed in drawer lid 120. In this regard, the lid handle 115 can provide a way for user 302 to open and close drawer lid 120, as well as friction fit, snap, latch, or otherwise be secured to drawer 112 as to keep the drawer lid 120 closed preventing the contents inside drawer 112 from spilling or undesirably mixing between drawer 112 compartments 117.

Figure 9B:
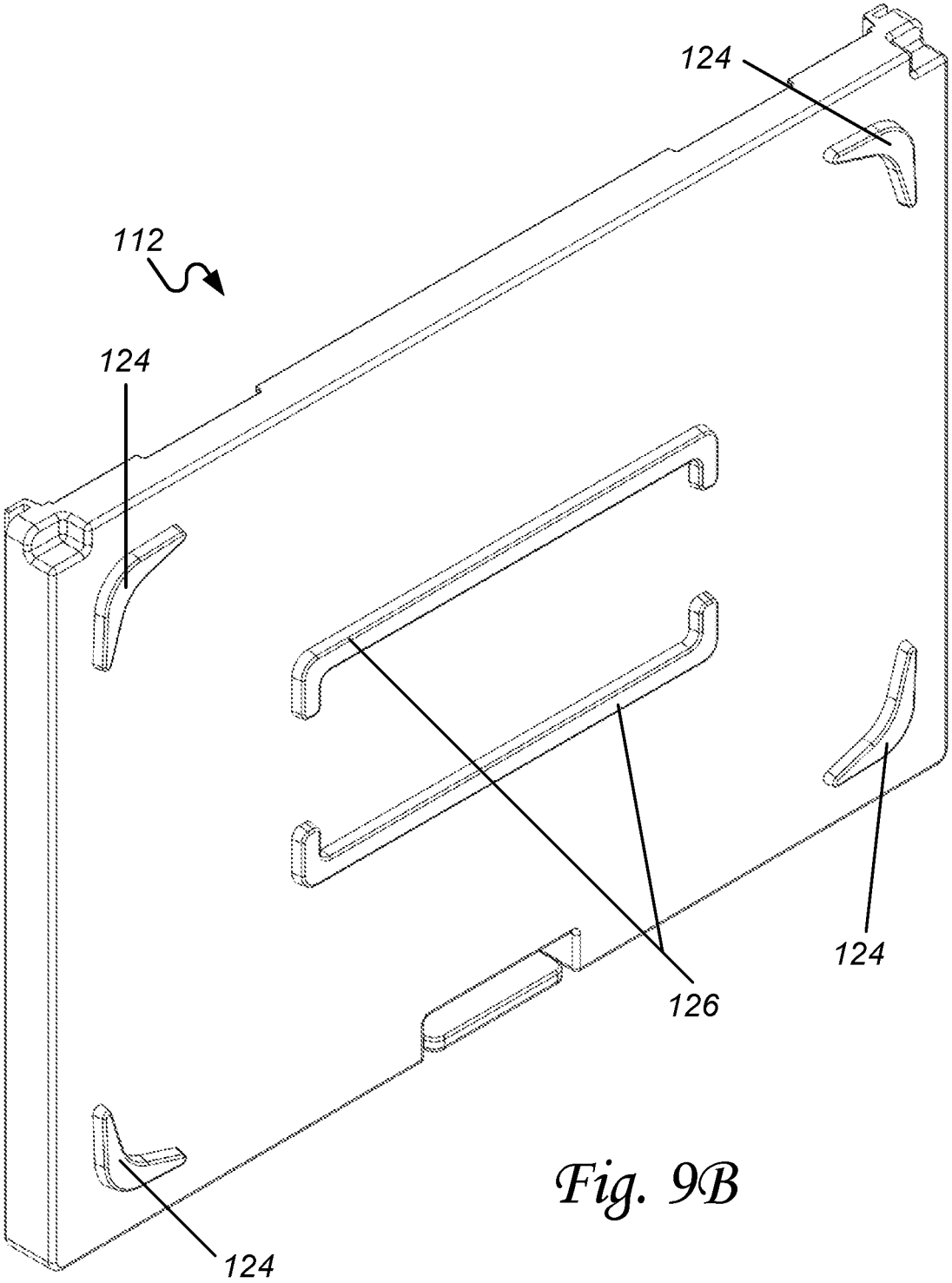
Figure 9C:
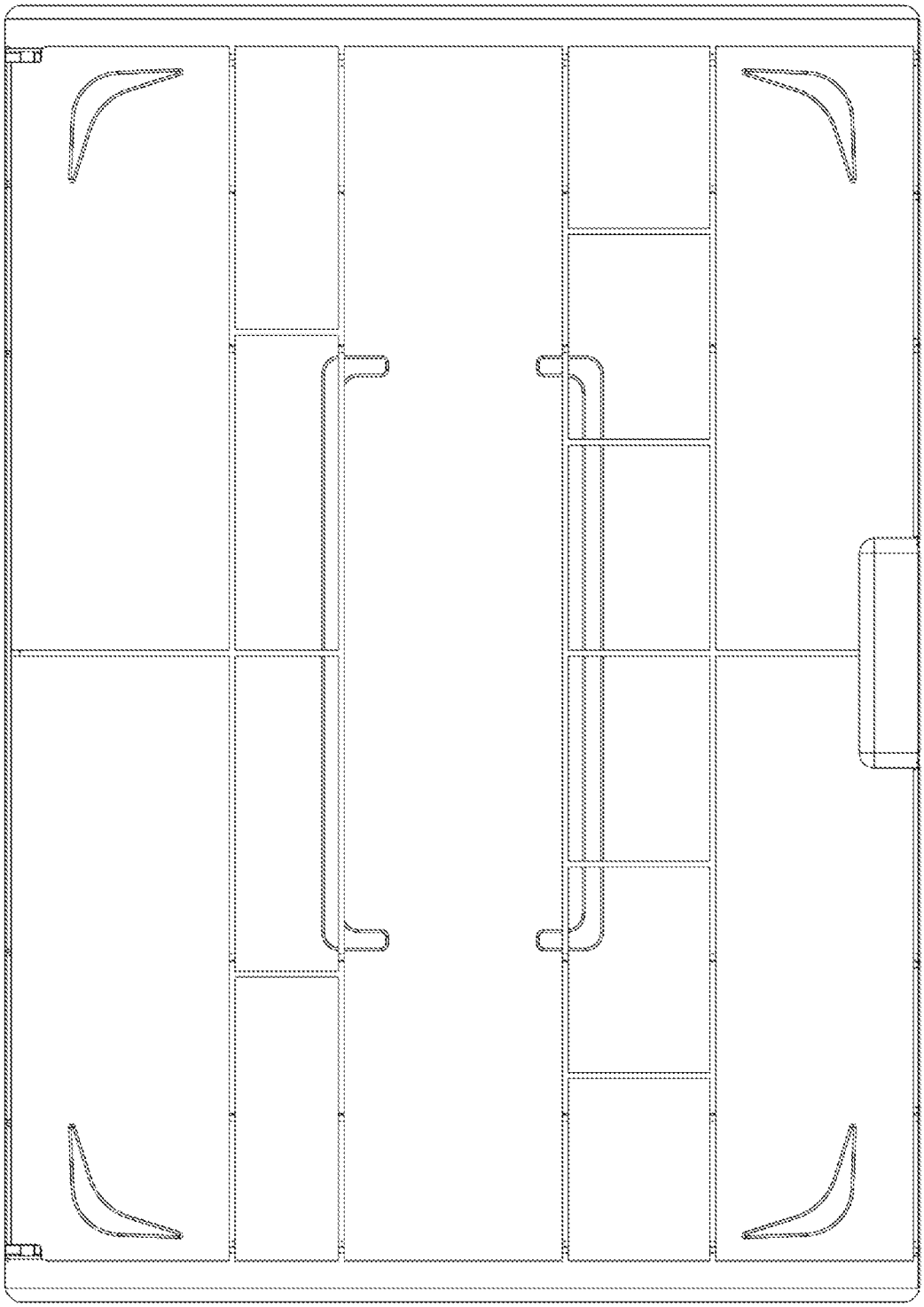
Figure 9D:
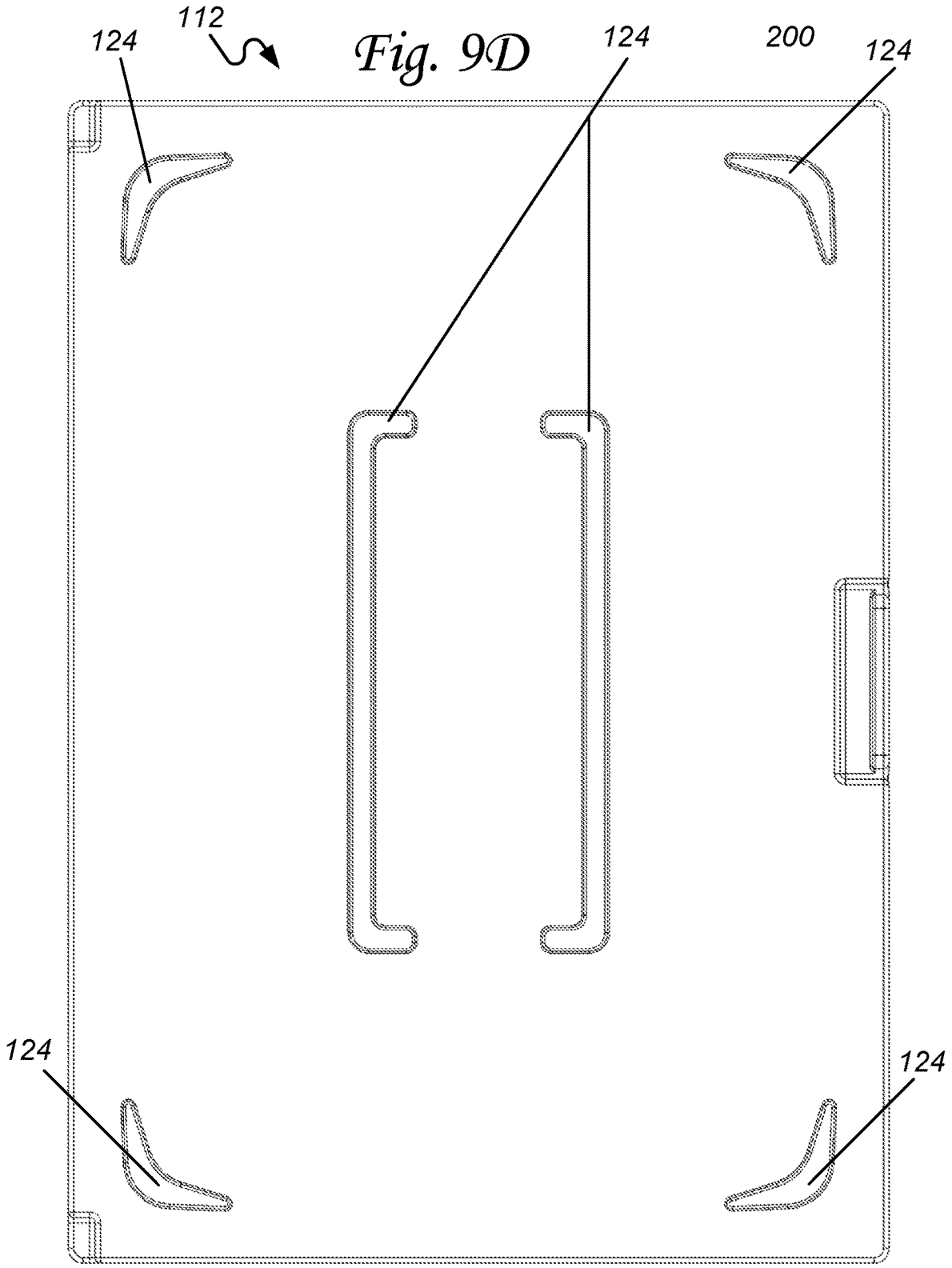
Figure 9E:
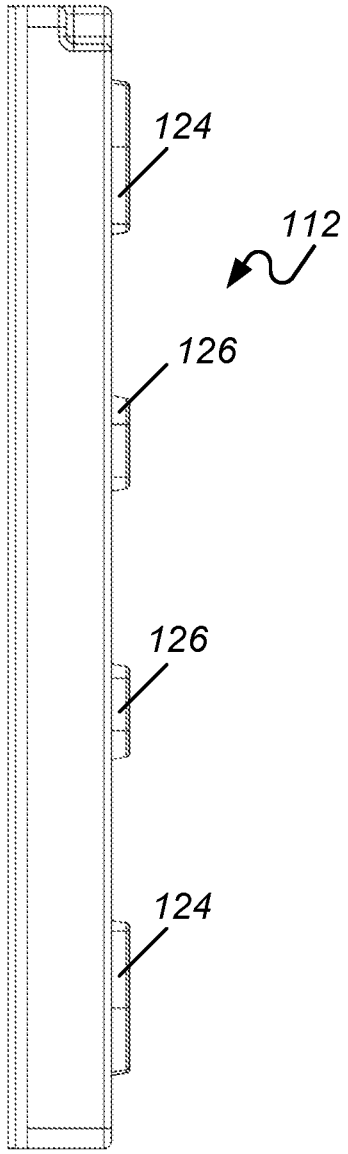
Figure 9F:
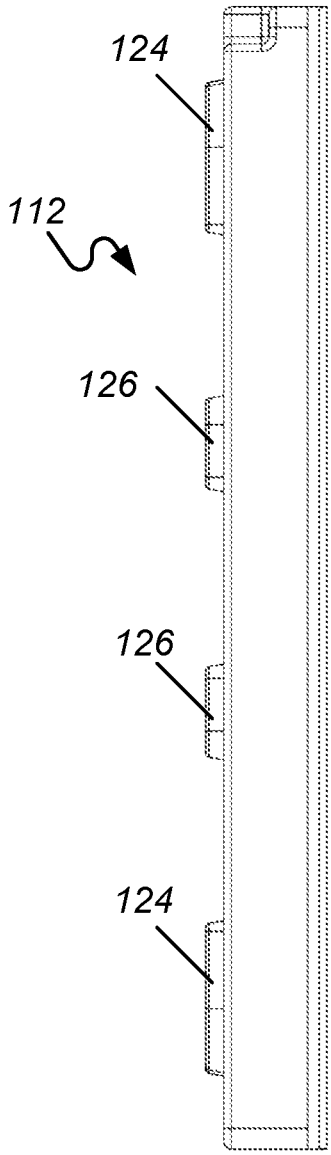

Referring to FIGS. 9A-9H, there is illustrated one example of a drawer 112. FIG. 9A is a top perspective view of a drawer 112 having more than one compartment 117. FIG. 9B is a back perspective view of drawer 112. FIG. 9C is a top view of drawer 112. FIG. 9D is a bottom view of drawer 112. FIG. 9E is a right side view of drawer 112. FIG. 9F is a left side view of drawer 112. FIG. 9G is a back view of drawer 112. FIG. 9H is a front view of drawer 112.

In an exemplary embodiment, drawer 112 is useable by user 302 even when the collapsible tray 100 is folded closed. In this regard, while the triangle panel 104, trapezoid panel 114, and side panel 108 are folded closed on the base 110, user 302 can still slide drawer 112 out to access contents within drawer 112 and then slide the drawer 112 closed back under the base 110 when done for storage.

Figures 10C, 10D:
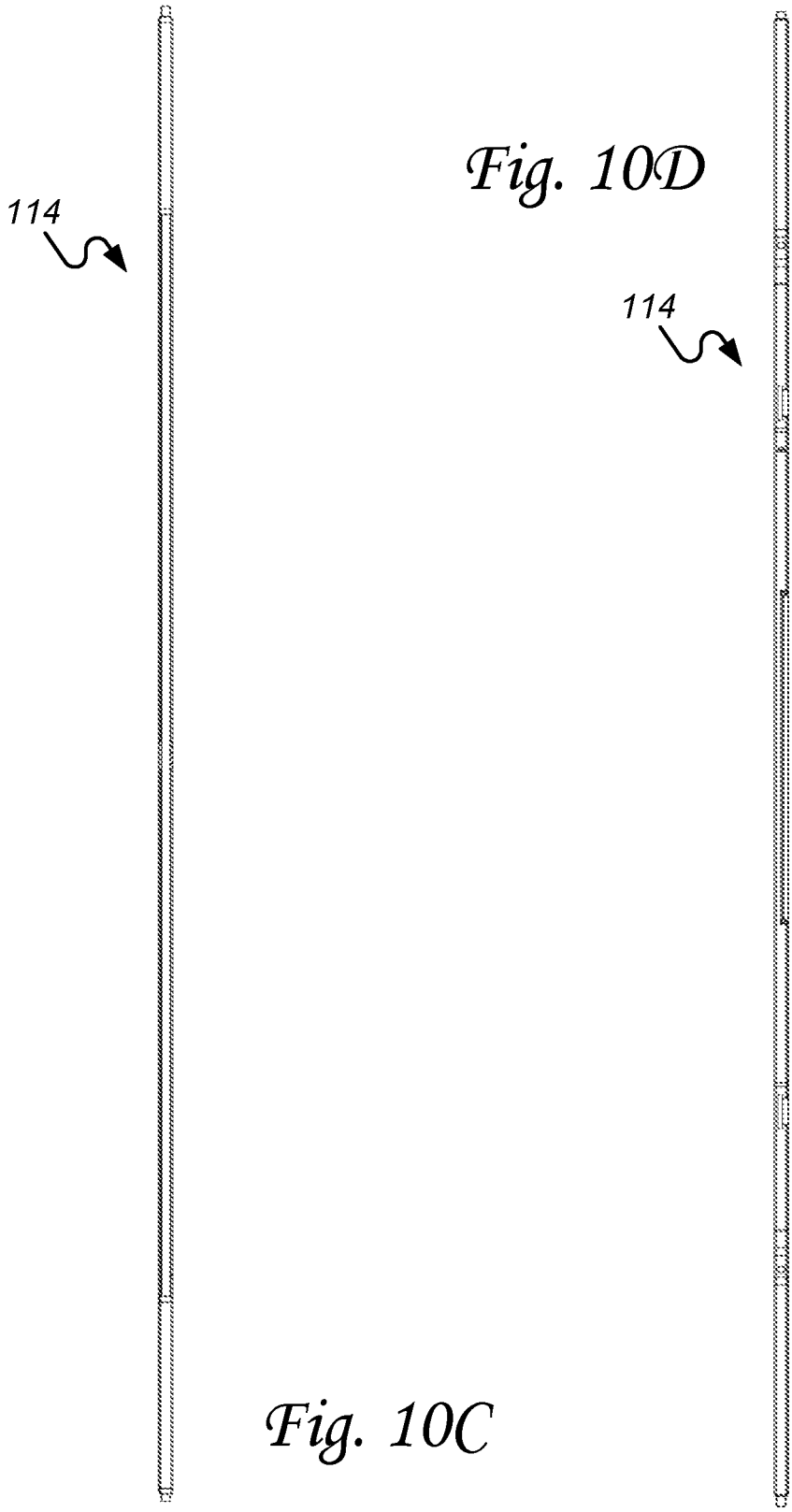
Figure 10E:
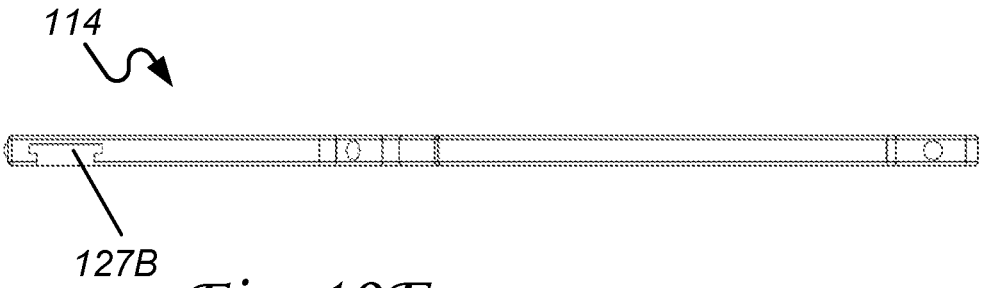
Figure 10F:
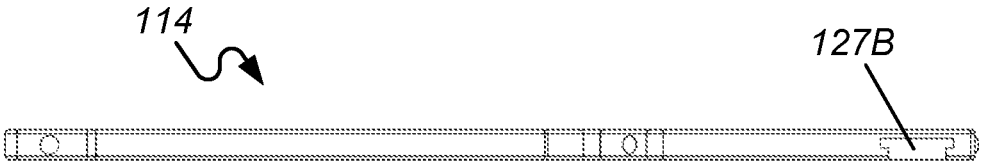

Referring to FIGS. 10A-10F, there is illustrated one example of a trapezoid panel 114. FIG. 10A is a back view of a trapezoid panel 114. FIG. 10B is a front view of a trapezoid panel 114. FIG. 10C is a bottom view of a trapezoid panel 114. FIG. 10D is a top view of a trapezoid panel 114. FIG. 10E is a left side view of a trapezoid panel 114. FIG. 10F is a right side view of a trapezoid panel 114.

In an exemplary embodiment, the trapezoid panel 114 can have one or more trapezoid light weighting holes 188. In this regard, without significantly compromising the structural strength of the trapezoid panel 104, one or more of the trapezoid light weighting holes 188 can be cut out of or otherwise eliminated from the trapezoid panel 114. Such trapezoid light weighting holes 188 reduce material used and thus material costs as well as reduce the weight of the trapezoid panels 104 and thus the overall weight of the collapsible tray 100 making it easier for a user 302 to carry.

Figure 11B:
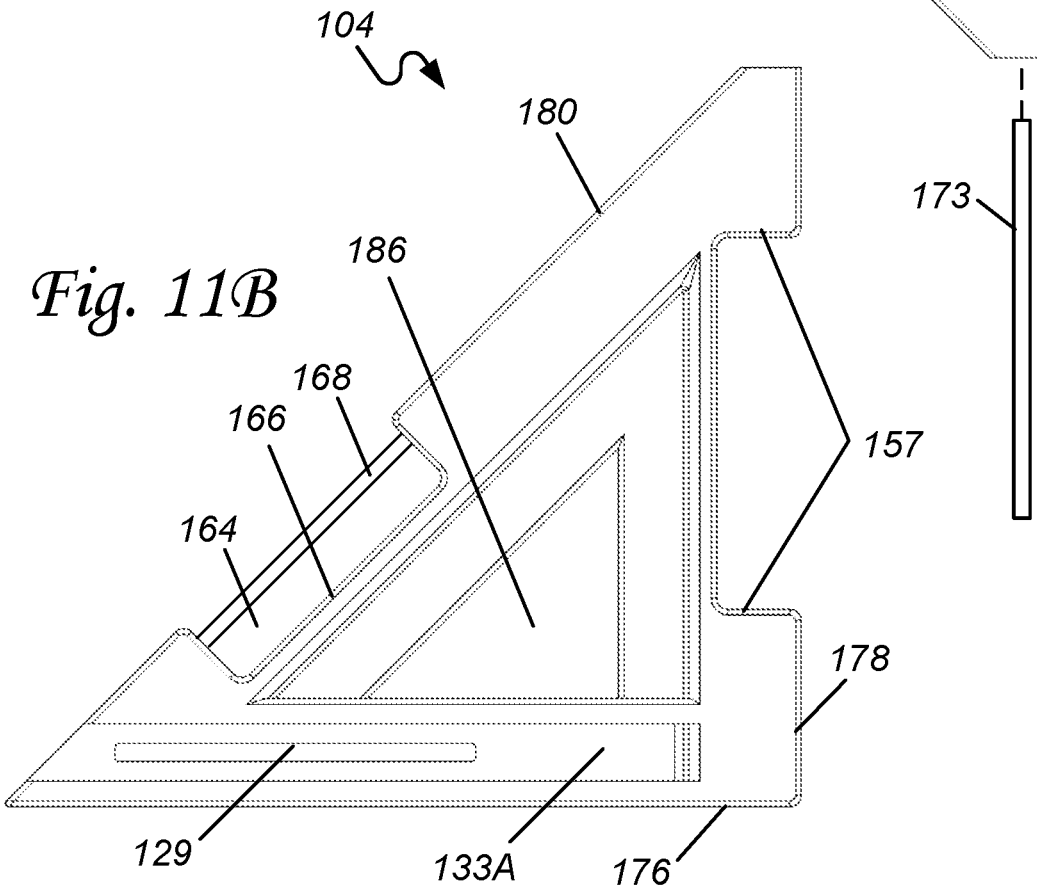
Figure 11C:
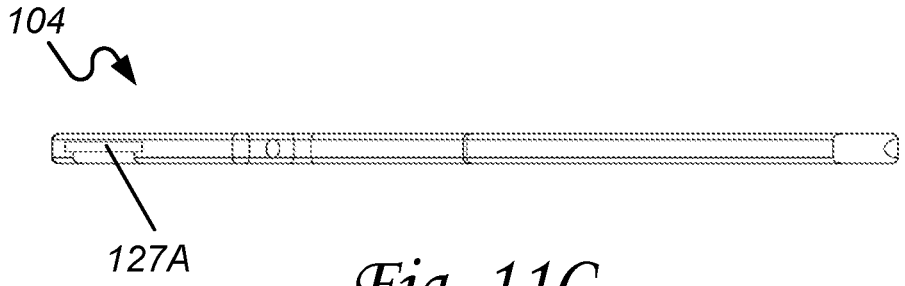
Figure 11D:
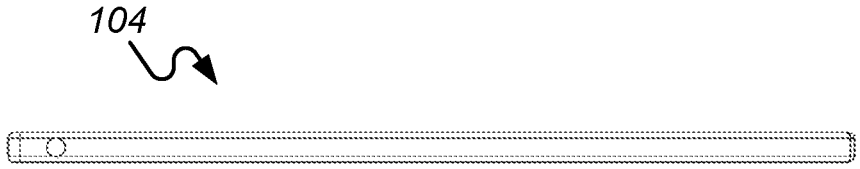
Figure 11E:
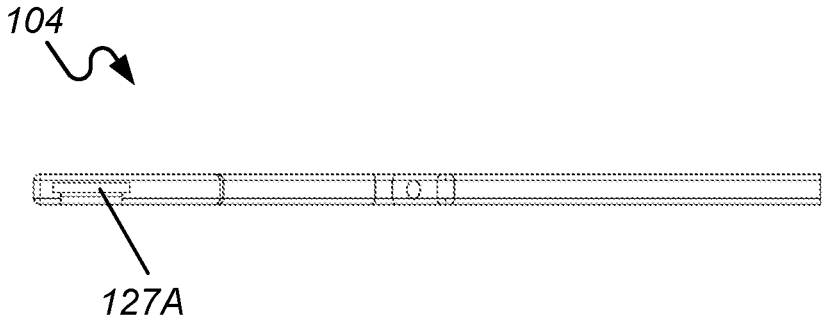
Figure 11F:
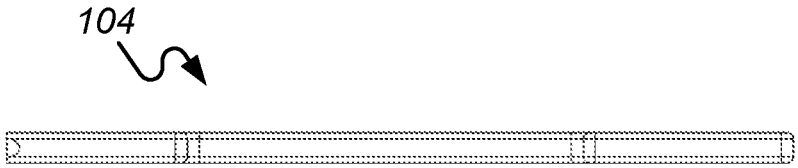

Referring to FIGS. 11A-11F, there is illustrated one example of a triangle panel 104. FIG. 11A is a back side view of a triangle panel 104. FIG. 11B is a front side view of a triangle panel 104. FIG. 11C is a left side view of a triangle panel 104. FIG. 11D is a right side view of a triangle panel 104. FIG. 11E is a top view of a triangle panel 104. FIG. 11F is a bottom view of a triangle panel 104.

In an exemplary embodiment, the triangle panel 104 can have one or more triangle light weighting hole 186. In this regard, without significantly compromising the structural strength of triangle panel 104, one or more of the triangle light weighting holes 186 can be cut out of or otherwise eliminated from triangle panel 104. Such triangle light weighting holes 186 reduce material used and thus material costs as well as reduce the weight of the triangle panels 104 and thus the overall weight of the collapsible tray 100 making it easier for a user 302 to carry.

Figure 12A:
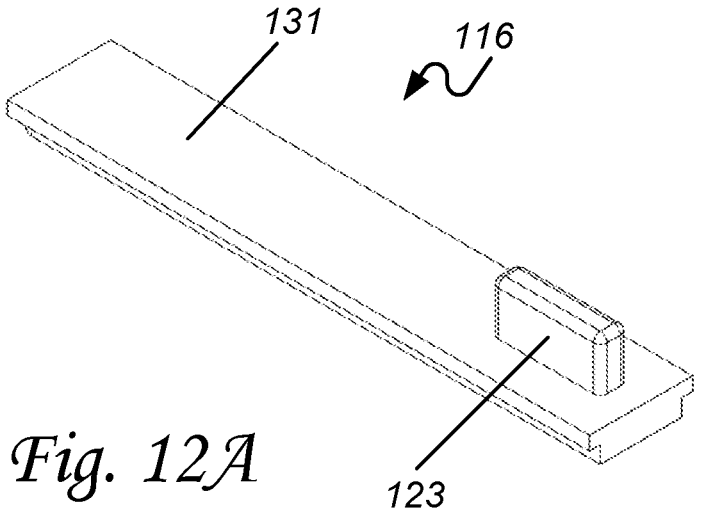
FIGS. 12A-12G illustrate one example of a slide lock.
Figure 12B:
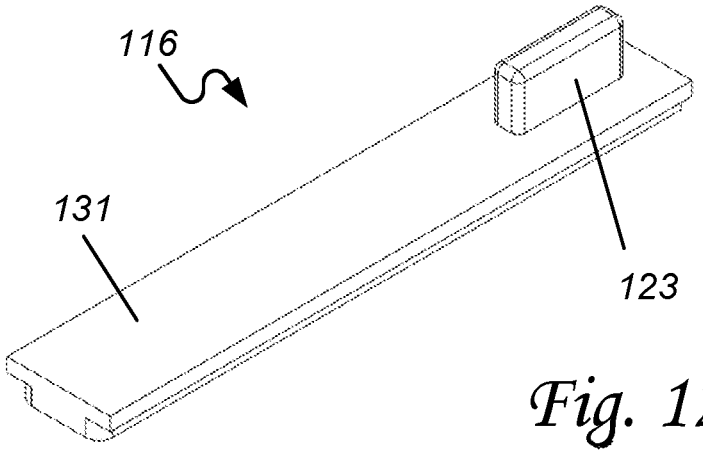
Figure 12C:
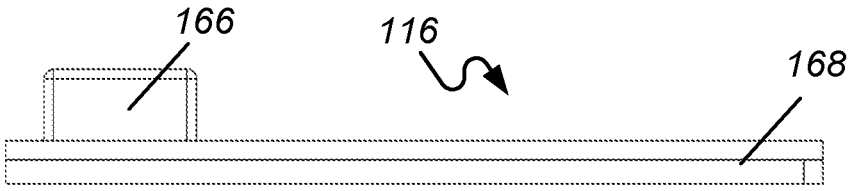
Figure 12D:
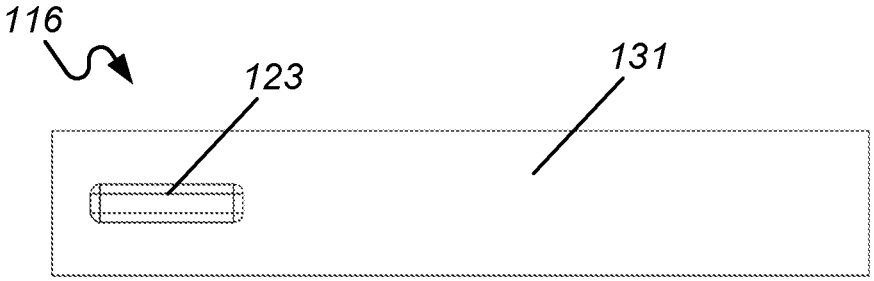
Figure 12E:
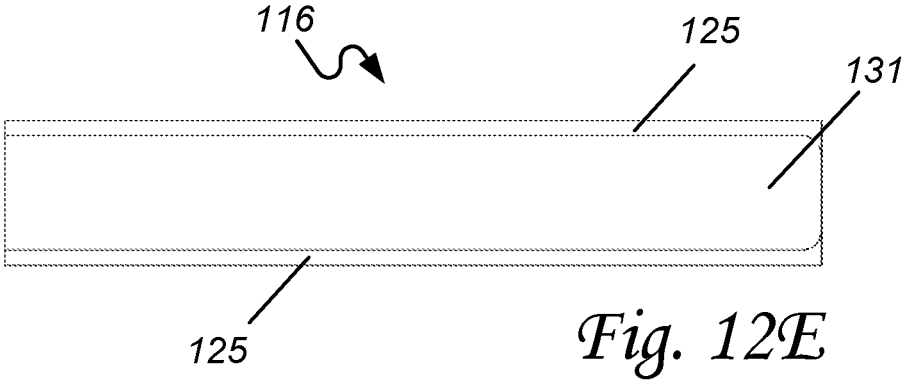
Figure 12F:
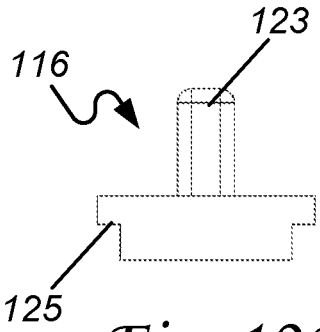
Figure 12G:
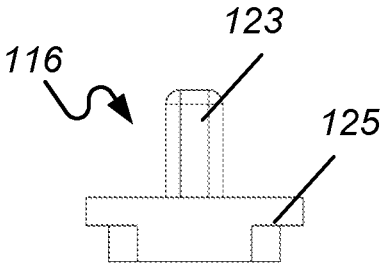

Referring to FIGS. 12A-12G, there is illustrated one example of a slide lock 116. FIGS. 12A and 12B are a top perspective view of a slide lock 116. FIG. 12C is a right and left side view of a slide lock 116. The right and left sides of slide lock 116 are the same. FIG. 12D is a top view of a slide lock 116. FIG. 12E is a bottom view of a slide lock 116. FIGS. 12F and 12G are left and right end views of a slide lock 116.

In an exemplary embodiment, slide lock 116 can comprise slide tab 123 and guide 125. In operation, slide lock 116 can be inserted into slide lock channel 127A-B. In this regard and with reference to at least FIGS. 10E-F and 11A-C, slide lock 116 is inserted into slide lock channel 127A-B such that slide tab 123 protrudes through slide hole 129. Slide hole 129 retains slide lock 116 by retaining slide tab 123. Slide tab 123 can be repositioned by user 302. When the collapsible tray 100 is opened, the slide lock channel 127A-B in the trapezoid panel 114 and triangle panel 104 are aligned allowing the slide lock 116 to cross between the trapezoid panel 114 and triangle panel 104 preventing the collapsible tray 100 from closing by preventing trapezoid panel 114 and triangle panel 104 from folding at the hypotenuse edge 180 and tapered edge 162. In operation, guide 125 aides in orientating slide lock 116 within slide lock channel 127A-B.

In an exemplary embodiment, the trapezoid panel 114 has a first slide lock guide 133A that is recessed along the front surface of the trapezoid panel 114. Triangle panel 104 has a second slide lock guide 133B that is recessed along the front surface of triangle panel 104. When user 302 slides the slide lock 116, the slide lock glides along the first slide lock guide 133A and the second slide lock guide 133B.

In an exemplary embodiment, at least one slide lock 116 comprises a slide body 131 and a slide tab 123 connected to slide body 131. The triangle panel 104 comprises at least one first slide lock channel 127A. The trapezoid panel 114 comprises at least one second slide lock channel 127B. One the first lock channel 127A or the second slide lock channel 127B having a slider hole 127 therethrough. The slide body 131 slidably fits and is retained in either the first slider channel 127A or the second slider channel 127B. Slide tab 123 protrudes through slider hole 127 and is accessible to user 302. In operation, when the collapsible tray 100 is opened the first slide lock channel 127A and the second slide lock channel 127B are aligned allowing user 302 to reposition the slide lock 116 by way of the slider tab 123 to extend between both the first lock channel 127A and the second lock channel 127B keeping the collapsible tray from closing by preventing the triangle panel 104 and the trapezoid panel 114 from folding along the tapered edge 162.

While the preferred embodiment of the invention has been described, it will be understood that those skilled in the art, both now and in the future, may make various improvements and enhancements which fall within the scope of the claims which follow. These claims should be construed to maintain the proper protection for the invention first described.

What is claimed is:

1. A collapsible tray comprising:

at least one foldable side comprising:

at least one trapezoid panel having a tapered edge along a left side and a right side;

at least one first panel connector hole proximate to each of the tapered edges; and at least one triangle panel having at least one hypotenuse edge and at least one second panel connector hole proximate to the at least one hypotenuse edge;

at least one panel connector, the at least one panel connector passes through the at least one first panel connector hole and the at least one second panel connector hole, securing together, in a movable manner, one of the at least one triangle panel to the left side and another one of the at least one triangle panel to the right side of the at least one trapezoid panel;

at least one side panel, each of the at least one side panel is movably interconnected to the at least one foldable side;

a base movably interconnected to each of the at least one foldable side and each of the at least one side panel, forming a tray perimeter, wherein when a user applies a collapsing force to the at least one trapezoid panel or the at least one side panel, each of the hypotenuse edges moves inward, allowing each of the at least one foldable side and each of the at least one side panel to collapse flat on top of the base; and a drawer positioned beneath the base, the drawer comprising at least one first slidable track, the base comprising at least one second slidable track, wherein the at least one first slidable track and the at least one second slidable track interlock to slidably attach the drawer along a bottom surface of the base, wherein the user can slide the drawer out, from beneath the base, to access its contents and slide the drawer back under the base for storage.

2. The collapsible tray in accordance with claim 1, further comprising:

a drawer lid movably interconnected with the drawer along one edge, wherein when the user slides the drawer out from the bottom of the base the drawer lid can be opened to access contents inside the drawer and the drawer lid can be closed to cover contents inside the drawer before sliding the drawer back under the base for storage.

3. The collapsible tray in accordance with claim 1, further comprising:

a ruler formed on an outer surface of the at least one trapezoid panel or on an outer surface of the base.

4. The collapsible tray in accordance with claim 1, wherein the at least one side panel comprises at least one standoff integrally formed on the side panel and positioned to be in contact with the at least one trapezoid panel, the at least one triangle panel, or the base to prevent crushing between the at least one side panel and the at least one panel connector when the collapsible tray is in a closed position.

5. The collapsible tray in accordance with claim 1, wherein the collapsible tray further comprising:

at least one rotating link and a handle, the side panel comprises at least one contour that forms at least two end portions and a center portion, wherein when the collapsible tray is in a closed position the at least one contour raises at least one end portion, creating a storage passage under each of the at least one end portion where the at least one triangle panel and the at least one trapezoid panel fold along the tapered edge and fit, wherein the center portion creates a recessed passage where the at least one rotating link and the handle fold and fit, wherein when in the closed position the collapsible tray is of uniform thickness across the base.

6. The collapsible tray in accordance with claim 1, further comprising:

at least one folding link, the at least one folding link comprises a first dimpled pattern along at least one surface, and having at least one first rotating link hole, wherein the at least one side panel and the at least one folding link are movably interconnected, allowing the at least one folding link to move inward when the collapsible tray is closed.

7. The collapsible tray in accordance with claim 6, further comprising:

at least one rotating link comprises a second dimple pattern, and having at least one second rotating link hole, wherein a fastening pin is fitted through the at least one first rotating link hole and the at least one second rotating link hole, securing, in a movable manner, the at least one rotating link to the at least one folding link.

8. The collapsible tray in accordance with claim 7, further comprising:

a handle interconnected, in a movable manner, between at least two of the at least one rotating link, wherein the first dimple pattern and the second dimple pattern engage, in a movable manner, allowing the at least one rotating link to hold the handle in an upright position when the collapsible tray is in an open position.

9. The collapsible tray in accordance with claim 8, wherein the handle comprises at least one strengthening rib that is integrally formed and runs laterally along a portion of the surface of the handle between each of the at least one rotating link interconnection points.

10. The collapsible tray in accordance with claim 1, further comprising:

at least one locking tab, the at least one locking tab comprising a tab magnet on one end and is fastened on the other end to either the at least one trapezoid panel or the at least one triangle panel, wherein when the collapsible tray is in an open position the at least one locking tab overlays both the at least one trapezoid panel and the at least one triangle panel, and the tab magnet magnetically engages a magnetic surface on either the at least one trapezoid panel or the at least one triangle panel, whichever is absent the at least one locking tab, keeping the collapsible tray from closing by preventing the at least one triangle panel and the at least one trapezoid panel from moving folding along the tapered edge.

11. The collapsible tray in accordance with claim 1, further comprising:

at least one slide lock, the at least one slide lock comprising a slide body and a slide tab connected to the slide body, the at least one triangle panel comprising at least one first slide lock channel, the at least one trapezoid panel comprising at least one second slide lock channel, wherein one of the at least one first lock channel or one of the at least one second slide lock channel having a slider hole therethrough, wherein the slide body slidably fits and is retained in either the at least one first slider lock channel or the at least one second slider lock channel, wherein the slide tab protrudes through the slider hole and is accessible to the user, wherein when the collapsible tray is opened the at least one first slide lock channel and the at least one second slide lock channel are aligned, allowing the user to reposition the at least one slide lock by way of the slider tab to extend between both the at least one first lock channel and the at least one second lock channel, keeping the collapsible tray from closing by preventing the at least one triangle panel and the at least one trapezoid panel from moving along the tapered edge.

12. A collapsible tray comprising:

at least one foldable side, the at least one foldable side comprising at least one trapezoid panel, and at least one triangle panel, the at least one trapezoid panel having a top trapezoid edge, a bottom trapezoid edge, a left trapezoid edge, and a right trapezoid edge, wherein a portion of a first trapezoid base hinge is positioned along the bottom trapezoid edge, a tapered edge is positioned along each of the left trapezoid edge and the right trapezoid edge, and at least one first panel connector hole is positioned proximate to each of the tapered edges, wherein the at least one triangle panel forms a right triangle having a base edge, a perpendicular edge, and a hypotenuse edge, wherein a portion of a first triangle side panel hinge is positioned proximate to the perpendicular edge and at least one second panel connector hole is positioned proximate to the hypotenuse edge, wherein one of the at least one triangle panel is positioned on the left trapezoid edge and another one of the at least one triangle panel is positioned on the right trapezoid edge, wherein the base edge aligns with the top trapezoid edge and the hypotenuse edge aligns with the tapered edge;

at least one panel connector passes through the at least one first panel connector hole and the at least one second panel connector hole, securing together, in a movable manner, one of the at least one triangle panel to the left trapezoid edge and another one of the at least one triangle panel to the right trapezoid edge;

at least one side panel having a left side panel edge, a right side panel edge, a top side panel edge, and a bottom side panel edge, wherein the bottom side panel edge comprising a portion of at least one first side panel base hinge, and each of the left side panel edge and the right side panel edge comprising a portion of at least one second triangle side panel hinge, wherein each of the at least one first triangle side panel hinge and each of the at least one second triangle side panel hinge are movably interconnected, wherein at least two of the at least one side panel and at least two of the at least one foldable side panel are interconnected, forming a tray perimeter; and a base comprising a portion of at least one second trapezoid base hinge interconnects with the at least one first trapezoid base hinge, securing together, in a movable manner, each of the at least one trapezoid panel to the base;

wherein when a user applies a collapsing force to the at least one trapezoid panel or the at least one side panel, each of the hypotenuse edges move inward, allowing each of the at least one trapezoid panel, each of the at least one triangle panel, and each of the at least one side panel to collapse flat on top of the base.

13. The collapsible tray in accordance with claim 12, further comprising:

at least one slide lock, the at least one slide lock comprising a slide body and a slide tab connected to the slide body, the at least one triangle panel comprising at least one first slide lock channel, the at least one trapezoid panel comprising at least one second slide lock channel, wherein one of the at least one first lock channel or one of the at least one second slide lock channel includes a slider hole therethrough, the slide body slidably fits and is retained in either the at least one first slider channel or the at least one second slider channel, the slide tab protrudes through the slider hole and is accessible to the user, wherein when the collapsible tray is opened the at least one first slide lock channel and the at least one second slide lock channel are aligned allowing the user to reposition the slide lock by way of the slider tab to extend between both the at least one first lock channel and the at least one second lock channel, keeping the collapsible tray from closing by preventing the at least one triangle panel and the at least one trapezoid panel from moving along each of the tapered edge.

14. The collapsible tray in accordance with claim 12, further comprising:

a drawer comprising at least one first slidable track, the base comprising at least one second slidable track, the at least one first slidable track and the at least one second slidable track interlock, allowing the drawer to be slidably attached along a bottom surface of the base, wherein the user can slide the drawer out from the bottom of the base to access contents inside the drawer and then slide the drawer back under the base for storage.

15. The collapsible tray in accordance with claim 14, further comprising:

a drawer lid movably interconnected with the drawer along one edge, wherein when the user slides the drawer out from the bottom of the base, the drawer lid can be opened to access contents inside the drawer, and the drawer lid can be closed to cover contents of the drawer before sliding the drawer back under the base for storage.

16. The collapsible tray in accordance with claim 12, further comprising:

a ruler is formed on an outer surface of the at least one trapezoid panel or on an outer surface of the base.

17. The collapsible tray in accordance with claim 12, wherein the at least one side panel comprises at least one standoff integrally formed on the side panel and positioned to be in contact with the at least one trapezoid panel, the at least one triangle panel, or the base to prevent crushing between the at least one side panel and the at least one panel connector when the collapsible tray is in a closed position.

18. The collapsible tray in accordance with claim 12, wherein the collapsible tray further comprising:

at least one rotating link and a handle, the at least one side panel comprises at least one contour that forms at least one end portion and a center portion, wherein when the collapsible tray is in a closed position the at least one contour raises at least one end portion, creating a storage passage under each of the at least one end portion where the at least one triangle panel and the at least one trapezoid panel fold along the at least one tapered edge and fit, wherein the center portion creates a recessed passage where the at least one rotating link and the handle fold and fit, wherein when in the closed position the collapsible tray is of uniform thickness across the base.

19. The collapsible tray in accordance with claim 12, further comprising:

at least one folding link the at least one folding link comprising a first dimpled pattern along at least one surface, and having a first rotating link hole therethrough, wherein the at least one side panel and the at least one folding link are movably interconnected, allowing the at least one folding link to move inward when the collapsible tray is closed.

20. The collapsible tray in accordance with claim 19, further comprising:

at least one rotating link comprising a second dimple pattern, and having a second rotating link hole, wherein a fastening pin is fitted through the first rotating link hole and the second rotating link hole, securing, in a movable manner, the at least one rotating link to the at least one folding link.

21. The collapsible tray in accordance with claim 20, further comprising:

a handle interconnected, in a movable manner, between at least two of the at least one rotating link, wherein the first dimple pattern and the second dimple pattern engage, in a movable manner, allowing the at least one rotating link to hold the handle in an upright position when the collapsible tray is in an open position.

22. The collapsible tray in accordance with claim 12, further comprising:

at least one locking tab, the at least one locking tab comprising a tab magnet on one end and is fastened on the other end to either the at least one trapezoid panel or the at least one triangle panel, wherein when the collapsible tray is in an open position the locking tab overlays both the at least one trapezoid panel and the at least one triangle panel, and the tab magnet magnetically engages a magnetic surface on either the at least one trapezoid panel or the at least one triangle panel whichever is absent the locking tab, keeping the collapsible tray from closing by preventing the at least one triangle panel and the at least one trapezoid panel from moving along the tapered edge.

23. A collapsible tray comprising:

at least one trapezoid panel comprising a top trapezoid edge, a bottom trapezoid edge, a left trapezoid edge, a right trapezoid edge, a portion of a first trapezoid base hinge is positioned along the bottom trapezoid edge, a tapered edge is positioned along each of the left trapezoid edge and the right trapezoid edge, and at least one first panel connector hole is proximate to each of the tapered edges;

at least one triangle panel forms a right triangle comprising a base edge, a perpendicular edge, a hypotenuse edge, and at least one second panel connector hole proximate to the hypotenuse edge, wherein the perpendicular edge comprising a portion of at least one first triangle side panel hinge, wherein one of the at least one triangle panel is positioned on the left trapezoid edge and another one of the at least one triangle panel is positioned on the right trapezoid edge, wherein the base edge aligns with the top trapezoid edge and the hypotenuse edge aligns with the tapered edge;

at least one panel connector, one of the at least one panel connector passes through a first pair of the at least one first panel connector hole and the at least one second panel connector hole, securing together, in a movable manner, one of the at least one triangle panel to the left trapezoid edge and a second one of the at least one panel connector passes through a second pair of the at least one first panel connector hole and the at least one second panel connector hole, securing together another one of the at least one triangle panel to the right trapezoid edge, forming at least one foldable side panel;

at least one side panel comprising a left side panel edge, a right side panel edge, a top side panel edge, and a bottom side panel edge, wherein the bottom side panel edge comprising a portion of at least one first side panel base hinge, and each of the left side panel edge and the right side panel edge comprising a portion of at least one second triangle side panel hinge, wherein each of the at least one first triangle side panel hinge and the at least one second triangle side panel hinge are movably interconnected, wherein at least two of the at least one side panel and at least two of the at least one triangle panel are interconnected, forming a tray perimeter; and a base comprising a portion of at least one second trapezoid base hinge that interconnects with the at least one first trapezoid base hinge, securing together, in a movable manner, each of the at least one trapezoid panel to the base, and a portion of at least one second side panel base hinge that interconnects with the at least one first side panel base hinge, securing together, in a movable manner, each of the at least one side panel to the base;

wherein when a user applies a collapsing force to the at least one trapezoid panel or the at least one side panel, each of the hypotenuse edges move inward, allowing each of the at least one trapezoid panel, the at least one triangle panel, and the at least one side panel to collapse flat on top of the base.

* * * * *